US011566796B2

(12) United States Patent
Oh et al.

(10) Patent No.: US 11,566,796 B2
(45) Date of Patent: Jan. 31, 2023

(54) AIR MANAGEMENT APPARATUS AND METHOD THEREOF

(71) Applicant: LG ELECTRONICS INC., Seoul (KR)

(72) Inventors: Min Kyu Oh, Seoul (KR); Yong Nam Kim, Seoul (KR); Yang Hwan No, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 272 days.

(21) Appl. No.: 17/072,746

(22) Filed: Oct. 16, 2020

(65) Prior Publication Data

US 2021/0172648 A1 Jun. 10, 2021

(30) Foreign Application Priority Data

Dec. 10, 2019 (KR) ..... 10-2019-0163424
Dec. 10, 2019 (KR) ..... 10-2019-0163426
(Continued)

(51) Int. Cl.
*F24F 1/0033* (2019.01)
*F24F 1/0014* (2019.01)
(Continued)

(52) U.S. Cl.
CPC ..... *F24F 1/0033* (2013.01); *F24F 1/005* (2019.02); *F24F 1/0011* (2013.01);
(Continued)

(58) Field of Classification Search
CPC ..... F24F 1/0033; F24F 1/0011; F24F 1/0029; F24F 1/005; F24F 1/0063; F24F 1/0073;
(Continued)

(56) References Cited

U.S. PATENT DOCUMENTS 4,733,542 A 3/1988 Blair
4,958,500 A 9/1990 Kuroda et al.
(Continued)

FOREIGN PATENT DOCUMENTS

CN 1752600 3/2006
CN 1752603 3/2006
(Continued)

OTHER PUBLICATIONS

European Search Report dated Mar. 29, 2021 issued in Application No. 20203259.5.
(Continued)

*Primary Examiner* — Emmanuel E Duke
(74) *Attorney, Agent, or Firm* — KED & Associates, LLP

(57) ABSTRACT

An air management device may include three independently operated primary impellers 131, 131', 131", and drawn-in air is discharged through discharge ports 15'-1, 15'-2, 15'-3 provided in the front plate 15 of the housing 10. Louvers 141, 142, 143installed downstream of the air flow and discharge ports 15'-1, 15'-2, 15'-3 may be independently opened or closed to provide discharge of the air to the surrounding environment. Further, at least one retractable or pop-up fan may be provided. A bottom inlet 11' may be formed on the bottom plate 11 of the housing 10 facing the floor of the living space above a predetermined distance. The replaceable filter 300 may be installed to filter the air sucked through the bottom inlet 11', and may be drawn in and out of the housing 10.

20 Claims, 51 Drawing Sheets

(30) Foreign Application Priority Data

| | | |
|---|---|---|
| Dec. 10, 2019 | (KR) | 10-2019-0163428 |
| Dec. 10, 2019 | (KR) | 10-2019-0163430 |
| Dec. 10, 2019 | (KR) | 10-2019-0163431 |
| Dec. 10, 2019 | (KR) | 10-2019-0163432 |
| Dec. 10, 2019 | (KR) | 10-2019-0163437 |
| Dec. 10, 2019 | (KR) | 10-2019-0163438 |
| Dec. 10, 2019 | (KR) | 10-2019-0163441 |
| Dec. 10, 2019 | (KR) | 10-2019-0163444 |
| Dec. 17, 2019 | (KR) | 10-2019-0168728 |

(51) Int. Cl.

| | |
|---|---|
| ***F24F 13/14*** | (2006.01) |
| ***F24F 13/20*** | (2006.01) |
| ***F24F 13/02*** | (2006.01) |
| ***F24F 1/0073*** | (2019.01) |
| ***F24F 1/035*** | (2019.01) |
| ***F24F 13/08*** | (2006.01) |
| ***F24F 1/0087*** | (2019.01) |
| ***F24F 1/005*** | (2019.01) |
| ***F24F 1/0063*** | (2019.01) |
| ***F24F 13/28*** | (2006.01) |
| ***F24F 13/30*** | (2006.01) |
| ***F24F 1/0011*** | (2019.01) |
| ***F24F 1/0029*** | (2019.01) |
| ***F24F 13/06*** | (2006.01) |
| ***F24F 13/32*** | (2006.01) |
| *F24F 3/00* | (2006.01) |

(52) U.S. Cl.

CPC ..... *F24F 1/0014* (2013.01); *F24F 1/0029* (2013.01); *F24F 1/0063* (2019.02); *F24F 1/0073* (2019.02); *F24F 1/0087* (2019.02); *F24F 1/035* (2019.02); *F24F 13/0236* (2013.01); *F24F 13/06* (2013.01); *F24F 13/085* (2013.01); *F24F 13/14* (2013.01); *F24F 13/20* (2013.01); *F24F 13/28* (2013.01); *F24F 13/30* (2013.01); *F24F 13/32* (2013.01); *F24F 2003/008* (2013.01); *F24F 2013/205* (2013.01); *F24F 2221/36* (2013.01)

(58) Field of Classification Search

CPC ..... F24F 1/0087; F24F 1/035; F24F 13/0236; F24F 13/06; F24F 13/085; F24F 13/14; F24F 13/20; F24F 13/28; F24F 13/30; F24F 13/32; F24F 13/222; F24F 2003/008; F24F 2003/205; F24F 2221/36; F24F 11/50; F24F 11/58; F24F 11/79; F24F 2120/12

See application file for complete search history.

(56) References Cited

U.S. PATENT DOCUMENTS

| | | | | |
|---|---|---|---|---|
| 6,295,823 | B1 | 10/2001 | Odom et al. | |
| 2013/0149956 | A1 | 6/2013 | Su | |
| 2017/0120182 | A1 | 5/2017 | Kim et al. | |
| 2017/0176026 | A1 | 6/2017 | Lee | |
| 2018/0216835 | A1 | 8/2018 | Yun et al. | |
| 2018/0335221 | A1* | 11/2018 | Cho | F24F 1/0087 |

FOREIGN PATENT DOCUMENTS

| | | |
|---|---|---|
| CN | 107143958 | 9/2017 |
| CN | 108413494 | 8/2018 |
| CN | 109489122 | 3/2019 |
| CN | 109812873 | 5/2019 |
| CN | 110160161 | 8/2019 |
| CN | 110160162 | 8/2019 |
| CN | 110186117 | 8/2019 |
| CN | 110285488 | 9/2019 |
| EP | 1767873 | 3/2007 |
| EP | 3009752 | 4/2016 |
| EP | 3211338 | 8/2017 |
| EP | 3372907 | 9/2018 |
| EP | 3376123 | 9/2018 |
| EP | 3379155 | 9/2018 |
| EP | 3489589 | 5/2019 |
| GB | 2468326 | 9/2010 |
| JP | H09-178259 | 7/1997 |
| JP | 2016-031163 | 3/2016 |
| JP | 2016-211846 | 12/2016 |
| KR | 10-2004-0106051 | 12/2004 |
| KR | 10-2005-0023790 | 3/2005 |
| KR | 10-2009-0038555 | 4/2009 |
| KR | 10-2009-0043232 | 5/2009 |
| KR | 10-2009-0091527 | 8/2009 |
| KR | 10-2009-0098514 | 9/2009 |
| KR | 10-2013-0043980 | 5/2013 |
| KR | 10-2013-0058716 | 6/2013 |
| KR | 101384150 | 4/2014 |
| KR | 101385286 | 4/2014 |
| KR | 10-2015-0082967 | 7/2015 |
| KR | 10-2018-0123642 | 11/2018 |
| KR | 10-2018-0127223 | 11/2018 |
| KR | 10-2019-0010395 | 1/2019 |
| WO | WO 2009/057869 | 5/2009 |
| WO | WO 2010/110980 | 9/2010 |
| WO | WO 2018/192384 | 10/2018 |
| WO | WO 2018/196591 | 11/2018 |
| WO | WO 2019/030796 | 2/2019 |
| WO | WO 2019/144959 | 8/2019 |
| WO | WO 2019/177414 | 9/2019 |
| WO | WO-2019177414 A1 * | 9/2019 |

OTHER PUBLICATIONS

European Search Report dated Mar. 29, 2021 issued in Application No. 20203257.9.
European Search Report dated Mar. 30, 2021 issued in Application No. 20203261.1.
European Search Report dated Apr. 6, 2021 issued in Application No. 20203253.8.
European Search Report dated Apr. 9, 2021 issued in Application No. 20203249.6.
European Search Report dated Mar. 23, 2021 issued in Application No. 20203252.0.
European Search Report dated Apr. 8, 2021 issued in Application No. 20203247.0.
European Search Report dated Apr. 1, 2021 issued in Application No. 20203242.1.
European Search Report dated Apr. 8, 2021 issued in Application No. 20203243.9.
U.S. Appl. No. 17/072,576, filed Oct. 16, 2020.
U.S. Appl. No. 17/072,656, filed Oct. 16, 2020.
U.S. Appl. No. 17/072,746, filed Oct. 16, 2020.
U.S. Appl. No. 17/072,807, filed Oct. 16, 2020.
U.S. Appl. No. 17/072,891, filed Oct. 16, 2020.
U.S. Appl. No. 17/072,953, filed Oct. 16, 2020.
U.S. Appl. No. 17/072,996, filed Oct. 16, 2020.
U.S. Appl. No. 17/073,040, filed Oct. 16, 2020.
U.S. Appl. No. 17/073,093, filed Oct. 16, 2020.
U.S. Office Action dated Nov. 23, 2022 issued in U.S. Appl. No. 17/073,040.
Jin, Bingtai, CN 1752603 Translation.pdf, "Indoor unit for air conditioner", Mar. 2006, pp. 1-10.
Hwang, Sung Jin, KR 20130043980 Translation.pdf, "Air conditioner", May 2013, pp. 1-16.
U.S. Office Action dated Nov. 21, 2022 issued in U.S. Appl. No. 17/073,093.

* cited by examiner

AIR MANAGEMENT APPARATUS AND METHOD THEREOF

CROSS-REFERENCE TO RELATED APPLICATION(S)

This application claims priority under 35 U.S.C. § 119 to Korean Application Nos. 10-2019-0163424, 10-2019-0163426, 10-2019-0163428, 10-2019-0163430, 10-2019-0163431, 10-2019-0163432, 10-2019-0163437, 10-2019-0163438, 10-2019-0163441, 10-2019-0163444, all filed on Dec. 10, 2019, and Korean Application No. 10-2019-0168728 filed on Dec. 17, 2019, whose entire disclosure(s) is/are hereby incorporated by reference.

BACKGROUND

1. Field

The present invention relates to an air management apparatus, and more particularly, to an air management apparatus or device to be placed over a floor of a livable space and discharges air to the surrounding environment of the livable space.

2. Background

The air management device may maintain the air in a predetermined space in a desired state or temperature to provide a pleasant environment for those in the space. An example may an air conditioner. Various types of air conditioners may be used. The air conditioner may include an indoor unit provided in the same position as the window and the outdoor unit provided outside. In another type, the indoor unit may be installed on the ceiling of a corresponding space, a stand type installed in an indoor space, or a wall type installed on an upper wall of an indoor space.

Other than the window type, the indoor unit are configured to discharge air into the room at a higher position of the indoor space. Therefore, it is difficult to perform air conditioning in accordance with the needs of individual users quickly and accurately. In the case of the window type air conditioner, there is generally one discharge port, and it may be difficult to perform air conditioning in accordance with the needs of individual users.

Recently, livable spaces, e.g., as living rooms, bedrooms, rooms, kitchens, and study rooms, may be connected, and the demand for products that may maximize the efficiency and functionality of the livable space is increasing. As the trend of integration of livable space and the trend of nuclear family overlap, demand for various home appliances are increasing. Air management system is a type of home appliances that can maintain the temperature, humidity, cleanliness, etc. in the livable space and may fulfill the trend. Further, there may be a need for the air management device to harmonize with other elements in the livable space. However, the conventional air conditioner inadequately harmonizes with other elements in the living space.

Korean Publication Nos. 10-2005-0023790 and 10-2015-0082967 and Korean Patent No. 10-2009-0038555 attempt to solve various problems, but are insufficient to disperse the discharged air or meet the needs of the user or multiple users in the livable space. Other than the window type, the indoor unit All the air conditioners except the window type are configured to discharge air into the room at a higher position of the indoor space. Therefore, it is difficult to perform air conditioning in accordance with the needs of individual users more quickly and accurately. In the case of the window type air conditioner, there is generally one discharge port, and thus it is may be difficult to perform air conditioning in accordance with the needs of individual users. Korean Publication Nos. 10-2005-0023790 and 10-2015-0082967 and Korean Patent No. 10-2009-0038555 attempt to solve various problems, but are insufficient to disperse the discharged air or meet the needs of the user or multiple users in the livable space, the trend, and harmonization with other elements.

The above references are incorporated by reference herein where appropriate for appropriate teachings of additional or alternative details, features and/or technical background.

SUMMARY OF THE INVENTION

According to the disclosed embodiment(s), the air management apparatus may be seated on the floor of the livable space in which is the ambient air is sucked in to be heat exchanged to a desired temperature, and is discharged through a plurality of discharge ports. Because the discharge ports are arranged side by side and the air discharge is independently controlled, air management can be performed to meet the needs of the users who may be located in front of a housing of the air management apparatus in left and right directions.

The air discharged by the primary impellers may be guided the air to the primary impeller outlets at a position corresponding to the discharge port, and it is possible to discharge the heat exchanged air stably through each discharge port.

The louver motors for opening or closing of the louvers provided for the discharge ports may be independently driven for precise control of air charge or air dispersal.

Due to the motor block to install the louver motors, the primary impeller guide may be easily installed regardless of the motor type.

The pivot axis for the louver is provided along a longitudinal central axis of the louver using a pivot brackets having a hole, and opening or closing of the louver may be shared or easily controlled.

A primary impeller guide of a heat insulating material may include a plurality of primary impeller openings corresponding to the number of the discharge port and are formed side by side. A plurality of primary impellers are formed in the openings to allow customization of air delivery to side-by-side located users in front of the housing.

In the disclosed embodiment(s), a branch air flow may be formed at least one of a plurality of primary impeller openings to divert air to at least one retractable fan or pop-up fan allow discharge of air further and to other regions of the livable space.

In the disclosed embodiment(s), at least one retractable fan or pop-up fan protrudes above the upper surface of the housing to send the air to a position farther than at least one discharge ports provided in the front of the housing.

In the disclosed embodiment(s), each primary impeller may be independently driven to meet the needs of various users in front of the housing with the air discharged through the respective discharge ports.

The louver installed in each discharge port to open or close the discharge port and the opened angle of each louver may be independently controlled to adjust the vertical and horizontal angles of the air discharged from the discharge port to the user to allow direct or indirect delivery of air.

In the disclosed embodiment(s), humidity may be added to the air to provide a comfortable and/or healthy environment to the livable space.

In the disclosed embodiment(s), a replaceable filter may be installed at a position past the bottom inlet formed in the bottom plate of the housing, and the replaceable filter may be pulled in and out through the entrance of the front lower portion of the housing to facilitate the maintenance and removal.

In the present embodiment(s), one side end of the housing may be partitioned to form a first space for the first retractable or pop-up fan and/or a humidifier, the other end of the housing may be partitioned to formed a second space for a machine room and/or a second retractable or pop-up fan to provide more flexibility of various operation modes.

In the present embodiment(s), the upper surface of the housing is formed with a flat top plate for placement of various items to allow efficient usage of space the air management apparatus or device.

According to another feature of the present embodiment (s), the housing of the air management apparatus or device imitates a household furnishing, and houses a heat exchanger to supply the heat exchanged air into the living space. According to such a configuration, the air management apparatus may perform air management of the living space while being in harmony with the surroundings.

In the present embodiment(s), a thermal imaging camera may be provided to detect the user's body temperature in the front of the housing, and using the information obtained from the thermal imaging camera to perform the air management to suit the user.

BRIEF DESCRIPTION OF THE DRAWINGS

The embodiments will be described in detail with reference to the following drawings in which like reference numerals refer to like elements wherein.

DETAILED DESCRIPTION

Figure 1:
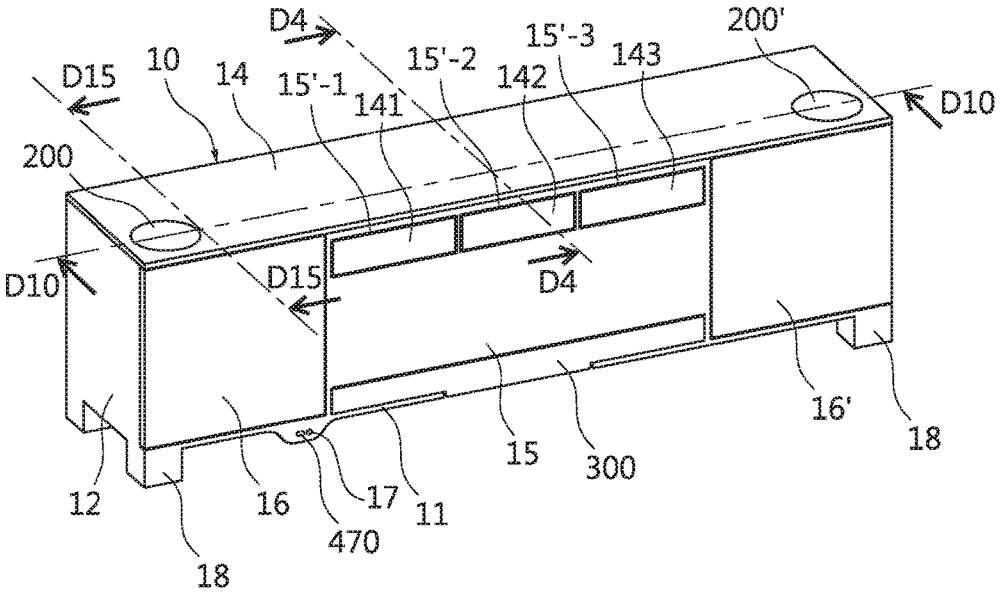
FIG. 1 is a perspective view showing an embodiment of the air management apparatus.

As shown FIGS. 1-3B, the housing 10 provides an outer appearance of the air management device and may have a hexahedron shape extending from side to side. The lower surface of the housing 10 faces the floor of the living space, and the rear surface of the housing 10 faces the wall of the living space. The upper surface of the housing 10 may have a rectangular shape of a predetermined surface area. The upper surface of the housing 10 may be located at a height such that a person may look down on the upper surface while standing up. The housing 10 may have a width from side to side which is at least two times the height, and the height may be greater than the front to back lengths of the upper surface. For example, the width may be 2000 mm (approximately 79 inches), the front-back length may be 450 mm (approximately 18 inches), and the height may be 600 mm (approximately 24 inches).

The bottom plate 11 provides a bottom of the housing 10. The bottom plate 11 may have a rectangular shape and is positioned at a predetermined distance above a floor of a livable space. Side plates 12 are attached on both sides of the bottom plate 11 to provide the side surfaces of the housing 10. A top plate 14 may provide an upper surface of the housing 10. The upper surface of the top plate may provide a flat planar surface to allow placement of various articles and/or electronics. As can be appreciated, the placement of articles and/or electronics may be restricted to prevent interference with retractable first and second fans 200, 200' (or first and second pop-up fans 200, 200') described below.

Figure 2:
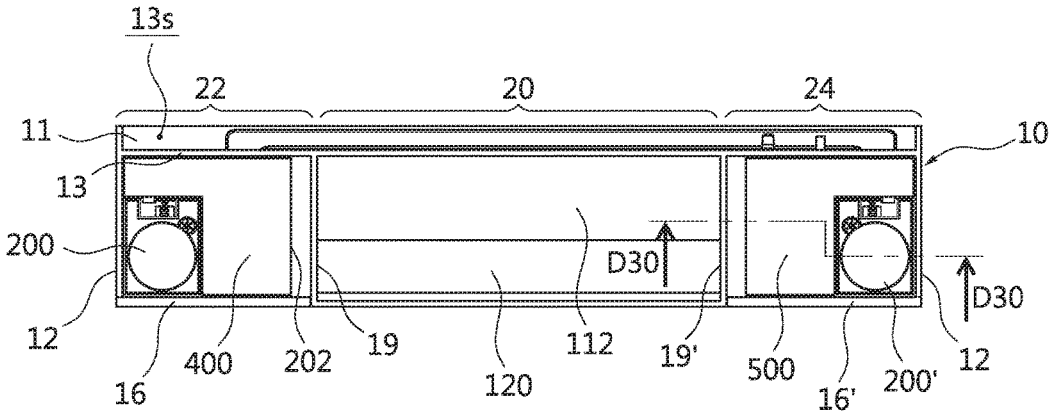
FIG. 2 is a top plan view showing the inside of the air management device shown in FIG. 1.
Figure 30A:
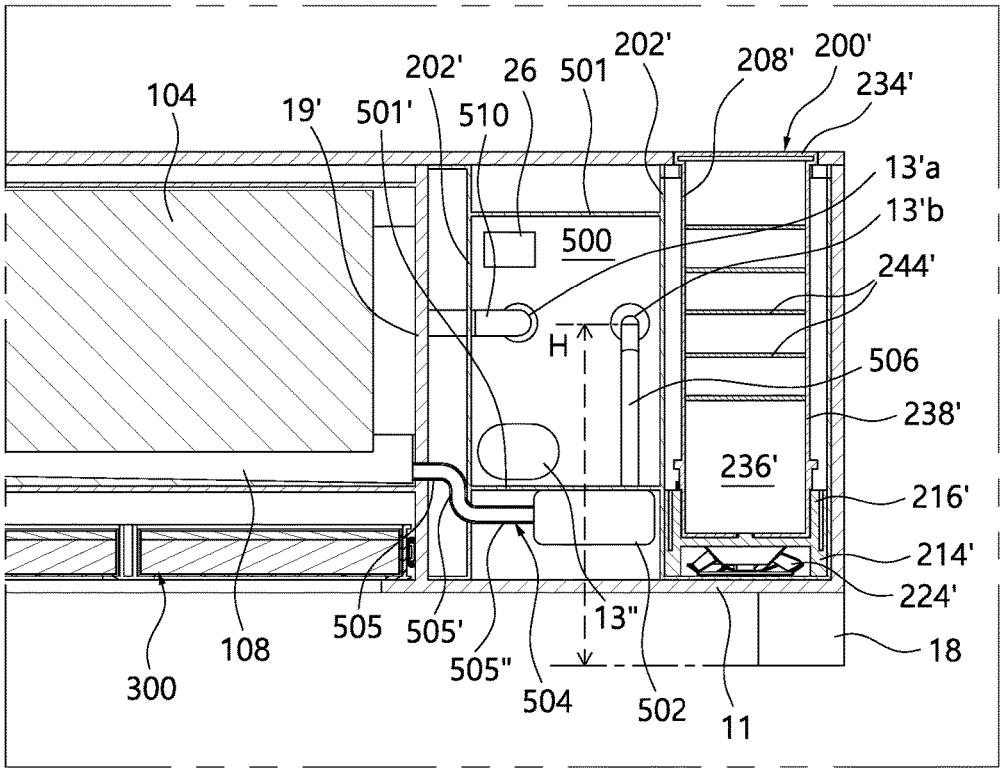
FIG. 30A is a cross-sectional view taken along the line D30-D30 in FIG. 2.
Figure 30B:
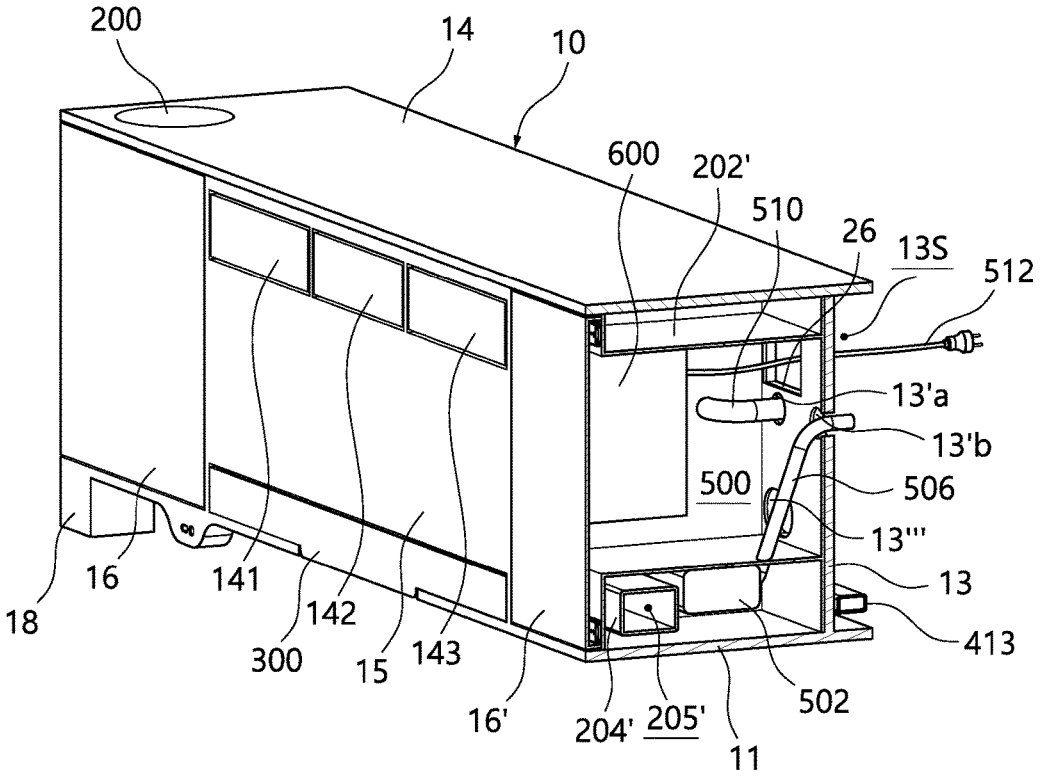
FIG. 30B is perspective view of the machine room 500.
Figure 30C:
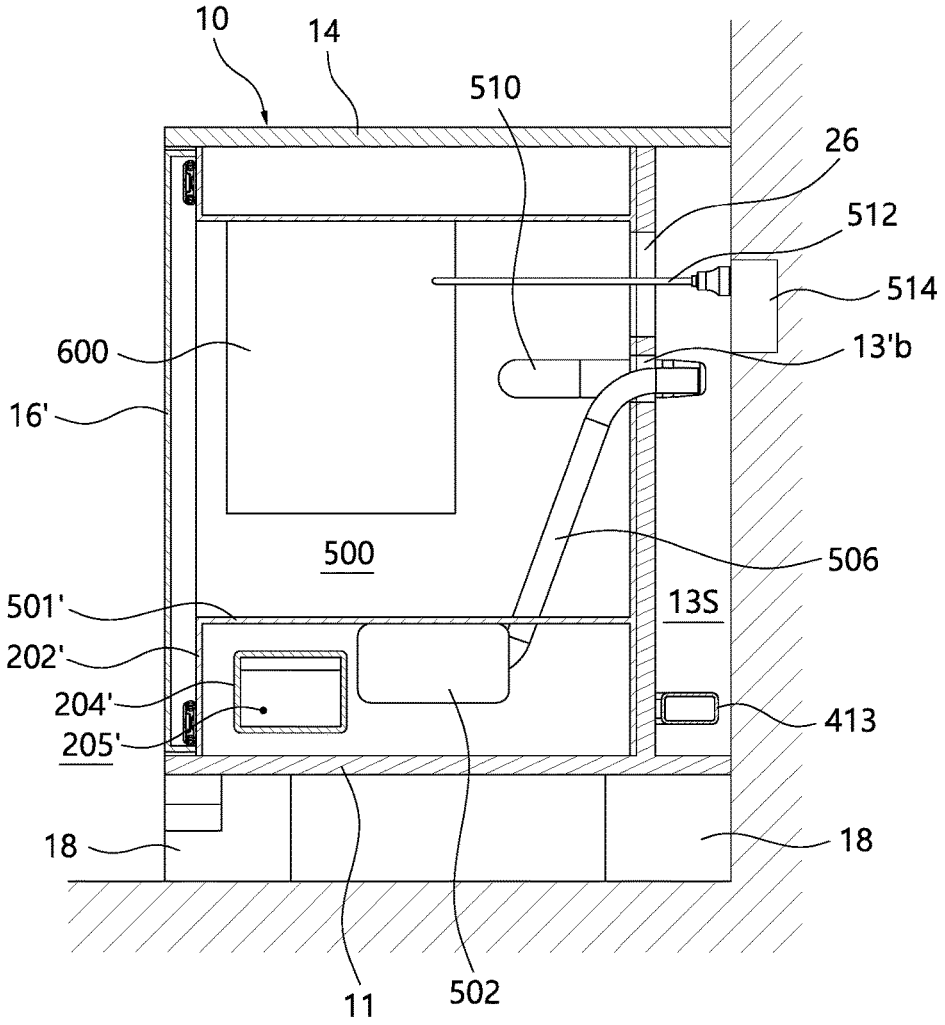
FIG. 30C is a sectional view of the machine room 500.

A back plate 13 provides a rear surface of the housing 10. The back plate 13 may be provide at a rear of the bottom plate 11, the side plates 12 and the top plate 14. However, as shown in FIG. 2, the back plate 13 is attached a predetermined distance from the rear ends of the bottom plate 11, the side plates 12 and the top plate 14 such that a predetermine gap exists between the back plate 13 and the wall of the livable space. When the housing 10 is installed in the livable space, a rear space 13*s* is may be between a rear surface of the back plate 13 and the wall surface. The back plate may further include first and second holes 13'*a* and 13'*b* through which a discharge pipe 506 and a gas supply hose 510 may pass therethrough, which is described in FIGS. 30A-30C. A pair of third holes 13'*c* allows passage for a connection duct 413 of a humidifier described below. Through hole 13" allow passage of adjacent inlet and outlet pipes of a heat exchanger 104. Reference numeral 29 is a through hole formed in the second partition plate 19' for the gas supply hose 510. These holes 13'*a*, 13'*b* and 29 are formed slightly larger than the diameter of the corresponding hoses 506 and 510.

A power supply hole 26 may be provided to have a size corresponding to the size of a wall outlet 516 (FIG. 30C), and may have a size larger than the through hole 13". The power supply hole 26 is formed at an upper end of the rear plate 13 corresponding to the rear surface of the second secondary space 24. The power supply hole 26 allows passage of the power cord 512 to the wall outlet 516. The power supply 26 also allows the user to access the outlet 514 on the wall to perform engagement and separation of the power cord 512 and the outlet 514. The size of the power supply hole 26 may be at least larger than the front area of the outlet 514. The size of the power supply hole 26 may be such that the outlet 514 can be easily seen by the user through the rear space 13' and the power cord 512 can be manually connected. The through hole 13" may be smaller than the power supply hole 26.

The front plate 15 may provide a front surface of the housing 10. The front plate 15 may not provide the entire front surface of the housing 10, but may be provided along a position corresponding to a primary air flow space 20 described below. First, second and third discharge ports 15'-1, 15'-2, and 15'-3 in a side-by-side configuration may be formed at the upper end of the front plate 15. The discharge ports 15'-1, 15'-2, and 15'-3 have a rectangular shape, which may correspond to the shape of the housing 10.

An input unit 17, e.g., a user interface, through which a user's may be received may provide along a front of the housing 10. For example, the input unit 17 may be formed on the front lower end of the housing 10, but as can be appreciated, the position at which the input unit 17 may be placed is not limited to the lower end. For example, it may be formed as part of the front plate 15 of the housing 10. The input unit 17 may be formed so that a part of the user's input is displayed on the outside, and the remaining components may be formed in the inner space.

The input unit 17 may receive a user's input for the overall operation of the air management device of the present disclosure. Thus, the user can input the ON/OFF of the air management device, the temperature of the discharged air, the air volume, the wind direction, and a user operation for the operation of various components described later through the input unit 17. The input unit 17 may comprise a push button, a touch input and/or a display.

The input unit 17 may be implemented in the form of a button or a touch pad. As can be appreciated, the input unit 17 may be implemented in the form of a touch screen on the display. In another embodiment, the input unit 17 and the display may be integrally implemented. A touch panel may be formed on the display to receive a manipulation input of a user through touch.

The display may also include a flat panel display. The display may display a user interface (UI) or a graphic user interface (GUI) related to driving and operation of the air management apparatus. The display may be, e.g., a liquid crystal display, a thin film transistor-liquid crystal display, an organic light-emitting diode, a flexible display, a three-dimensional display 3D display). When the display and the touch sensor for detecting the touch operation form a mutual layer structure to form a touch screen, the display may be used as an input device in addition to the output device. The touch sensor may have, for example, a form of a touch film, a touch sheet, a touch pad, or the like.

In one embodiment, the user may directly touch the input unit 17 to input a user operation. Alternatively, or in addition thereto, the input unit 17 may receive a user manipulation input through a wireless signal of an external device. The input unit 17 may include a wireless communication module for performing wireless communication with the external device. The wireless communication may be based on infrared (IR) protocol, near field communication (NFC) protocol, Wi-Fi protocol, Bluetooth protocol, Zigbee protocol, BLE (Bluetooth Low Energy) protocol, telecommunication protocol, e.g., LTE or 5G, and/or other wireless communication protocol. Alternatively, or in addition thereto, a remote controller may be used to allow a user's manipulation to be received through infrared communication.

At least four corners of the housing 10, legs 18 of predetermined height to allow a lower surface of the bottom plate 11 to be a predetermined distance from a floor or bottom surface of the living space. Further, the legs 18 may create a space in which air can be sucked into a bottom inlet 11' formed in the bottom plate 11. As can be appreciated, additional legs 18 may be provided based on, e.g., the side-to-side length of the housing 10.

The outer surfaces of the side plate 12, the top plate 14, the front plate 15, the first movable panel or plate 16, and a second movable panel or plate 16' of the housing 10 may be made of a material to provide an aesthetically appealing appearance. The outer surface of the housing 10 may be formed to have an appearance of a household furniture. For example, the material surface of the housing 10 may have an appearance of a wood material, a varnished finish or coated finish.

The interior of the housing 10 may be divided into three spaces, where a first partition wall 19 separates the primary air flow space 20 and a first secondary space 22 and a second partition wall 19' separates the primary air flow space 20 and a second secondary space 24. Within the primary air flow space 20, the air in the livable space is forced through the bottom inlet 11' to be heat exchanged, and exhausted through the first, second and third discharge ports 15'-1, 15'-2, 15'-3 into the livable space. The first retractable fan or first pop-up fan 200 and the humidifier 400 may be installed within the first secondary space 22, and a machine room 500 and the second retractable fan or second pop-up fan 200' may be installed in the second secondary space 24. The left and right width of the primary air flow space 20 may be at least two times greater than the left and right widths of the first secondary space 22 and the second secondary space 24. The left and right width of the primary air flow space 20 may be dependent upon the number of discharge ports 15'-1, 15'-2, 15'-3, . . . **15'-*n* to be formed in the front plate 15 of the housing 10**.

Access to the first and second space 22, 24 may be made through the first and second moveable panels 16, 16'. The first and second movable panels 16, 16' may be installed on the remaining front of the housing 10 not covered by the front plate 15. The first and second movable panels 16, 16' may be configured as slidable access panels or plates. See FIG. 38. Alternatively, the first and second movable panels may be configured to be hinged, similar doors, to open or close the first secondary space 22 and the second secondary space 24.

Figure 4:
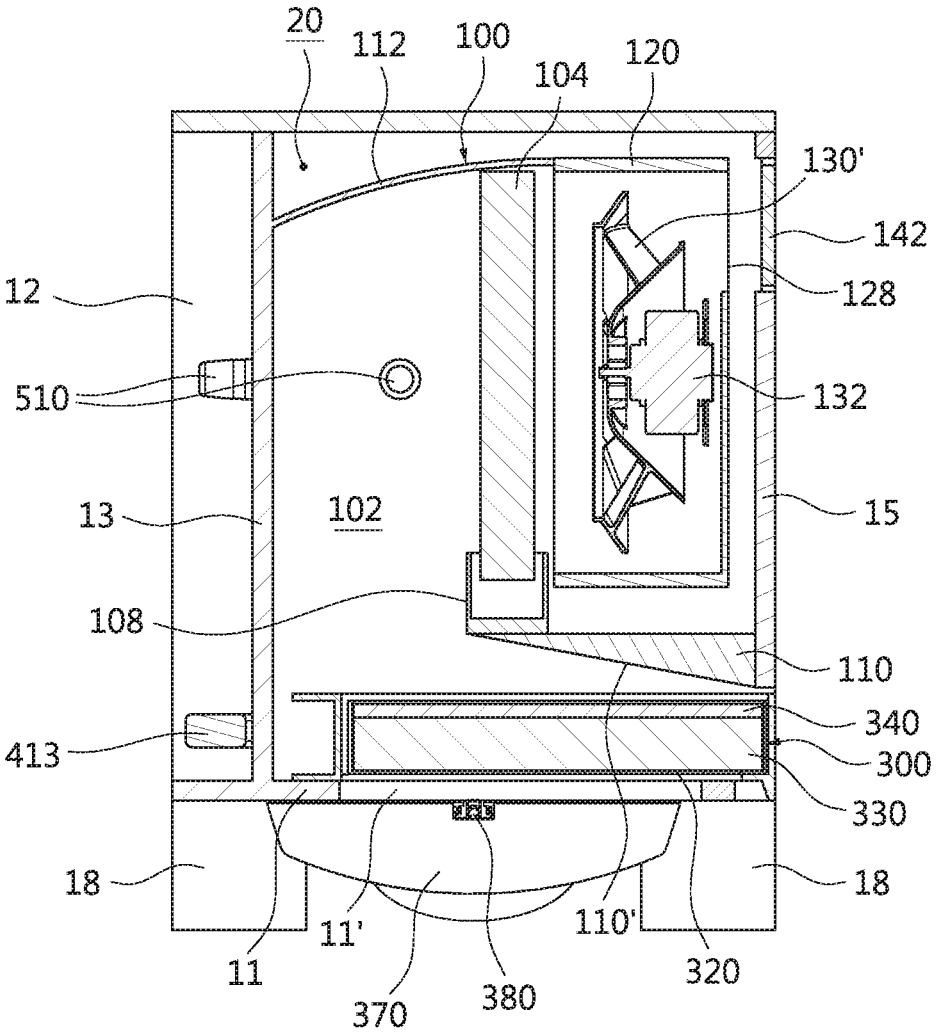
FIG. 4 is a cross-sectional view taken along the line D4-D4 of FIG. 1.
Figure 5:
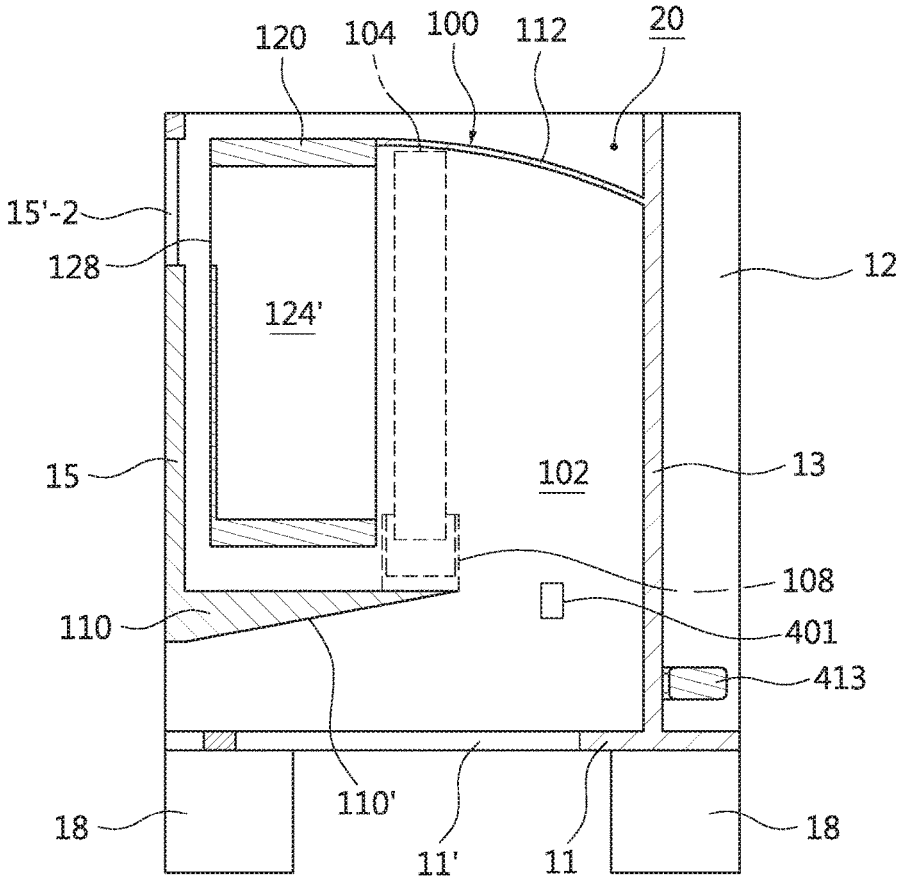
FIG. 5 is a cross-sectional view taken along the line D5-D5 of FIG. 3.

As shown in FIG. 4, a heating, ventilation and air conditioning (HVAC) system 100 may be installed in the primary air flow space 20 and may be configured to exchange heat with air drawn through the bottom inlet 11'. Thereafter, the suctioned air may discharge to the first, second, and third discharge ports 15'-1, 15'-2, 15'-3. A replaceable filter 300 may be placed at a position corresponding to the bottom inlet 11'. Air passing through the replaceable filter 300 flows through the air passage 102 formed in the primary air flow space 20.

A heat exchanger 104 may be provided in the air flow path 102. The heat exchanger 104 may allow a heat exchange between the air flowing in the air flow path 102 and the working fluid of the heat exchange cycle. For example, in the case of a cooling operation, the heat exchanger 104 may receive heat from the air and may transfer the heat to the outdoor unit for discharge to the outside. In the heating operation, the heat may be transferred from the working fluid while the air passes through the heat exchanger 104 to be transferred into the living space. Of course, in the heating operation, the heat may be supplied from a separate configuration without using the heat exchanger 104. The working fluid delivered from the outdoor unit is delivered to the heat exchanger 104 through the inlet pipe, and the working fluid passed through the heat exchanger 104 is delivered to the outdoor unit through the outlet pipe. A drain pan 108 may be provided under the heat exchanger 104. The drain pan 108 collects and discharges condensed liquid condensed from the air passing through the heat exchanger 104.

In order to form the air passage 102, the primary air flow space 20 may include components for guiding the flow of air. There may be an inlet guide 110 to face the replaceable filter 300. The inlet guide 110 may be provided over a region corresponding to the inlet 11'. The inlet guide 110 may face most of the region or area of the bottom inlet 11'. An angled guide surface 110' may formed in the inlet guide 110 so that air passing through the inlet 11' region adjacent to the front end of the housing 10 may be directed or guided to the back plate 13. The slope of the angled guide surface 110' moves away from the bottom inlet 11' toward the rear plate 13 such that a clearance over the replaceable filter 300 may increase from the front to the rear of the replaceable filter 300.

The air inlet guide 110 may extend toward the rear plate 13, and the air inlet guide 110 may extend about ⅔ of the bottom inlet 11'. As such, the air inlet guide 110 may allow majority of the suctioned air to be delivered to the rear of the air passage 102 inside the housing 10. The drain pan 108 and a primary impeller guide 120 may be located over an upper surface of the inlet guide 110, which is opposite of the angled guide surface 110'.

The air passage 102 may include an upper guide 112. The upper guide 112 may serve as a ceiling or a top cover of the air flow path 102. The upper guide 112 extends from the back plate 13 to the primary impeller guide 120. The upper guide 112 has a curved surface to prevent formation of a vortex or air turbulence at the portion that meets or connects to the rear plate 13. In other words, the back plate 13 and the upper guide 112 may not be perpendicular to each other. Further, a portion of the inner surface of the rear plate 13 corresponding to the air flow path 102 may be curved. The back plate 13 and the upper guide 112 is to be a continuous curved surface rather than abrupt coupling joints. To accomplish such curved surface, the rear surface of the rear plate 13 may be formed to protrude or curve to the outside.

The inlet guide 110 and the upper guide 112 may be made of a heat insulating material or the surfaces of thereof may be coated with a heat insulating material. The heat insulating material may prevent a heat exchange with the surroundings. The upper guide 112 may contact the upper end of the heat exchanger 104 and may extend to the primary impeller guide 120.

Figure 6:
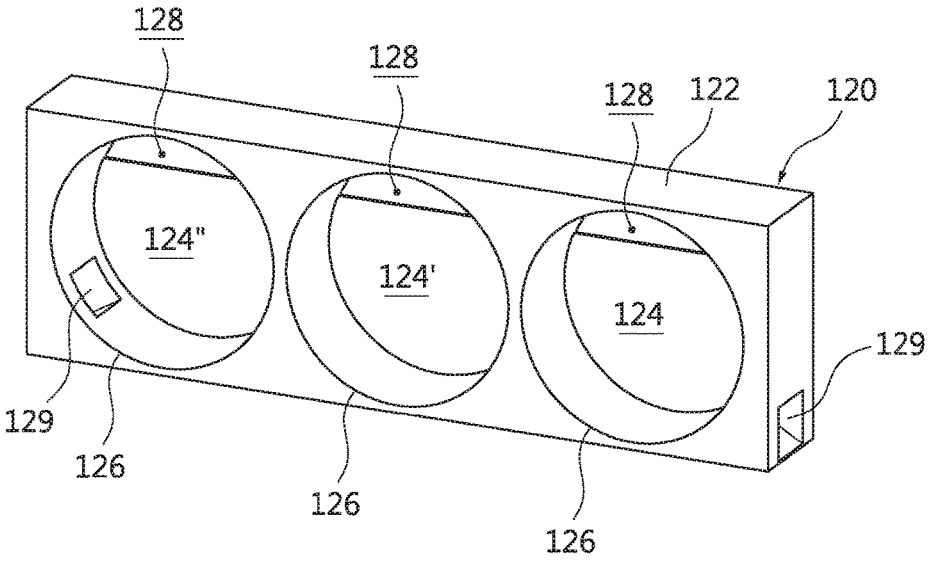
FIG. 6 is a perspective view showing the configuration of a primary impeller guide used in the air management device shown in FIG. 4.
Figure 7:
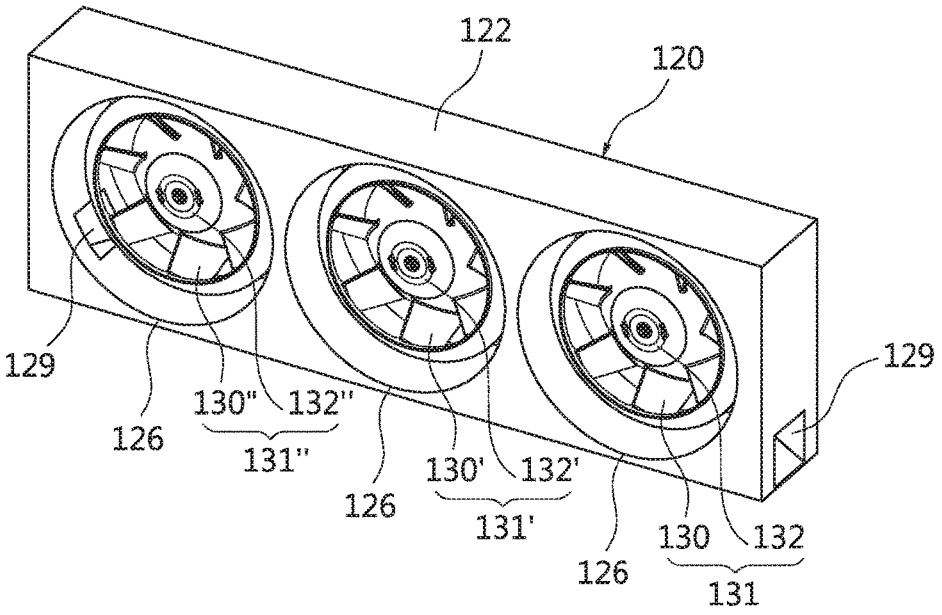
FIG. 7 is a perspective view illustrating that primary impellers located in the primary impeller guide shown in FIG. 6.
Figure 8:
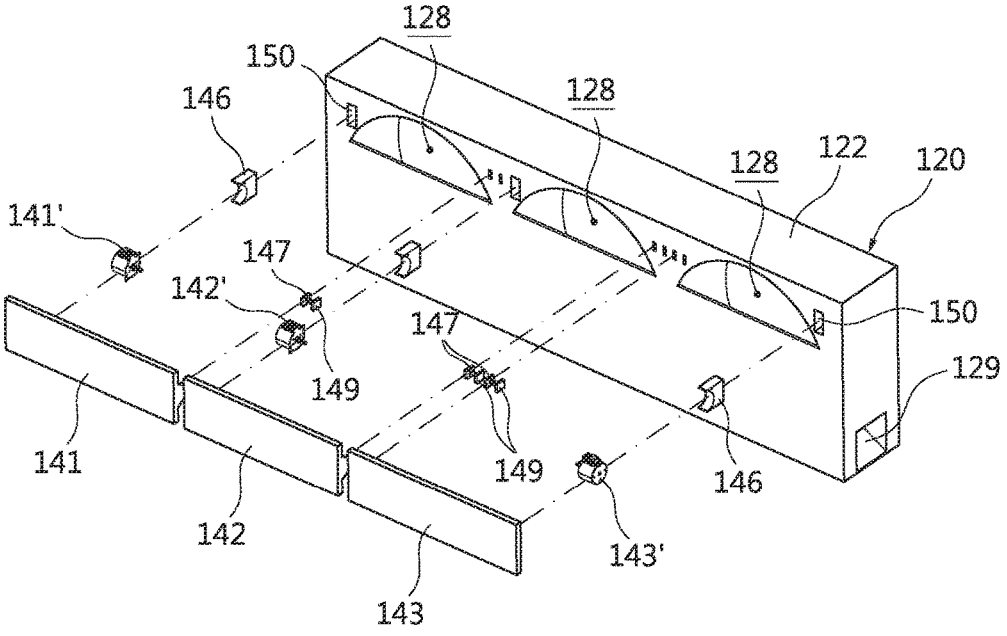
FIG. 8 is an exploded perspective view showing a configuration for discharging air through the discharge port in the front of the housing.

As illustrated in FIGS. 6-8, the primary impeller guide 120 is installed in front of the heat exchanger 104. The primary impeller guide 120 may guide air to be sucked into the air flow passage 102 and discharged to the indoor space through the discharge ports 15'-1, 15'-2, 15'-3. Primary impellers 131, 131' and 131" with primary impeller blades 130, 130' and 130" and primary motors 132, 132' and 132" may be positioned therein. By dividing the air flow into, e.g., three paths, the primary impeller guide 120 separates the air passing through the heat exchanger 104. The primary impeller guide 120 may be made of a thermal insulation material to ensure that the heat-exchanged air passed through the heat exchanger 104 can be delivered to the livable space with minimal heat loss rather than being dissipated inside the housing 10.

A primary impeller frame 122 may be formed of or coated with a thermal insulation material, and serve as the skeleton of the primary impeller guide 120. The primary impeller frame 122 may have a predetermined thickness in the front-rear direction, and a plurality of primary impeller openings 124, 124', and 124" may formed therein. As shown in FIG. 7, the first, second and third primary impellers 131, 131', 131" may be respectively installed in the first, second, third primary impeller openings 124, 124', and 124" to allow rotation of the first, second, and third primary impeller blades 130, 130', 130". The axial centers of the primary impellers may be equal distant from each other or may be different.

The primary impeller openings 124, 124', and 124" face the heat exchanger 104 to form the primary impeller inlet 126 for the primary impellers. However, only a portion of the primary impeller openings 124, 124', 124" may be open to serve as the primary impeller outlets 128, corresponding to the discharge ports 15'-1, 15'-2, 15'-3. In other words, the primary impeller outlets 128 may be formed at a position corresponding to the upper side at primary impeller openings 124, 124' and 124", corresponding to the positions of the first to third discharge ports 15'-1, 15'-2, and 15'-3 of the front plate 15. Hence, the cross-sectional area of the primary impeller outlets 128 may be smaller than the cross-sectional area of the primary impeller openings 124, 124' and 124" or the primary impeller inlets 126. The primary impeller outlets 128 may be provided at an upper end of the openings 124, 124' and 124". Alternatively, the primary impeller outlets may be provided at the middle or lower section of the openings 124, 124' and 124" depending on the position of the first to third discharge ports 15'-1, 15'-2, 15'-3.

A branch air flow channel or passage 129, e.g., a duct, a passageway, conduit, tunnel, etc., may be formed in the primary impeller frame 122 at one side of an inner surface defining the first primary impeller opening 124 and/or the third primary impeller opening 124". A portion of the air flowing through the first primary impeller opening 124 and/or the third primary impeller opening 124" may be diverted to the first and/or second retractable fans 200, 200'. The branch passage 129 may be open (e.g., an outlet) on both sides of the impeller frame 122 to transfer the diverted air to the first secondary space 22 and/or the second secondary space 24.

Figure 42:
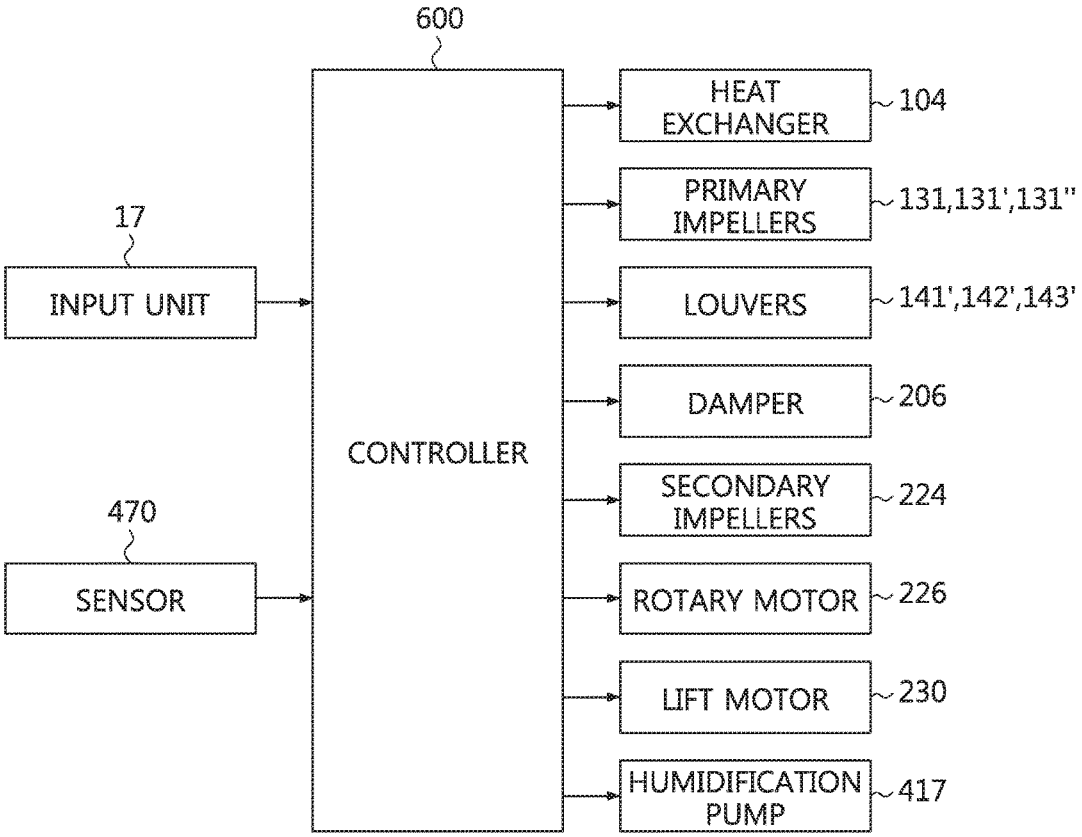
FIG. 42 is a block diagram of an air management device.

As shown in FIG. 7, the primary impellers 131, 131', and 131" are installed in the first, second and third primary impeller openings 124, 124', and 124", respectively. The first, second and third primary impeller blades 130, 130', 130" are rotated by the first, second and third primary impeller motors 132, 132', 132", respectively, to provide a driving force for the air flow. The impeller motors 132-132" may be controlled by a controller 600 (FIG. 42). In the present embodiment, the controller 600 may operate the primary impellers 131-131" to operate simultaneously or independently from each other. Although three (3) primary impellers 131-131" are illustrated, additional impellers may be provided, e.g., additional primary impellers for each of the primary impeller openings and/or additional impellers based on the number of primary impeller openings. Further, although the primary impellers may have the same size and/or the same cubic feet per minute (CFM) for air flow, different sizes or CFM may be used, and/or the size of primary impeller openings may vary. Depending on the location of the primary impeller inlet and outlet, an appropriate fan type may be use. In this embodiment, a turbo fan in which air is drawn in the rotational axis direction and discharged in the centrifugal direction may be used.

In the present embodiment, three (3) dampers, e.g., louvers 141, 142, 143, may be positioned corresponding to the three primary impellers 131, 131', 131". For example, a first louver 141 may be installed in the first discharge port 15'-1, a second louver 142 may be installed at the second discharge port 15'-2, and a third louver 143 may be installed at the third discharge port 15'-3. The louvers 141, 142, 143 may be simultaneously or independently driven by the same driving source or by separate driving sources, respectively, to open and close the discharge ports 15'-1, 15'-2, 15'-3, and to discharge the air. Further, the degree of opening of the discharge ports 15'-1, 15'-2, 15'-3 may be same or different. As can be appreciated, the number of dampers may be changed based on aesthetics of the housing, the number and/or size of the primary impeller openings, and/or the number or size of primary impellers in each primary impeller opening.

Opening or closing the louvers 141, 142, 143 may be performed by louver motors 141', 142', 143'. The output shafts of the louver motors 141', 142', and 143' are connected to the rotational axes of the louvers 141, 142 and 143 so that the louvers 141, 142 and 143 are rotated when the output shafts are rotated. The louver motors 141', 142', and 143' may be driven and/or controlled by the controller 600 to open or close the discharge ports 15'-1, 15'-2, 15'-3. The louver motors 141', 142', 143' may also adjust the opening angles of the louvers 141, 142, 143.

Figure 9:
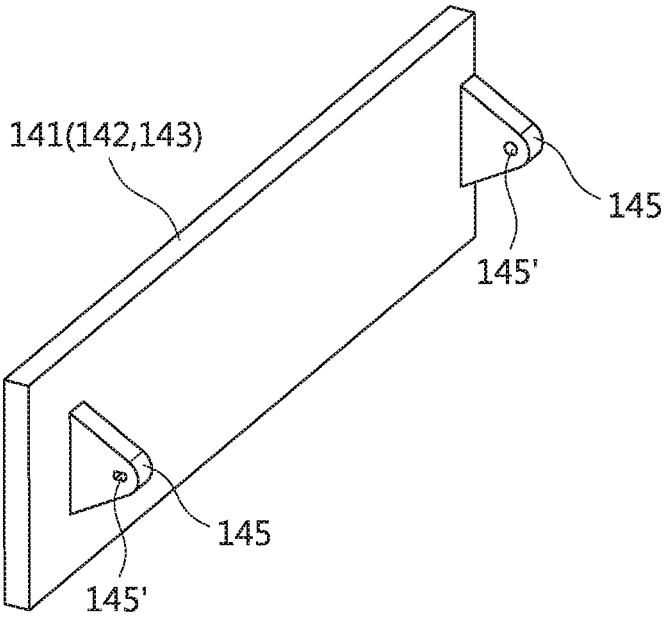
FIG. 9 is a perspective view showing the configuration of a louver.

As shown in FIG. 9, a pair of pivot brackets 145 may be attached or formed on each rear surface of the louvers 141, 142, 143. A pivot axis hole 145' may formed in each pivot bracket 145. An output shaft of each louver motor 141', 142', 143' may be coupled to one of the pivot axis hole 145'. Although the pivot bracket 145 may have a wedge or triangular shape, other shapes may be used. Further, as can be appreciated, the pair of pivot brackets 145 may not be required to be located along the central longitudinal axis of each louvre. Alternatively, or in addition thereto, the louvre may be configured to slide, e.g., up and down, to open and close the primary impeller outlet 128.

The louvre motors 141', 142', and 143' may be fixed to the installation groove 150 formed in the primary impeller guide 120 using a motor block 146. One side of the motor block 146 coupled to the louvre motors 141', 142',143' has a shape based on the exterior contour of the louvre motors 141', 142', and 143', and the other side of the motor block 146 is inserted and coupled to the installation groove 150.

Each of the louvers 141, 142, 143 may include the pair of pivot brackets 145, each bracket having a pivoting hole 145'. One of the pivoting hole is coupled to a shaft of a corresponding louvre motor 141', 142', or 143' and the other pivoting hole is coupled to a slave shaft or pin 147. The motor shaft and the slave shaft 147 form a rotation or pivoting axis for the louvers 141, 142, and 143. A pair of support pieces 149, fixed to the installation groove 150 of the fan guide 120, supports each end of the slave shaft.

In the illustrated embodiment, the slave shaft may be provided for one of the pair of pivot brackets 145. However, in certain instances, two adjacent louvers may share the same slave shaft. As shown in FIG. 8, the second and third louvers 142 and 143 each include a slave shaft 147 and pair of support pieces. Instead, the adjacent pivot brackets of the second and third louvers may share a single slave pin. Alternatively, the slave shafts 147 may be omitted if the shaft of the drive motors 141', 142' or 143" extends all the way across between the pivot holes 145' of the pair of pivot brackets 145.

The particular structure and arrangements of the pivot brackets 145 are not limited to the present disclosure. In this embodiment, the heat exchanged air is exhausted upwards the louvers 141-143 are opened (FIG. 33), where the maximum opened position of the louvers 141-143 being limited due to the pivot brackets being located along the central longitudinal axis of the louvers. However, a lever or linkage may be provided between the pivot hole 145' and the motor and slave shafts to allow the louvers 141-143 to be at least perpendicular to the front plate 15. In such a configuration, heat exchanged air may be exhausted perpendicular to the front plate 15. Alternatively, the pivot brackets 145 may be provided near the bottom of the louvers 141-143.

The output shafts of the louvre motors 141', 142', and 143' may be operated by setting the speed and torque of the gears therein. The rotational angles of the louvers 141, 142, and 143 may be set by the degree of rotation of the output shafts of the louvre motors 141', 142', and 143'. The rotational angles of the louvers 141, 142, and 143 may be controlled based on the user selection or a preset operational setting.

The impellers (impeller blades 130, 130', 130" and corresponding impeller motors 132, 132', 132") may all be operated simultaneously or independently. The impellers may be operated in various combinations according to the operation mode of the air management device.

Figure 10:
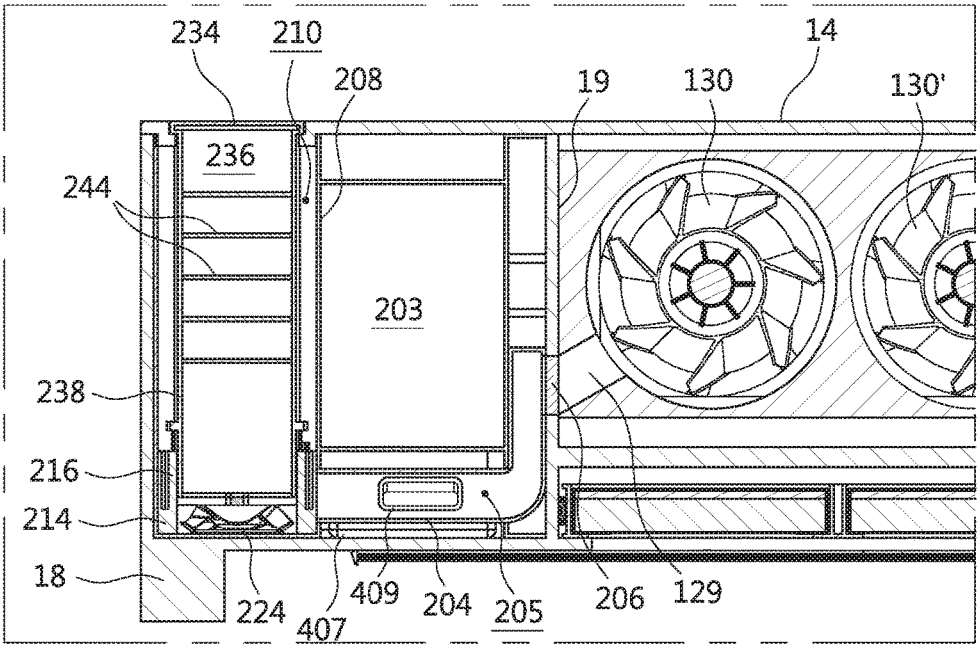
FIG. 10 is a cross-sectional view taken along the line D10-D10 of FIG. 1.

For example, all louvers 141, 142 and 143 may be opened to discharge the heat-exchanged air to the front of the housing 10 when all the impellers may be operated. At this time, the heat exchanged air may be prevented from being supplied to the branch passage 129, e.g., a secondary flow path, by closing a first damper 206 (FIG. 10). The first damper 206 is opened or closed by an operation of a damper driving motor, which is controlled by the controller 600. Alternatively, only one or two of the impellers may be turned on with one or two of the respective louvers being opened, while the first damper 206 is closed to prevent heat exchanged air from being supplied to the branch passage 129.

The suctioned air may be supplied to the additional retractable first or second fan 200, 200' in a state in which at least one of the louvers 141, 142, and 143 are closed. For example, when all the louvers 141-143 are closed, a primary first impeller 131 (primary first impeller blade 130 and primary first impeller motor 132) and the primary third impeller 131" (primary third impeller blade 130" and primary third impeller motor 132") may be turned on and the first damper 206 may be opened, the suctioned air flows through the secondary flow passage 129. Alternatively, the three primary impellers 131, 131', 131" may be turned on with the louvers 141 and 143 closed and the damper 206 and louvers 142 opened, the heat exchanged air may be supplied to the secondary flow passage and also discharged through the middle of the housing 10.

As shown in FIGS. 1 and 2, the discharge units or retractable fan 200 or 200' may be provided on either side of the upper surface of the housing 10. The retractable fans 200, 200' may allow first and second retractable ducts 234, 234' (or first and second pop-up ducts) to protrude from the upper surface of the housing 10 to further disperse the heat-exchanged air to a wider area.

As illustrated in FIGS. 10-16, the first and second retractable fans 200, 200' may be installed on at least one of the first secondary space 22 and/or the second secondary space 24 of the housing 10. Although the drawings illustrate the first and second retractable fans 200, 200' installed in the first secondary space 22 and the second secondary space 24, a detailed description of first retractable fan 200 installed in the first secondary space 22 is provided. Based on similar configuration, one of ordinary skill in the art may readily understand the installation of the second retractable fan 200' in the second secondary space 24.

Figure 11:
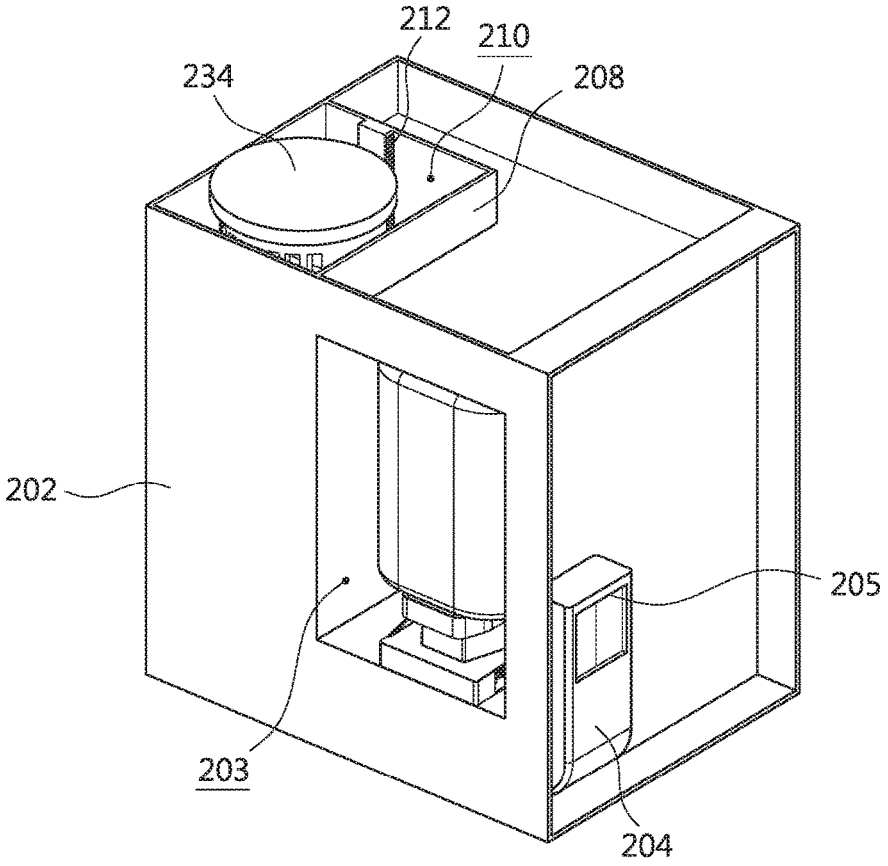
FIG. 11 is a perspective view showing the first inner frame and various components.
Figure 12:
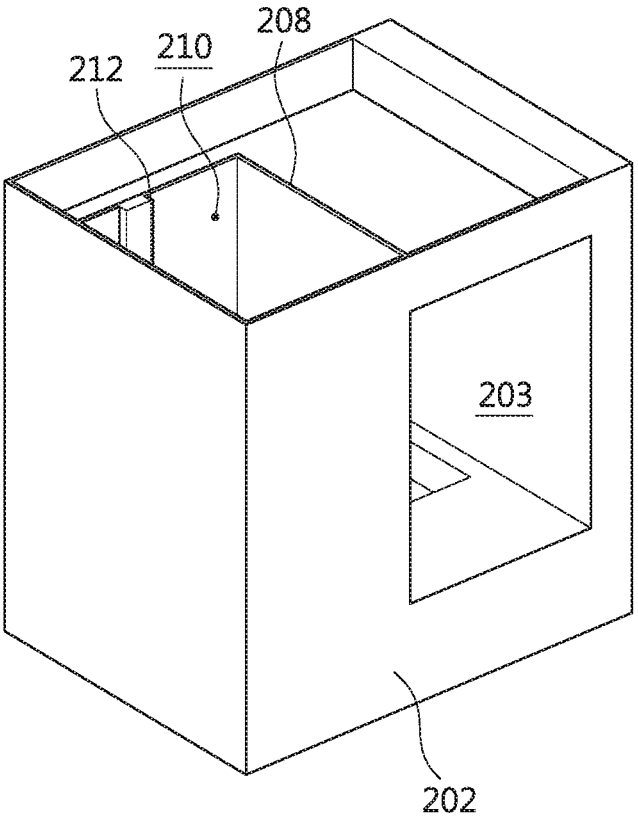
FIG. 12 is a perspective view of the first inner frame 202 shown in FIG. 11 independently.

As shown in FIGS. 10-12, a first inner frame 202 may partition the first secondary space 22 to form an first inner space 203 and a first vertical duct 208, which are adjacent to each other and allows installation of the first retractable fan 200 and the humidifier 400, respectively. The first inner space 203 may be accessed through the first movable panel 16, which slides left and right with respect to the housing 10 to open or close the first inner space 203.

A connection duct 204 is installed on the right side of the first inner frame 202. The first connection duct 204 is bent to have a reverse 'L' shape (or "L" shape on the other side), where the inlet communicates with the branch passage 129 of the fan guide 120 and the outlet communicates with the first vertical duct 208. A first connection flow passage 205 is provided at the inlet of the first connection duct 204, where the first connection flow passage is opened or closed by the first damper 206. Although the first connection duct 204 is shown to have a bent shape, other shapes and configurations are possible in view of the present disclosure and knowledge to one of ordinary skill in the art.

As shown in FIGS. 13-16, the first vertical duct 208 extends in the vertical direction to guide the lifting and lowering of a first lifting box or lift platform 214 such that the retractable first duct 234 of the first retractable fan 200 may move along a predetermined trajectory. When the first retractable fan 200 is raised, a first vertical flow path 210 is form inside the first vertical duct 208 between the outlet of the first connection duct 204 and an inlet of the retractable first duct 234. The vertical duct 208 does not necessarily need to be formed in the first inner frame 202 and may be made separately installed in the first secondary space 22. The vertical duct 208 extends in the vertical direction to guide the lifting and lowering of the lifting box 214 to be described below so that the popup duct 234 can be lifted along a predetermined trajectory.

A first lift platform 214 of the retractable first duct 234 may vertically move inside the vertical duct 208 using a first lift gear 212 (e.g., a linear gear) and a second lift gear 232 (a circular gear, e.g., a pinion) driven by a first lift motor 230. The first lift gear 212 may be a vertical rack formed from top to bottom of the first vertical duct 208. The cross-sectional shape of the first lift platform 214 may be the same as the cross sectional shape of the first vertical duct 208 except for a first indentation 221. The outer surfaces of the lift platform 214 may move in contact with the inner surface of the first vertical duct 208.

Figure 14:
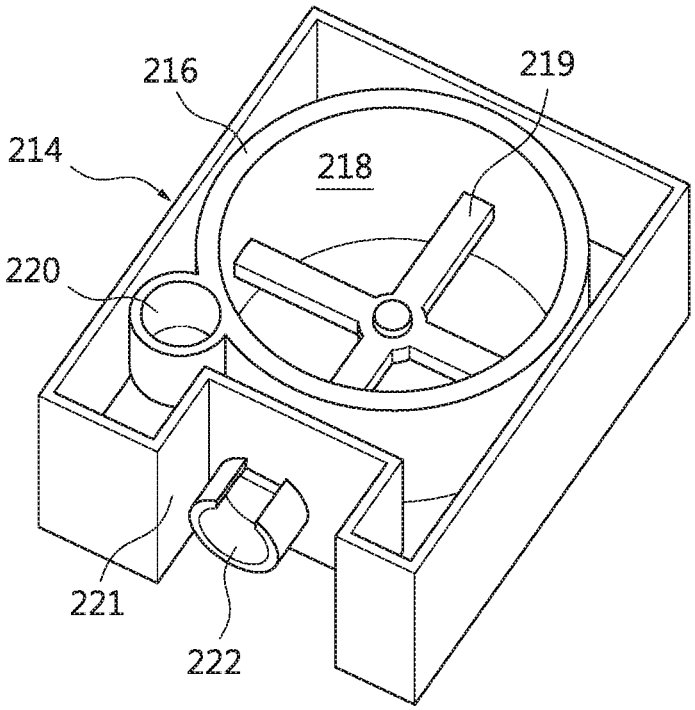
FIG. 14 is a different perspective view showing the lift platform shown in FIG. 13.
Figure 15:
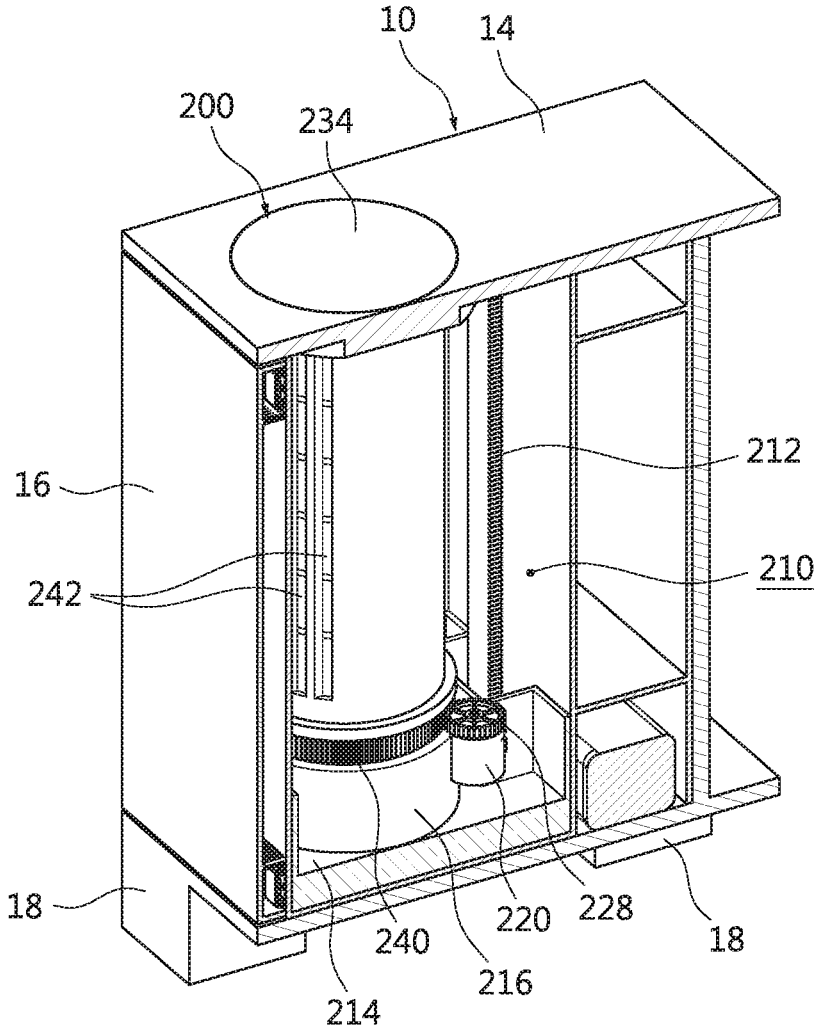
FIG. 15 is a sectional view taken along the line D15-D15 in FIG. 1.
Figure 16:
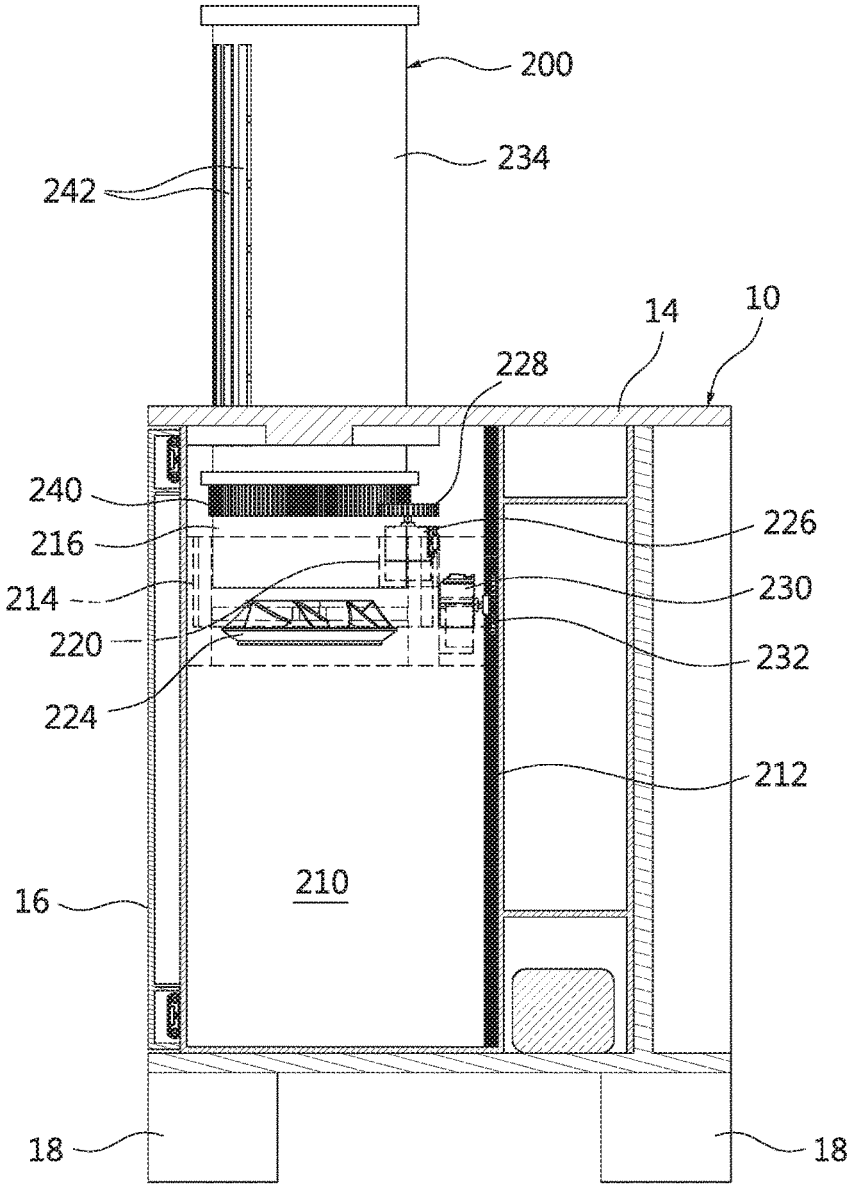
FIG. 16 is a side cross-sectional view illustrating lifting and rotation of a retractable or pop-up duct.
Figure 17:
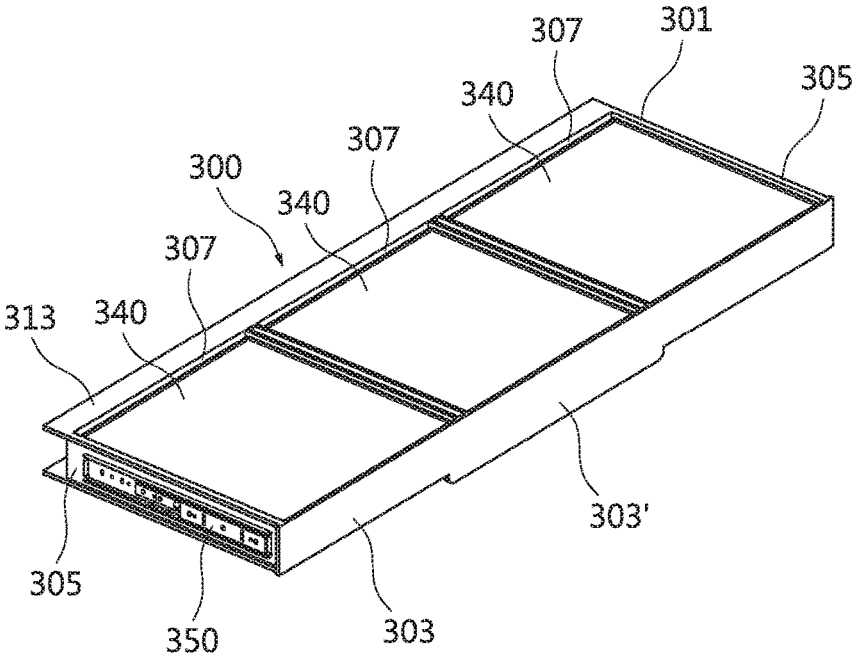
FIG. 17 is a perspective view of a replaceable filter.

As shown in FIG. 14, a first support ring 216 of a cylindrical shape passes through the first lift platform 214 to create a first communication passage 218. A first support base 238 is inserted into the first support ring 216 to be rotatably supported therein. The first communication channel 218 allows passage of air from the vertical flow path 210 to a retractable or pop-up channel 236 of the retractable first duct 234. The first support ring 216 is rotatably fitted with the first support 238 at the lower end of the retractable first duct 234.

A first impeller support 219 having two beams crossing each other may be provided inside the communication passage 218. A first secondary impeller blade 224 driven by an impeller motor (not shown) may be mounted to the first impeller support to pressurize the air discharged from the first retractable fan 200. The impeller motor may be driven or controlled by the controller 600.

A rotary motor housing 220 formed of a ring shape may be provided adjacent to the first support ring 216 of the first lift platform 214 and may be configured to receive a rotary motor 226. The first indentation 221 may be provided on one outer surface of the first lift platform 214, and as shown in FIG. 14, an elevating motor housing 222 may formed at the indentation 221. The outer side surface of the first lift platform 214 may be optimized to have the largest possible surface to contact an inner side surface of the first vertical duct 208.

As shown in FIG. 10, the first secondary impeller blade 224 is installed in the first impeller support 219 of the first lift platform 214. The operation of the first secondary impeller blade 224 pressurizes the air in the communication passage 218 to allow the air to be further force the air through retractable first channel 236. In other words, the air drawn into the first connection duct 204 and the first vertical duct 208 by the impeller, e.g., the first impeller 131, may be further pressurize by the first secondary impeller blade 224 for travel through the retractable first channel 236.

A lift motor 230 may be mounted at the elevation motor housing 222 of the first lift platform 214. The second lift gear 232 may be installed on an output shaft of the lift motor 230 to engaged with the first lift gear 212. Due to engagement of the second lift gear 232 with the first lift gear 212, the retractable first duct 324 coupled to the first lift platform 214 of the retractable fan 200 may ascend above or descend below the upper plate 14 of the housing 10 based on the operation of the lift motor 230, which may be controlled or driven by the controller 600. The retractable first duct 234 may be cylindrical as shown in this embodiment. However, the retractable first duct 234 may have other various shapes, e.g., a hexahedron shape.

The retractable first duct 234 forms the retractable first channel 236, which is in communication with the first communication passage 218. The first support base 238 of the retractable first duct is inserted into the first support ring 216 of the first lift platform 214. The outer diameter of the first support base 238 may be equal to or slightly smaller than the inner diameter of the first support ring 216 to allow rotation of the first support base 238 relative to the first support ring 216.

A rotary motor 226 may be mounted to the rotary motor housing 220. An output shaft of the rotary motor 226 has a first rotary gear 228, e.g., a pinion. A second rotary gear 240, e.g., a rack, may be formed around the outer surface of the first support base 238, which engages with the first rotary gear 228. The retractable first duct 234 rotates, e.g., side-to-side, along a path of the second rotary gear 240 when the first rotary gear 228 is rotated by the rotary motor 226. The rotary motor 226 is driven or controlled by the controller 600.

A plurality of discharge vents 242 may be formed on a section of an outer surface of the retractable first duct 234. To allow forced discharge of the air flowing through the retractable first channel 236, an area where discharge vents 242 is formed may be less than half the outer surface of the retractable first duct 234. Further, the discharge vents 242 may be formed over an area less than 180 degrees with respect to the center of the retractable first channel 236.

Figure 13:
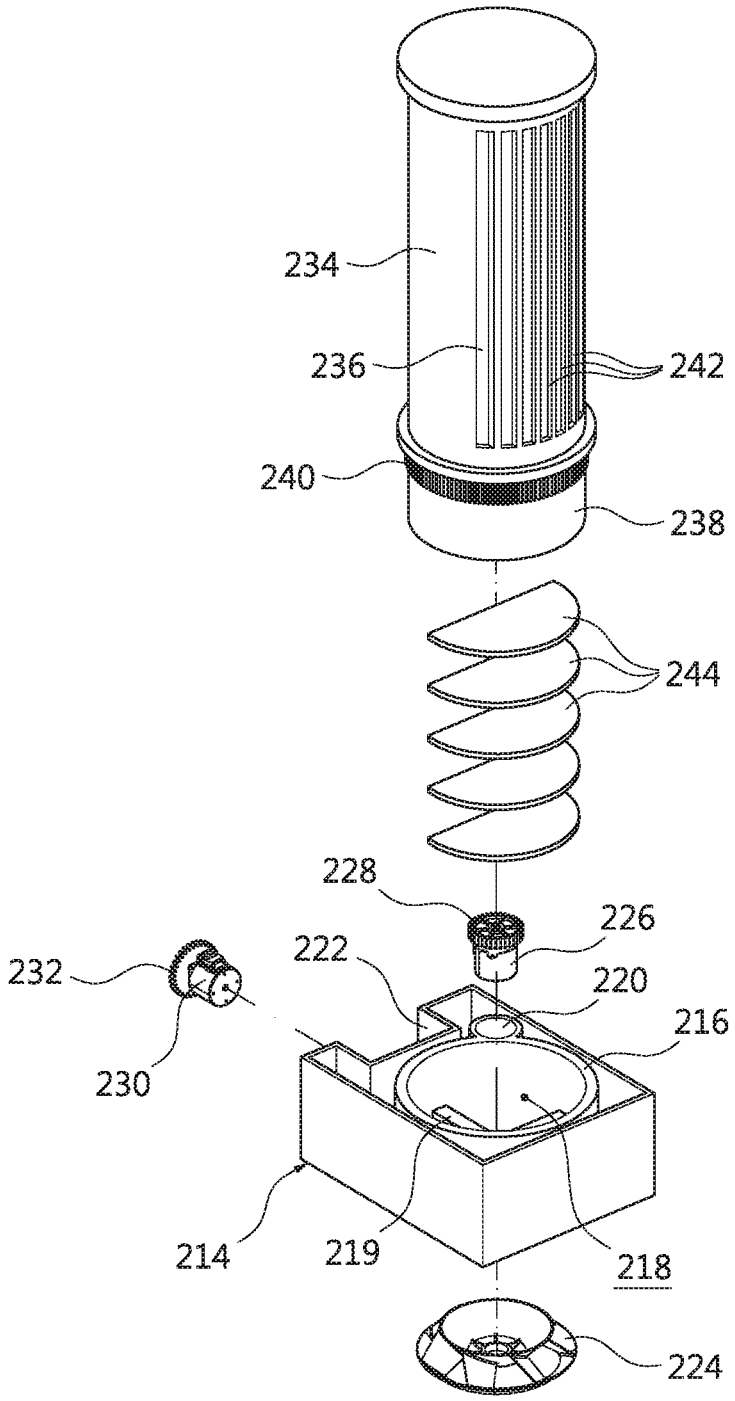
FIG. 13 is an exploded perspective view of various components for a retractable or pop-up fan.

A plurality of first directional blades 244 may be stacked vertically inside the retractable first channel 236. The directional blades 244 may pivot along a horizontal axis to adjust the vertical direction of the air discharged through the discharge vents 242. The directional blades 244, as shown in FIG. 13, may have a semi-circular plate shape, and may be controlled individually or collectively, either manually or automatically. If manually, at least one of the directional blades 244 may include a tab protruding through the discharge vents 242 for a user to grab and orient the directional blades 244, and if automatically, at least one of the directional blades 244 may be coupled to a motor driven or controlled by the controller 600.

The second retractable fan 200' having same or similar configuration may be installed in the second secondary space 24. FIG. 30 illustrates a second lift platform 214', a second support ring 216', a second secondary impeller blade 224' and second duct 234'. As can be appreciated, the second retractable fan 200' may be implanted to have corresponding first lift gear, communication passage, impeller support, rotary motor housing, indentation, elevation motor housing, rotary motor, first rotary gear, lift motor, second lift gear, retractable channel, support base, second rotary gear, discharge vents, directional blades, etc.

In the described embodiments, the first retractable fan 200 and/or the second retractable fan 200' have a cylindrically shaped tower configuration. As can be appreciated, other shapes are possible, e.g., rectangular pillar shape configuration with discharged vents 242 provided on one side, by changing the shape of the retractable first and/or second ducts 234, 234'. The shape of the ducts may be determined based on the desire to further distribute or send the heat-exchanged air to a particular location or locations in a room. As can be appreciated, if other shapes are used, the first and/or second support bases 238, 238' may be maintained to be cylindrical for the rotation of the retractable first and/or second ducts 234, 234'.

In the described embodiment, the discharge vents 242 extend in a vertical direction while the directional blades 244 are stacked vertically. As can be appreciated, the discharged vents 242 may extend horizontally while the directional blades 244 are stacked horizontally to achieve the same or similar results for distributing the air.

A replaceable filter 300 is provided within a push-in/pull-out drawer at a front center of the housing 10. The replaceable filter 300 is installed at the bottom inlet 11' provided defined by the bottom plate 11 and purifies/filters the air passing through the bottom inlet 11'.

Figure 3A:
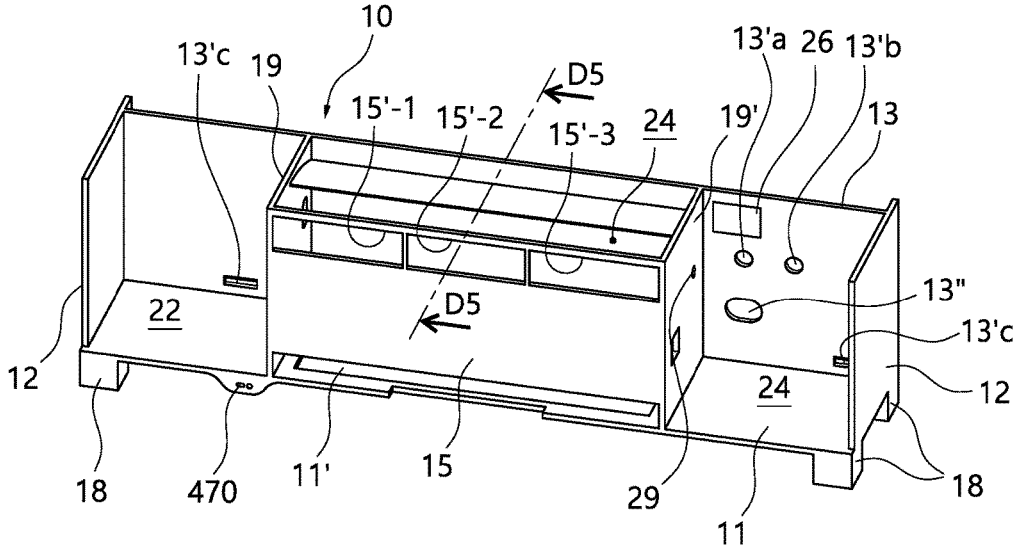
FIG. 3A is a front perspective view showing the configuration of various part of the housing for the air management device shown in FIG. 1.
Figure 3B:
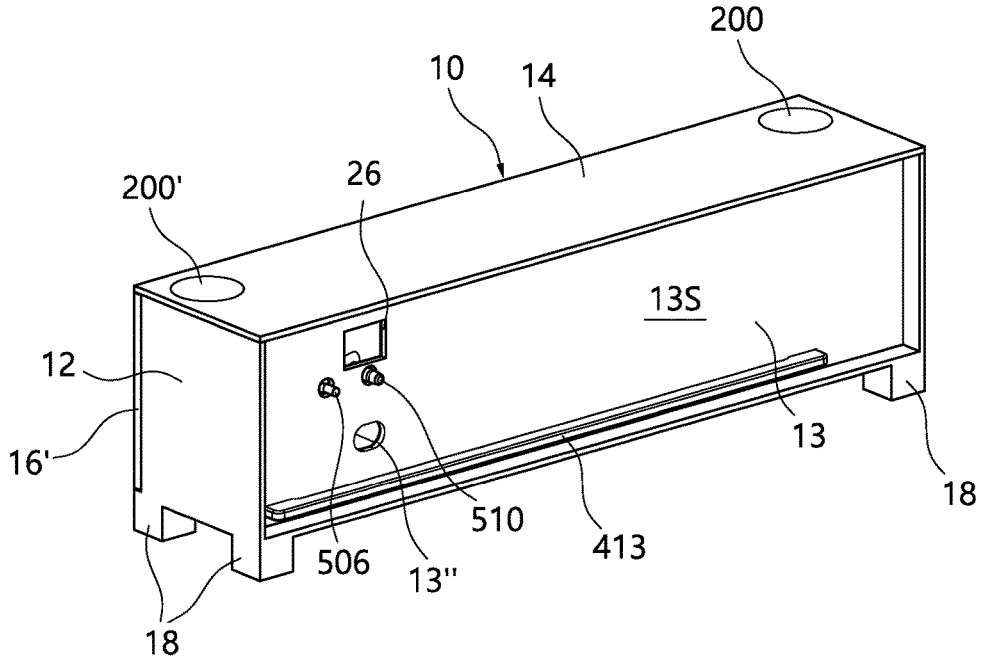
FIG. 3B is a rear perspective view of FIG. 1.

As shown in FIG. 3, the bottom inlet 11' is formed at the bottom plate 11 located a bottom of the housing 10 and faces the floor on which the housing 10 is placed. When the housing 10 is placed on the floor of a livable space, the inlet 11' is not visible to a user. However, the user is able to access the replaceable filter 300 through the front of the housing 10 by pulling out the housing of the replaceable filter 300 provided at an entrance formed in the lower portion of the front plate 15. Compare FIGS. 1 and 3. Based on such a configuration, the replacement of the filter(s) at an end of its life cycle may be simplified.

A filter frame 301, e.g., a drawer frame, forms a skeleton of the replaceable filter 300. The filter frame 301 has a hexahedral shape, and a plurality of passage openings 302 are formed on the bottom. Each passage opening 302 is a path through which air is allowed to pass. In the present disclosure, three passage openings 302 are provided having a square shape in a plan view. The shape and size of each passage openings 302 may be based on prevention of a plurality of filters 320, 330, and 340 located therein from sagging. A first filter 320, a second filter 330, and a third filter 340, are sequentially stacked over each of passage opening 302.

A front wall 303 forms a front surface of the filter frame 301. The front wall 303 forms a partial outer appearance of the housing 10 when the filter frame 301 of the replaceable filter 300 is inserted into the housing 10. A handle 303' may be provided at a bottom center of the front wall 303. A user may grasp the handle 303' to pull the filter frame through the entrance of the front plate 15 to access the replaceable filter 300.

A pair of side walls 305 extends rearward from both ends of the front wall 303 and connects to a back wall 307. The back wall 307 may extend parallel to the front wall 303. A plurality of filter partition walls 309 connects to the front wall 303 and the rear wall 307 between the pair of side walls 305 to divide the inside of the housing to create the plurality of passage openings 302.

A seating ledge 311 may extend at a lower end of the side wall 305 and the filter partition wall 309 to provide a seating surface for the edge of the first filter 320. Alternatively, or in addition thereto, the seating ledge 311 may be formed along a lower end of the front wall 303 and the back wall 307. As can be appreciated, the surface area of the seating ledge 311 may be based on prevention of narrowing the air flow cross sectional area.

Support ribs 313 are formed at upper and lower ends of the rear wall 307 to protrude to the rear of the filter frame 301. When the filter frame 301 is withdrawn from the entrance of the front plate 15 for replacement filter, the filter frame 301 is supported inside the entrance even though the filter frame 301 is retained in the housing 10 by a rail assembly 350. The filter frame 301 may be withdrawn all the way to expose the inside surface of the back wall to create a clearance for withdrawal of the filters while the support rib 313 or portion thereof is maintained within the entrance of the housing 10.

The plurality of filters, e.g., first filter 320, second filter 330, and third filter 340 provided over each of the passage opening 302. The first filter 320 is first installed over the passage opening 302. The first filter 320 may serve as a pre-filter to filter, e.g., dust. A plurality of the filtering cells 322 in a mesh network may form the first filter 320 and a storage case 324 may be integrally formed, surround the edge of the meshed filtering cells 322 of the first filter 320.

Figure 18:
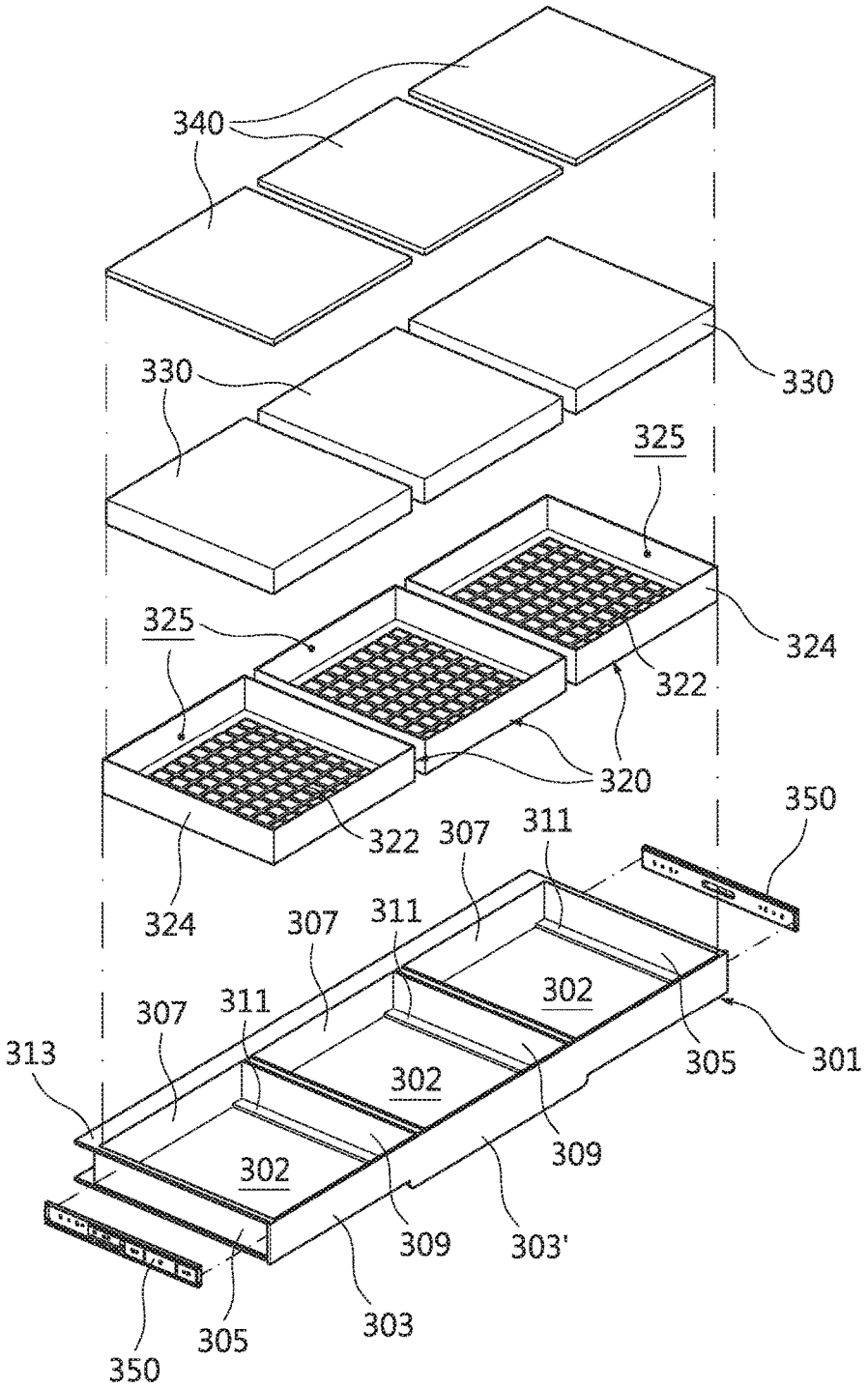
FIG. 18 is an exploded perspective view of the drawer type replaceable filter.
Figure 19:
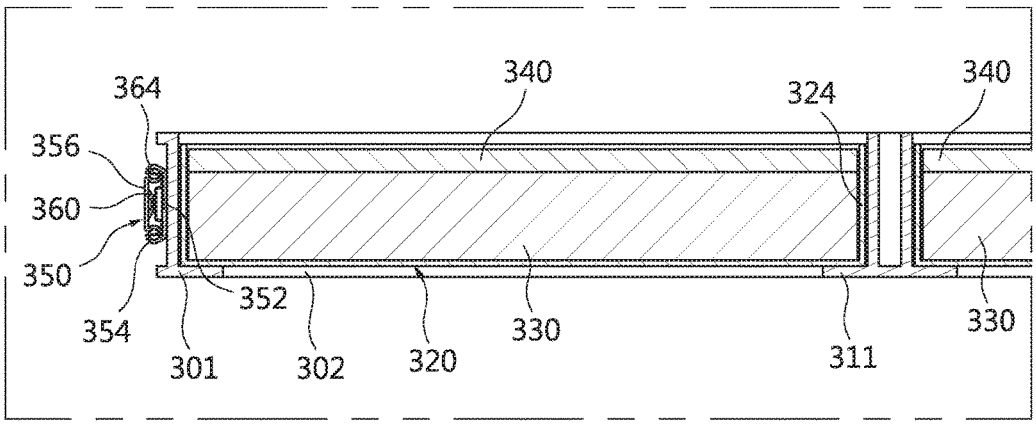
FIG. 19 is a sectional view of various components for the drawer type replaceable filter.

The rectangular walls of the storage case 324 may create a predetermined storage space 325. The second filter 330 and a third filter 340 may be stacked inside the storage space 325. Excluding the first filter 320, a height of the storage case 324 may be higher than a stacked height of the second and third filters 330, 340. As shown in FIGS. 18 and 19, such an arrangement may facilitate one-step removal of the first, second and third filters 320, 330, 340 housed by the storage case 324 from the passage opening 302 of the filter frame 301 when the retractable filter 300 is withdrawn from the entrance of the front plate 15.

The second filter 330 is installed in the storage space 325, and the third filer 340 is stacked on top thereof. The second filter 330 has a planar hexahedron shape corresponding to the shape of the storage space 325. A HEPA filter may be used as the second filter 330, and the third filter 340 may be a deodorizing filter of activated carbon components.

In order for the filter frame 301 to be pulled out or pushed in of the housing 10, a rail assembly 350, e.g., drawer slide set, may be is installed on the sides of the filter frame 301 and corresponding inner surfaces of the housing 10. See FIG. 20. The rail assembly 350 includes a first rail 352, a second rail 356 and a third rail 360, each rail 352, 356, 360 having guide rails at top and bottom, see e.g., guide rails 354 of first rail 352. The first rail 352 is attached to the side of the filter frame 301 and extends in front-to-rear direction, and the second rail 356 is attached to the inner surface of the housing. The third rail 360 is sandwiched in between the first and second rails 352, 358.

Figure 20:
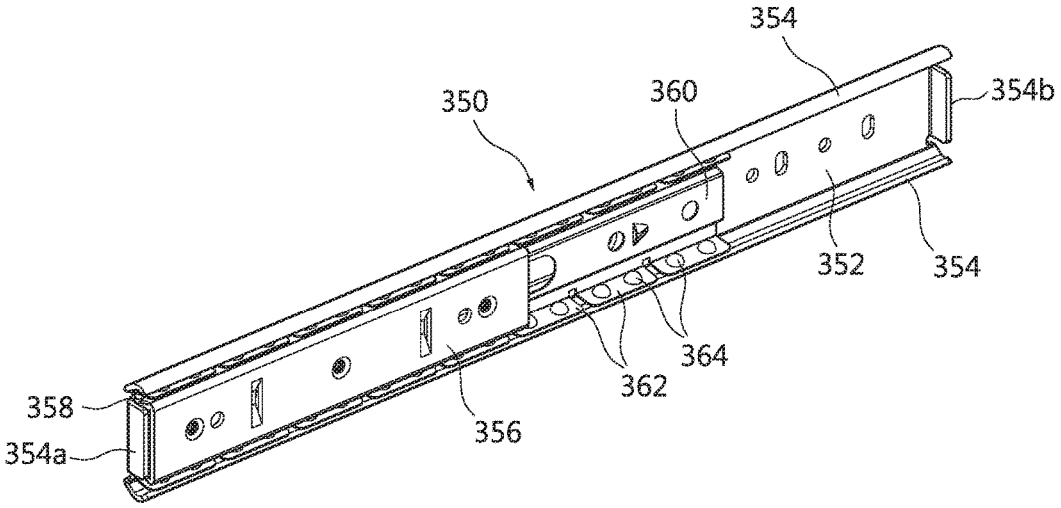
FIG. 20 is a perspective view showing an example of the rail assembly used for the drawer type replaceable filter.

Stop rails 354*a*, 354*b* of the first rail 352 prevent the second and third rails 356, 360 from falling out of the first rail 352 when the filter frame 301 is extended out of or retracted into the housing 10. A plurality of ball rails 362 are provided at upper and lower ends of the third rail 360, and a ball bearing 364 is rotatably installed at the ball bearing rails 362 to facilitate movement of the second and third rails 356, 360. When the filter frame 301 is pulled out, the first rail 352 moves with the filter frame 301 and the second and third rails 356, 360 slide along the first rail 352 relatively. The first rail 352 comes to a stop by bumping into an one end of the second rail 356 with the stop rail 354*b*. When the filter frame 302 is pushed in, the first and third rails 352, 360 slides rearward until the first rail 352 bumps into the other end of the second rail 356 with the stop rail 354*a*, as shown in FIG. 20.

Figure 21:
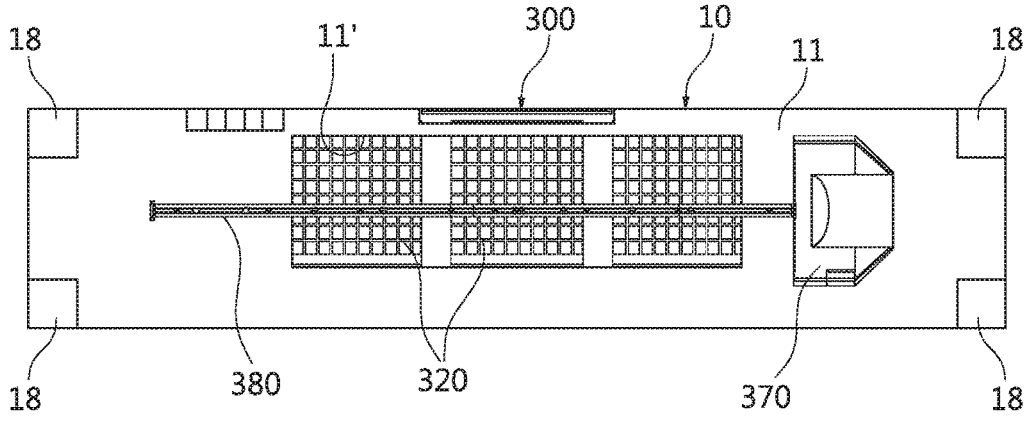
FIG. 21 is a bottom view of the air management apparatus.

As shown in FIGS. 4 and 21, a cleaner 370 configured to remove dust and foreign matter from the first and/or second filters 320 and 330 may be provided under the bottom plate 11 of the housing 10. The cleaner 370 may be configured to linearly reciprocate along the bottom inlet 11'. The cleaner 370 may be configured to operate similar to a vacuum cleaner having a suction motor and may optionally include a dust bin and at least one cyclone in a cleaner body 371. The cleaner 370 is configured and/or positioned to prevent obstruction of the bottom inlet 11'. This configuration allows the air in the living room to flow smoothly the bottom inlet 11' and then into the air passage 102.

Figure 22:
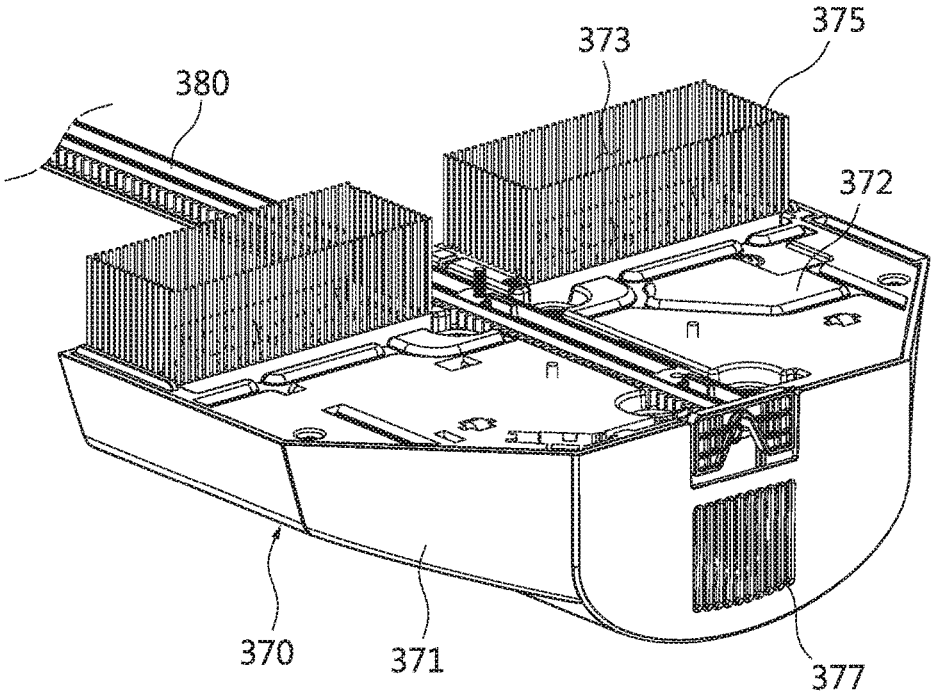
FIG. 22 is a perspective view a filter cleaner.

As shown in FIG. 22, the cleaner body 371 forms the appearance and skeleton of the cleaner 370. A surface 372 of the cleaner body 371 faces the bottom plate 11 and may have a predetermined width in front-to-rear direction which may be at least wider than the width of the bottom inlet 11'. A suction opening or port 373 may be provided on the surface 372, which is divided into two by cleaner rail 380 extending therethrough. In an alternative embodiment, a pair of cleaner rails 380 may be provided on the bottom plate 11 at corresponding edges of the bottom inlet 11' to provide a single suction port 373. However, when the size of the cleaner 370 increases, the weight may become heavy, so that the size of the cleaner 370 may be reduced by allowing the cleaner rail 380 to cross the suction port 11'. In addition, when the cleaner suction openings 373 are divided into a plurality, the flow cross-sectional area of each of the cleaner suction openings 373 may be reduced, and the suction force leakage due to the sagging of the cleaner 370 may be prevented.

An air outlet 377 is provided at one side of the outer surface of the cleaner body 371. The air outlet 377 may be located at a relatively remote position from the cleaner suction opening 373 exhaust air is discharged to the outside after dust or foreign matter is removed from the air sucked into the cleaner suction opening 373. In such a case, the dust in the air suction into the cleaner suction opening 373 is collected in a dust bin inside the cleaner body 371. In an alternative embodiment, the dust may be collected in the dust tank at a separate position by connecting the discharge hose to the air outlet 377 without a dust bin inside the cleaner 370.

The cleaner rail 380 is installed across the bottom inlet 11' on the bottom surface of the bottom plate 11 to allow the cleaner 370 to linearly reciprocate along the cleaner rail 380. The cleaner rail 380 may have an "I" beam shape, where the flanges at top and bottom engage grooves from in the cleaner body 371. Further, a linear gear, e.g., a rack, may be provided between the flanges at the top and bottom of the "I" beam, and may be provided on both sides of the "I" beam.

A motor coupled to a circular gear, e.g., pinion, may be provided in the cleaner body 371, where the teeth of the pinion engages with the teeth of the rack. Based on the actuation of the motor, the cleaner 370 travels along the cleaner rail 380, and a number of passes which the cleaner 370 travels across the length of the cleaner rail 380 or across the retractable filter 300, either in entirety or partially, may be based on a predetermined cleaning cycle determined by the controller 600.

Figure 23:
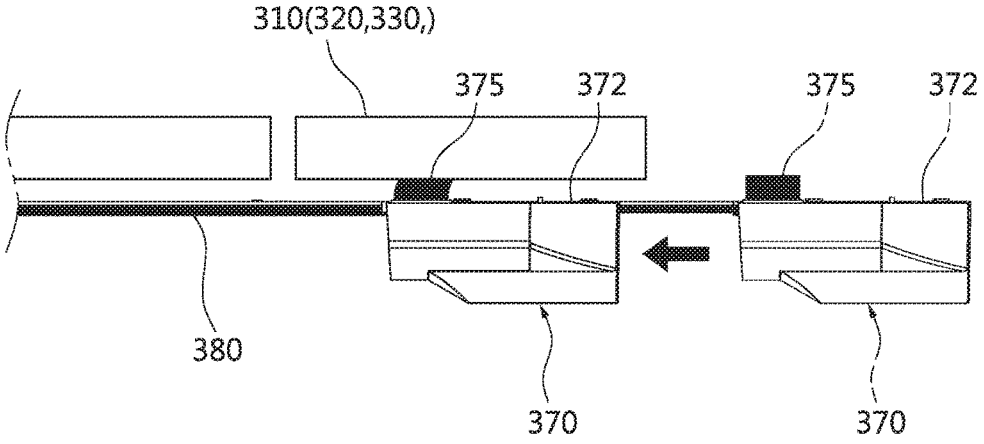
FIG. 23 is a side view showing a state in which the elastic bristles of the filter cleaner in contact with the filter.

As shown in FIGS. 22 and 23, elastic bristles 375 are installed around the edge of the cleaner suction port 373. The elastic bristles 375 may rub against the surface of the first filter 320 and sweep the dust for entry into the cleaner suction port 373. The elastic bristles 375 may be arranged to form a wall around the cleaner suction opening 373. Although a single line of elastic bristles 375 is shown in FIG. 22, the elastic bristles 375 may be arranged to have a plurality of lines to minimize or eliminate the leakage of suction force. The density of the elastic bristles 375 around the cleaner suction port 373 allows sufficient seal around the edge of the cleaner suction port 373 such that the suction air/force of the cleaner 370 may not leak outside of the cleaner suction port 373.

The elastic bristles 375 may be made of a material capable of elastic deflection from 0 degrees at the upper end of the elastic bristles 375, and may have a predetermined diameter and a predetermined length. The elastic bristles 375 may be made of a synthetic material, e.g., plastic, rubber, resin, etc. As can be appreciated, the elastic bristles 375 may be also made of a natural or organic material, e.g., hair, of predetermined stiffness and capable of prescribed degree of elastic deflection. If the length of the elastic bristles 375 is too long relative to the prescribed distance between the first filter 320 and the surface 372, the middle and bottom end of the elastic bristles 375 may deform to create gaps between the elastic bristles 375. Such gaps create leakage of air, resulting in reduction of suction force. To prevent such leakage and deformation rather than deflection, the length of the bristles are preselected based on the distance created between the first filter 320 and the surface 372.

Depending on the weight of cleaner 370 and/or stiffness of the cleaner rail 380, sagging of the cleaner rail 380 or wobbling of the cleaner 370 on the cleaner rail 380 may occur. However, the elastic bristles 375 may remain in contact with the surface of the first filter 320 due to the elastic deflection, thereby preventing the leakage of suction force. For example, at a location where the cleaner 370 sags due to gravity or wobbles on the cleaner rail 380, the degree of deflection of the elastic bristles 375 may be less, but ends of the elastic bristles 375 remain in contact with the surface of the first filter 320 to prevent loss of suction force.

Since the replaceable filter 300 is inside the bottom inlet 11' of the housing 10 and the cleaner 370 is on the bottom plate 11 of the housing 10, a distance between the bottom surface of the first filter 320 and the surface 372 of the cleaner body 371 may be greater than a distance between a bottom surface of the bottom plate 11 and the surface 372 of the cleaner body. To prevent such a difference in distance, a step may be provided at an edge of the first filter 320 such that the bottom surface of the first filter 320 may be coplanar with bottom surface of the bottom plate 11. Alternatively, a height of the step may be greater than a thickness of the bottom plate such that the bottom surface of the first filter 320 protrudes closer to the surface 372 of the cleaner 370 than the bottom surface of the bottom plate 11.

FIGS. 24-29 illustrates a humidifier 400 installed in the first inner space 203. The humidifier includes an inlet duct 401 penetrating through the first partition wall 19 to communicate with the main air passage 102. A portion of the air in the main air passage 102 is delivered to the air inlet duct 401. A inlet fan 403 having an impeller, e.g., circular impeller, is coupled to the inlet duct 401 such that the air in the main air passage 102 is sucked into the air inlet duct 401 when the inlet fan is actuated. Because air flowing into the inlet duct 401 has passed through the replaceable filter 300 (prior to the air being heat exchanged by the heat exchanger 104), the air delivered to the air inlet duct 401 is in a purified/filtered state.

The pressurized air of the inlet fan 403 is directed through a transfer duct 405 to a steam generator 407. The steam generator 407 generates steam by heating the water supplied from a bucket 419, e.g., a liquid storage tank. The steam generator may include a heater to heat the liquid to generate the steam for the humidifier 400, but water molecules may be vaporized using ultrasonic waves. In other words, different means may be used for generating the steam in the steam generator 407.

The steam generator 407 includes a first discharge duct 409 to exhaust humidified air formed by mixing of the steam generated by the steam generator 407 and the air suctioned through the air inlet duct 401. The first discharge duct 409 may be connected to first connection passage 205 of the first connection duct 204. See FIG. 10. The humidified air flowing through the first discharge duct 409 may be transferred to the first connection duct 204 to flow through the first vertical flow path 210, the first communication passage 218, and the retractable first channel 236, and then expelled through discharge vents 242 when the first retractable fan is raised and activated by the controller 600.

Figure 24:
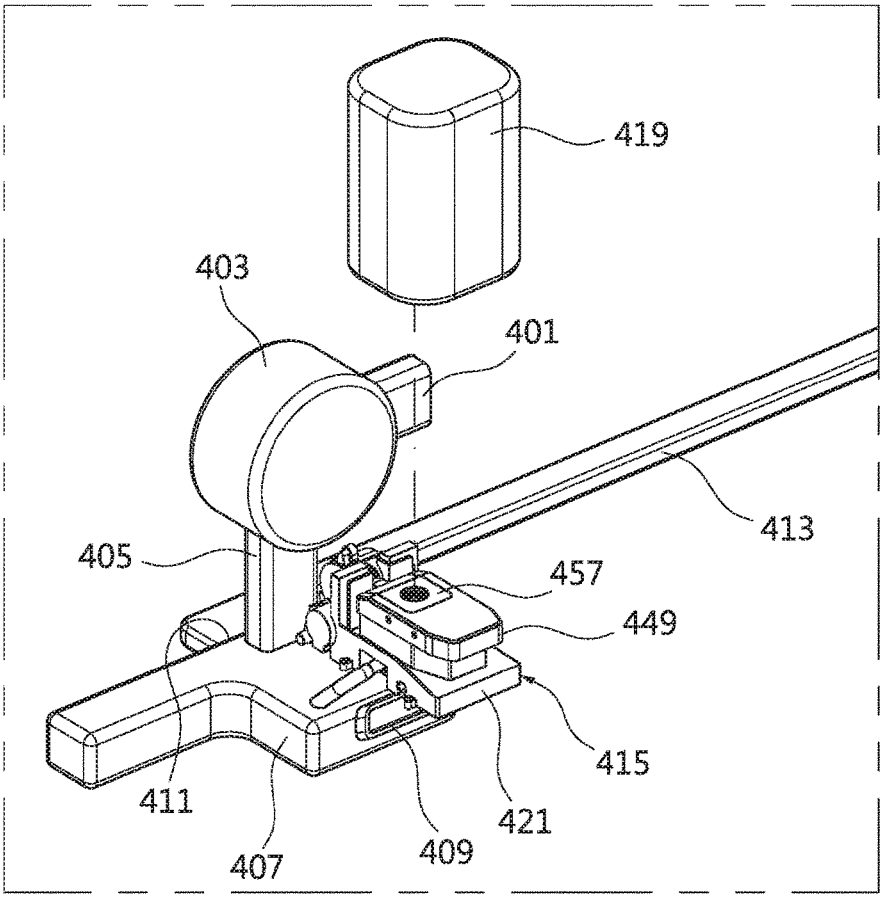
FIG. 24 is a perspective view of a humidifier for humidification used in the embodiment.
Figure 25:
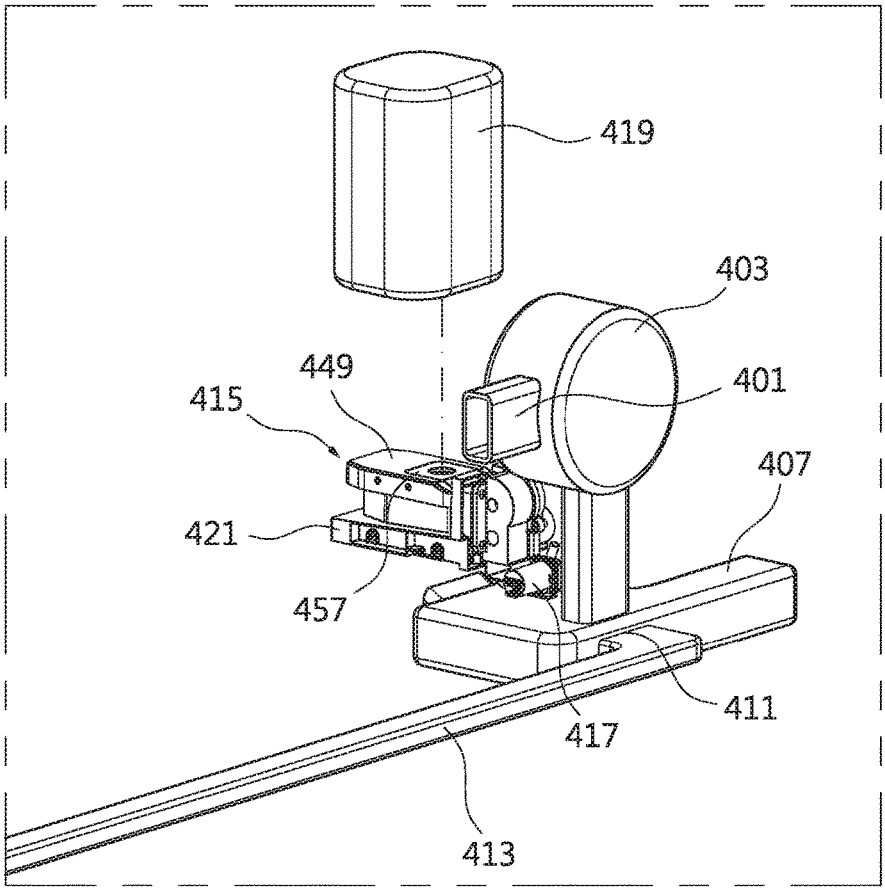
FIG. 25 is a perspective view of the configuration shown in FIG. 24 viewed from another direction.

As illustrated in FIGS. 24 and 25, the steam generator 407 may include a second discharge duct 411 in a direction different or opposite from that of the first discharge duct 409. As can be appreciated, the second discharge duct 411 may not be needed if the second retractable fan 200' is not provided. The second exhaust duct 411 delivers humidified air to a connection duct 413. When the humidified air is exhausted to the connecting duct 413 through the second discharge duct 411, the mixed humidified air travels to the second vertical duct 208' of the second secondary space 24 for expelling of humidified air by the second retractable fan 200'. The connecting duct 413 extends through the rear space **13*s* formed between a rear surface of the rear plate 13 and the wall surface. Dampers may be provided at the first discharge duct 409 and the second discharge duct 411 to control discharge of humidified air providing humidity to the living space through the first retractable fan 200 and/or second retractable fan 200'**.

A bucket seat 415 is installed on a bottom surface of the first inner space 203 to support the bucket 419 with a reservoir 429 and a tilting table 449 provided there between. A humidification pump 417 is installed adjacent to the bucket seat 415 to deliver the water supplied from the bucket 419 to the steam generator 407. The tilting table 449 may allow tilting of the bucket 419 such that an upper end of the bucket 419 protrudes outward from the first inner space 203 to facilitate installation and removal of the bucket 419 into and from the first inner space 203. See, e.g., FIG. 38.

Figure 27:
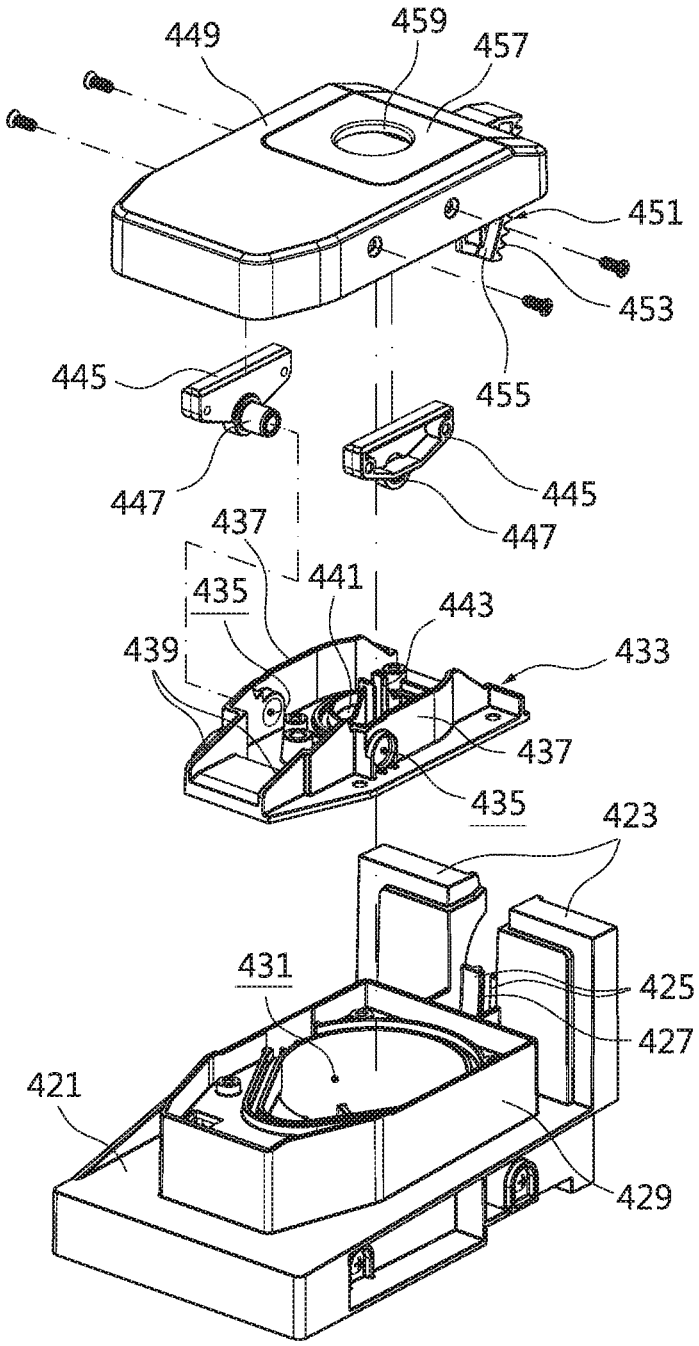
FIG. 27 is an exploded perspective view of the bucket seat shown in FIG. 26.

As shown in FIG. 27, the bucket seat 415 may include a base 421 for mounting of the bucket seat 415 at the bottom of the first inner space 203 of the first inner frame 202. A pair of guide columns 423 may be provided at a rear end (closer to the back plate 13) of the base frame 421. A pair of guide rails 425 forming a guide slot 427 is provided in a gap formed between the pair of guide columns 423. The guide rails 425 may be integrally formed on inner surfaces of the guide column 423 facing each other, and a space between the guide rails 425 may form the guide slot 427. The guide rails 425 may have a curved shape of a predetermined radius of curvature.

A reservoir tank 429 may protrude from an upper surface of the base 421 and may include a temporary liquid bin 431 inside the reservoir tank 429 to temporarily store liquid supplied from the bucket 419. An upper plate 433 is installed over the reservoir tank 429 over an upper surface of the water storage portion 429 of the base frame 421 and a seal is provided in a groove formed around an upper opening of the temporary liquid bin 431 between the reservoir tank and the upper plate 433 to prevent liquid leakage. As can be appreciated, the upper plate 433 may be integrally formed on the base frame 421.

A pair of holes 435 may be provided through supporting walls 437 protruding from the upper plate 433. The pair of holes 435 forms a rotational or pivoting axis for the tilting table 449. The supporting wall 437 further adds rigidity to the upper plate 437 and the tilting table 449 to further support a weight of the liquid in the bucket 419. The supporting walls 437 are formed symmetrically on opposite sides of a reservoir inlet formed by an opening on the upper plate. Further, a valve protrusion 443 may extend through the reservoir inlet to extend through a valve seal of the bucket 419 to allow liquid to flow into the temporary liquid bin 431 of the reservoir tank 429. As can be appreciated, the pair of holes 435 may be formed at both sides of the reservoir tank 429.

A tilt stopper 439 may extend from an end of the seating wall 437. The tilt stopper 439 may comprise at least one angled wall having an incline lowered toward the front end (closer to the first movable panel 16) of the reservoir plate 433. The tilt stopper 439 may support the lower surface of the tilting table 449 when the tilting table 449 is tilted toward the front.

A pair of tilt brackets 445 may include shafts 447 protruding, e.g., inwards, and inserted into the holes 435. The tilt brackets 445 may be configured to be attached to the tilting table 449 by, e.g., screws. Because the shafts 447 are rotatable within holes 435 and the tilt bracket is attached to the tilting table 449, the shafts 447 and holes 435 function as a tilt or pivot axis for the tilting table 449, and the tilting table 449 is configured to tilt relative to the base 421 from a horizontal position to a predetermined angled position, where the limit of the predetermined angled position is set by the tilt stopper 439.

Figure 28:
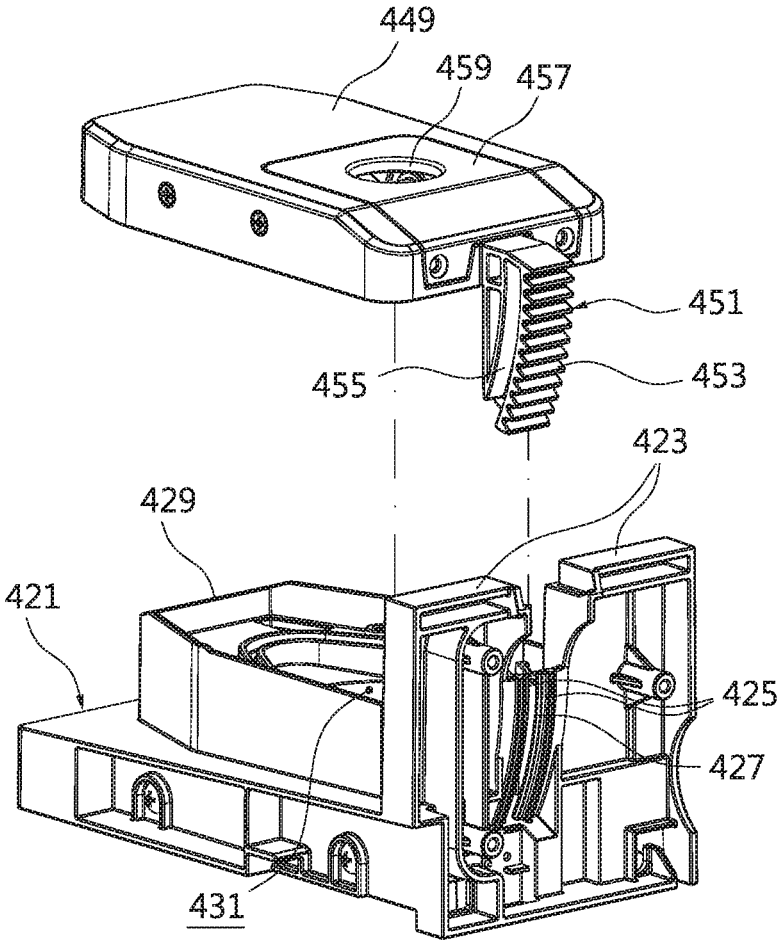
FIG. 28 is an exploded perspective view showing a configuration for guiding the tilt table to be tilted with respect to the base of the configuration shown in FIG. 26.

The driving force for the tilting the tilting table 449 is transmitted through a tilting rack gear 451. As shown in FIG. 28, the tilting rack gear 451 is provided at a rear end of the tilting table 449. The tilting rack gear 451 is curved to have a predetermined radius of curvature. The tilting rack gear 451 is configured to interlock with the guide rail 425 of the base 421. Rack teeth 453 are formed on an outer surface of the tilting rack gear 451. The rack gear 453 is operated in engagement with an output gear 467. An interlocking channel 455 is provided on both sides of the tilting rack gear 451. The guide rail 425 of the base 421 is positioned in the interlocking channel 455 to guide the movement of the tilting rack gear 451.

The tilting table 449 may include a reservoir cover 457 having a water supply hole 459. A bellows type connection hose protruding from the bucket 419 may be inserted through the water supply hole 459 to the reservoir inlet 441. Upon insertion, the valve protrusion 443 extends through the valve seal provided in the bellow type connection hose to allow liquid in the bucket 419 to flow temporary liquid bin 431 of the reservoir tank 431.

Figure 26:
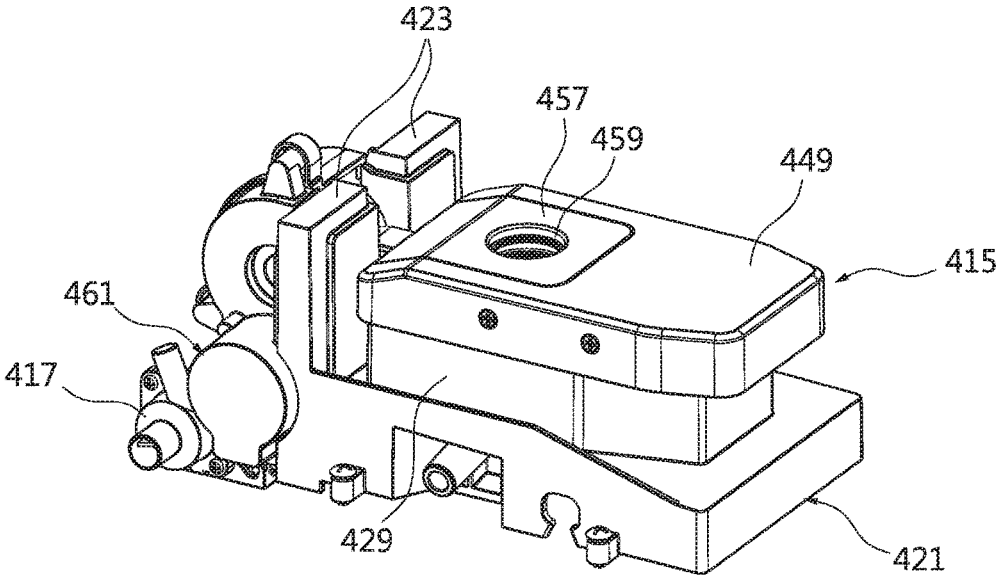
FIG. 26 is a perspective view showing the configuration of a bucket seat.
Figure 29:
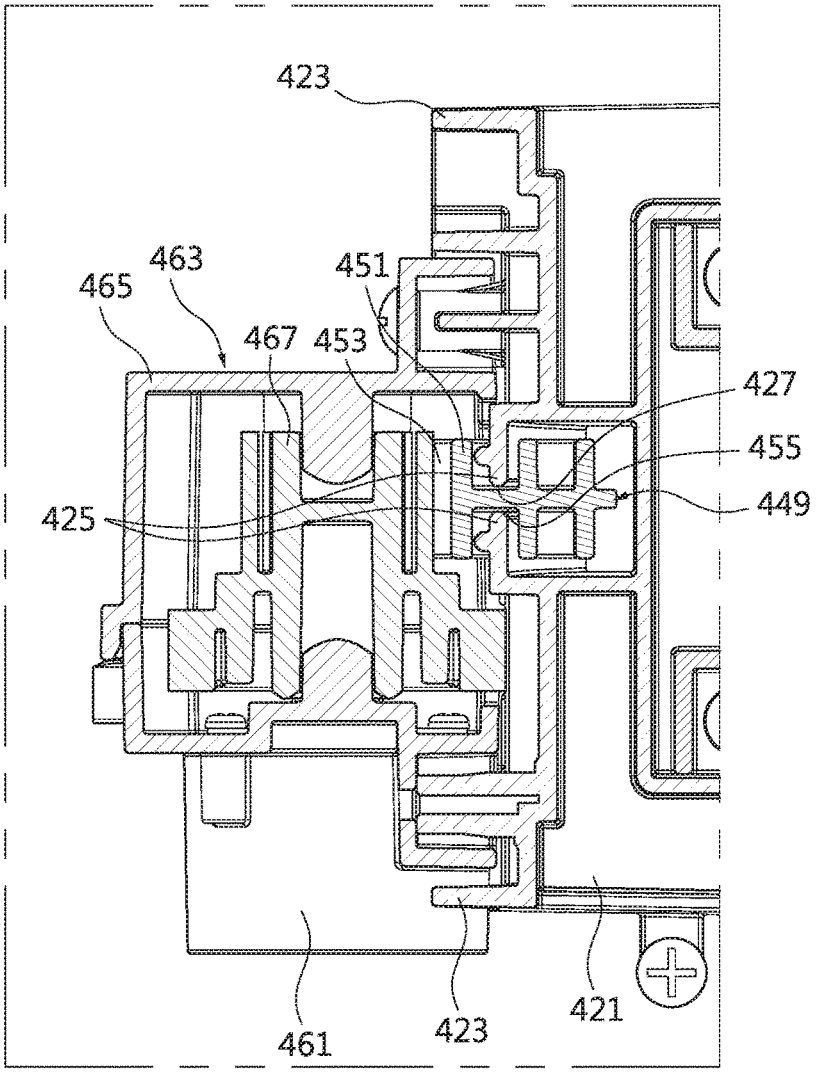
FIG. 29 is a cross-sectional view showing a configuration for guiding the tilt table to be tilted with respect to the base.

The driving force for the operation of the tilting table 449 is provided by the tilting driving source 461 shown in FIGS. 26 and 29. The tilting driving source 461 may be an electric motor. The tilting driving source 461 is installed at the rear of the base frame 421. A tilting reducer 463 which decelerates and transmits the driving force of the tilting driving source 461 is connected to the output shaft of the tilting driving source 461. The reducer housing 465 forms the appearance of the tilting reducer 463, and a plurality of gears are installed in the reducer housing 465. The last gear in the gear train of the tilting reducer 463 is the output gear 467. The output gear 467 is engaged with the rack gear 453 of the tilting table 449.

A proximity sensor 470 may be placed on the front of the housing 10. See FIG. 1. The proximity sensor 470 detects an approach of a user who intends to replace or refill the bucket 419. When the user approaches the proximity sensor 470, the first movable panel 16 slides automatically to an open position to reveal the first inner space 203, and the tilting table 9 may be automatically tilted so that the top of the bucket 419 protrudes from the first inner space 203. See FIG. 38. As can be appreciated, a manual or touch button may be used instead of the proximity sensor 470, or any other means may be used in place of the proximity sensor 470 to recognize a user's intention to replace or refill the bucket 419.

As shown in FIGS. 30A-30C and 31, the machine room 500 is formed at one side of the second inner frame 202'. The machine room 500 may comprise a remaining space other the second vertical duct 208' formed by the second space frame 202'. The upper compartment plate 501 form a ceiling of the machine room 500 and may be located at a position which is a first predetermined distance from the upper plate 14 of the housing 10. The lower compartment plate 501' may form a bottom of the machine room 500 and may be located at a position which is a predetermined second distance above the bottom plate 11 of the housing 10. A second connection duct 204' forming the second connection passage 205' to the second vertical duct 208' is provided below the lower compartment plate 501. The air flow from the branch air flow passage 129 (provided on the right side) may be controlled by another damper (not shown), similar to the first damper 206 for the air flow to the first vertical duct 208. Further, the controller 600 is provided in the machine room 500 for easy access and service if needed in the future.

A drain pump 502 may be installed on the bottom of the lower compartment plate 501'. The drain pump 502 may be situated at a lower position than a bottom of the drain pan 108. A connection hose 504, e.g., a pipe or a tube, may connect the drain pump with the drain pan 108. Based on the lower position, the connection hose 504 transfers the condensed water to the drain pump 502 by gravity. The connection hose 504 may penetrate a side surface of the drain pan 108. The bottom surface of the drain pan 108 and a corresponding inner surface of the connection hose 504 may be aligned. As can be appreciated, the connection hose 504 may be connected to penetrate a bottom of the drain pan 108. The drain pan 108 may be inclined such that the bottom surface of the drain pan 108 is tilted toward a side connected to the connection hose 504.

The connection hose 504 may be divided into an upper end 505, a connection section 505' and a lower end 505". The upper end 505 is connected to the drain pan 108 and the lower end 505" is connected to the drain pump 502. The lower end 505" is located at the lowest position of the connecting hose 504, and a predetermined height difference exists between the upper and lower ends 505, 505". The connection section 505' is provided where the height difference exists between the upper and lower ends 505, 505".

A discharge hose 506, e.g., a pipe or a tube, is connected to the drain pump 502. The discharge hose 506 serves to transfer the condensed water pumped through the connection hose 504 and to the outside through the discharge hose. The discharge hose 506 extends through a hole 13'*b* of the rear plate 13 to the outside. A minimum height H of the discharge hose 506 is at least 400 mm, and a maximum height H of the discharge hose 506 of the hose through a first hole 13'*b* of the rear plate 13 may be an uppermost end of the rear plate 13.

The machine room 500 has a gas supply hose 510, e.g., a pipe or a tube, provided through a second hole 13'*a* of the back plate 13. The gas supply hose 510 may be used to supply air containing a higher concentration of oxygen and/or anion (compared to the ambient air) to the air passage 102. The supply of higher concentration of oxygen and/or anion may create a healthier living environment. The supply hose 510 may penetrate through the back plate 13, e.g., the second hole 13'*a*, the second inner space frame 202' and the second partition plate 19' such that the main air passage 102 may be configured to receive an additional air supply provided via an external source, e.g., an oxygen tank and/or an anion generator or an air ioniser. Depending on the size, the anion generator may be provided inside of the main air passage 102 while the oxygen tank is coupled to the gas supply hose 501.

Figure 30D:
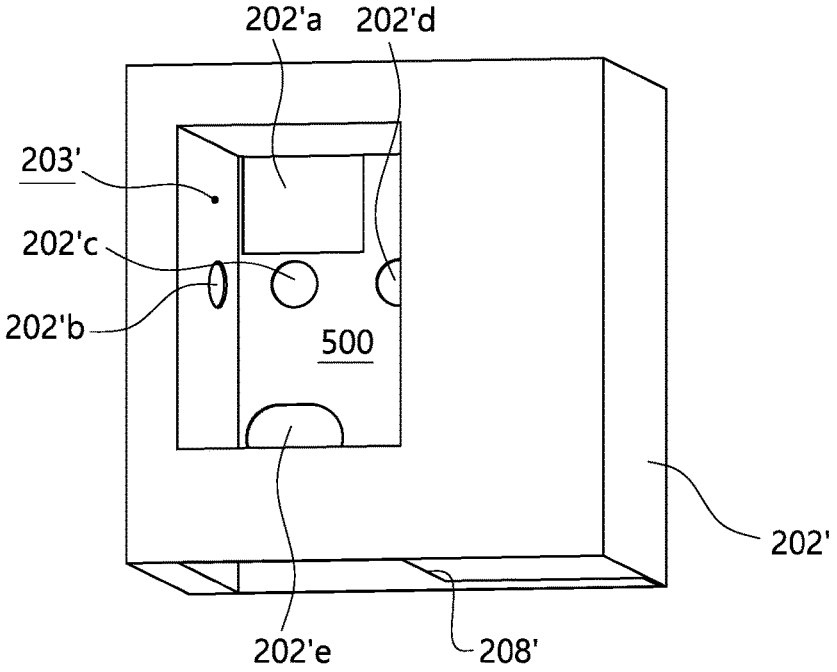
FIG. 30D is a perspective view of the second inner frame 202'.
Figure 31:
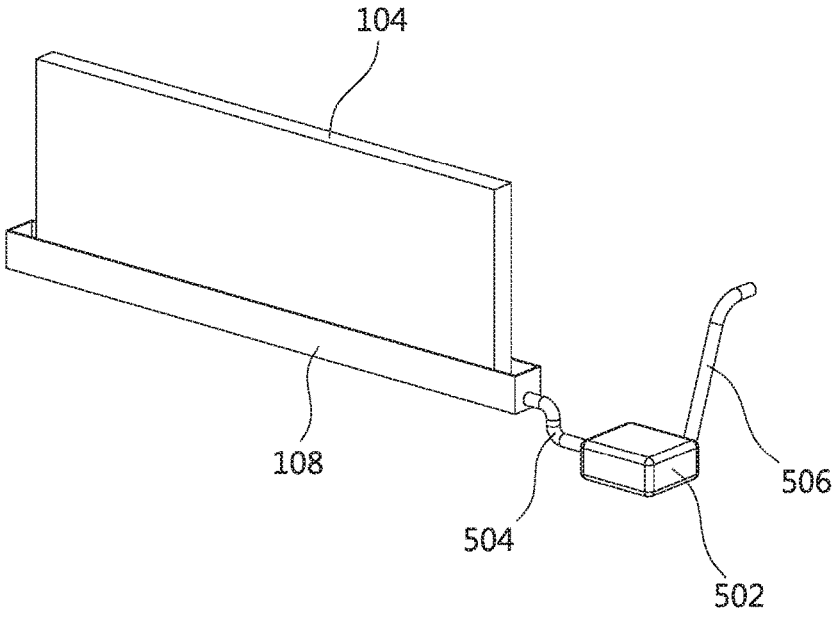
FIG. 31 is a perspective view of a drain pump.

As shown in FIG. 30D, the second inner frame 202', which is provided inside the second secondary space 24, provides the second inner space for the machine room 500, the second vertical duct 208', the upper compartment plate 501, and the lower compartment plate 501'. The second inner frame 202' includes holes 202'*a*, 202'*b*, 202'*c*, 202'*d* and 202'*e* aligning with the power supply hole 26, through hole 29, a first hole 13'*a*, a second hole 13'*b*, and through hole 13", respectively. Further, the second inner frame 202' may include additional holes or openings for the third hole 13'*c* and the second connection duct 204'.

Figure 32:
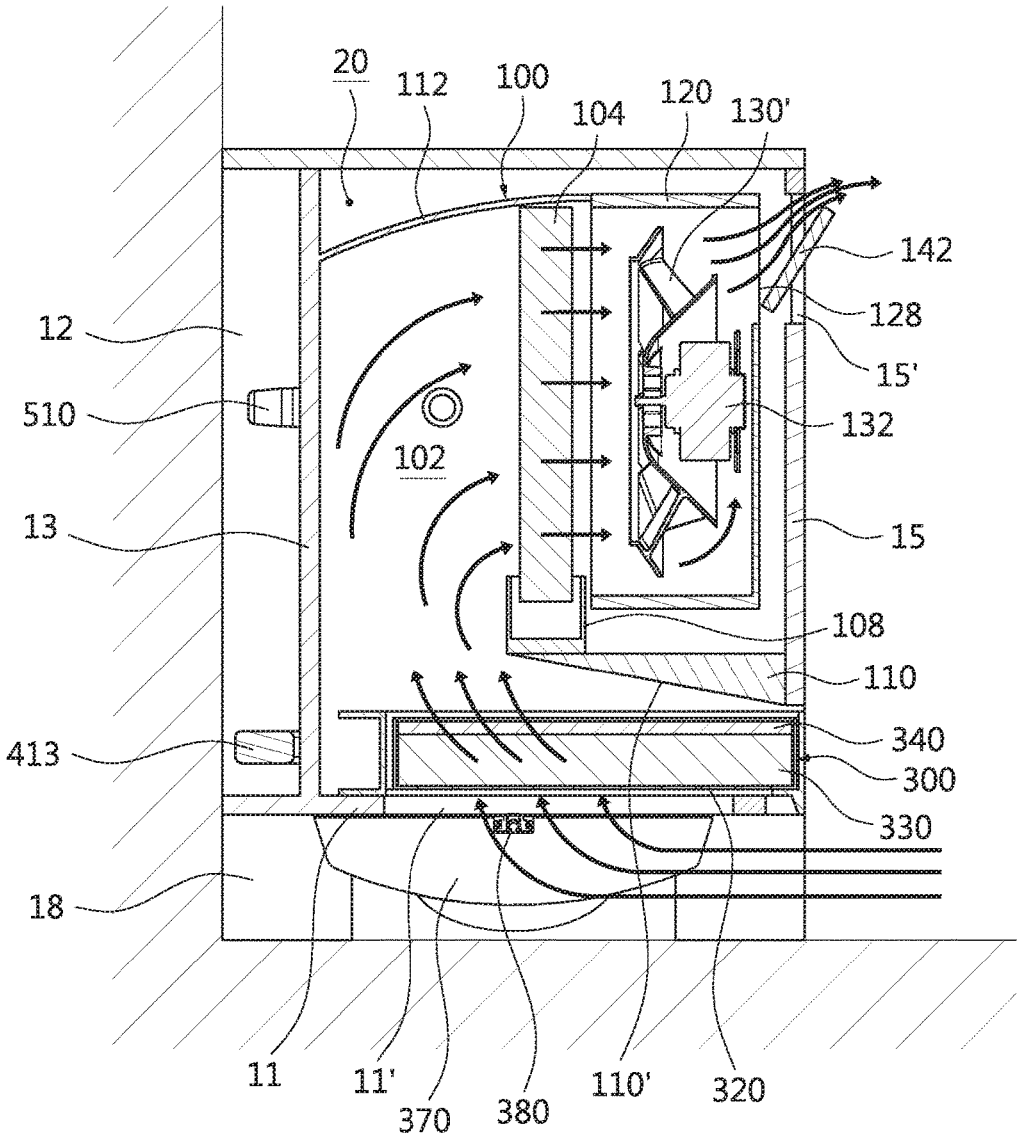
FIG. 32 illustrates an operational air flow through the heat exchanger and discharged through the louver.
Figure 33:
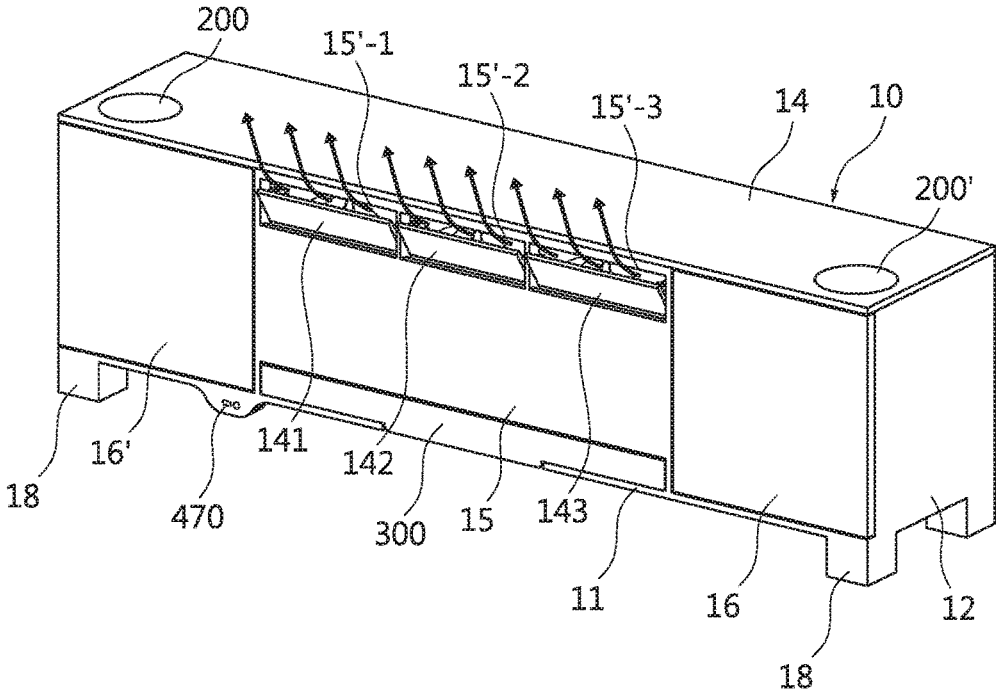
FIG. 33 illustrates an operational air flow discharged simultaneously through the first to the third discharge port.

As shown in FIGS. 32 and 33 of the air management apparatus or device, ambient air or indoor air is drawn through the bottom inlet 11' by turning on at least one of the primary impellers 130, 130', 130". The air passes through the replaceable filter 300 for removal of dust, foreign substances, and odors. The air suctioned through the bottom inlet 11' is directed to flows to the rear end of the air passage 102 by the inlet guide 110. Because of the angled guide surface 11' of the air inlet guide 110 being inclined upward toward the rear plate 13, i.e., the space between the angled guide surface 110' and the replaceable filter 300 becomes wider toward the rear plate 13, air passing through the replaceable filter 300 is mainly guided toward the rear plate 13.

Air flowing to the rear end of the main air flow passage 102 near the rear plate 13 is directed to enter the primary impeller openings 124, 124' and 124" by the operation and suction force of the primary impellers 131, 131' and 131". Prior to entering the primary impeller openings 124, 124', 124", the air drawn into the main air flow passage 102 is heat-exchanged while passing through the heat exchanger 104. The upper guide 112 guides the air flowing in the air flow path 102 so that air is transferred or directed to the heat exchanger 104. The upper guide 112 may allow all of the air flowing in the main air flow path 102 to pass through the heat exchanger 104 while preventing the air from flowing over the top of the heat exchanger 104.

Based to the number of primary impeller openings and/or the number of primary impellers being driven, the air flow path may be separated. For example, if all three primary impellers 131, 131', 131" are driven, the heat exchanged air enters corresponding primary impeller openings 124, 124', 124". The heat exchanged air is drawn through the primary impeller inlet 126 and exhausted to the primary impeller outlet 128. When the louvers 142, 142, 143 of the corresponding discharge ports 15'-1, 15'-2, 15'-3 are opened to be at a predetermined angle, heat exchanged air exhausted through the primary impeller outlet 128 is guided by the louvers 141, 142, 143 and discharged into the indoor space.

In the present embodiment, the air or heat exchanged air may be discharged through the discharge ports 15'-1, 15'-2 and 15'-3 based on the operation of the primary impellers 131, 131' and 130". The discharge of the air through the discharge ports 15'-1, 15'-2, 15'-3 may be independently set according to whether the specific primary impellers 130, 130', 130" are turned ON. For example, when only the first primary impeller 130 is turned ON while second and third primary impellers 131',131" are turned OFF, the first louver 141 may be opened at a predetermined to discharge the heat-exchanged air or air is dispersed only through the first discharge port 15'-1. When only the second primary impeller 131' is turned ON, the second louver 142 may be opened at a predetermined angle to discharge the air, e.g., heat exchanged air, only through the second discharge port 15'-2. Similarly, when only the third primary impeller 131" is turned ON, the third louver 143 may be opened at a predetermined angle to disperse the air only through the third discharge port 15'-3. However, as can be appreciated, the operation of the primary impellers 131, 131' and/or 131" may be combined to disperse the air through a combination of corresponding discharge ports 15'-1, 15'-2, 15'-3.

Further, the distance of the air dispersed through the discharge port 15'-1, 15'-2, 15'-3 may be independently controlled by varying the rotational or pivot angle of the louvers 141, 142, 143. As such, the air management or air dispersal may be performed and combined at the front region of the housing 10 according to the operation of the primary impellers 131, 131', 131" and the rotation angles of the louvers 141, 142, 143. Referring to an example in which the air management device is operated in the present embodiment, three users sitting or standing in front of the housing 10 in a position corresponding to each of the discharge ports 15'-1, 15'-2, 15'-3, the operation of turning OFF and ON and rotational speed of the primary impellers 131, 131', 131") and the rotation angle of the louvers 141, 142, 143 may be controlled according to each user based on individual needs to manage the air. In the example shown in FIG. 33, the first damper 206 on the left side and corresponding damper on the right side may be closed to prevent air, e.g., heat exchanged air, from being diverted to the retractable first and second fans 200, 200' through the branch air flow channel, e.g., 129, where air may directed to the retractable first duct or first pop-up duct 234 and/or retractable second duct or second pop-up duct 234'.

The opening and angle adjustment of the louvers 141, 142, and 143 are performed by driving the louvre motors 141', 142', and 143'. The louvers 141, 142, 143 are rotated to an angled opened position when pivot brackets 145 connected to the output shafts of the louver motors 141', 142', 143' are rotated. The output shafts of the louver motors 141', 142', 143' may be operated by setting a speed and a torque by a reduction gear therein. The rotation angles of the louvers 141, 142, and 143 may be set by the degree of rotation of the output shafts of the louver motors 141', 142', 143'.

The rotation or pivot angles of the louvers 141, 142, 143 may be selected by the user selecting a corresponding operation mode from a plurality of preset operation modes. Through this operation, air, e.g., heat exchanged air, discharged through the discharge ports 15'-1, 15'-2, and 15'-3 may be directly delivered to a specific user or indirectly. For example, when the heat-exchanged air is discharged in the forward direction of the discharge ports 15'-1, 15'-2, and/or 15'-3, the air may be directly delivered to the user in front of the housing 10 when the rotation angle of the louvers 141, 142, 143 is ninety (90) degrees from a vertical axis. Alternatively, by adjusting the rotation angle of the louvers 141, 142, 143 to be less than 90 degrees, air discharged from the discharge port 15'-1, 15'-2, and/or 15'-3 may be indirectly dispersed to the user. As can be appreciated, the rotation angle louvers 141, 142, 143 may not be fixed to a single angle. Instead, the rotation angle may change between two different angles to disperse the air into the livable space.

Figure 34:
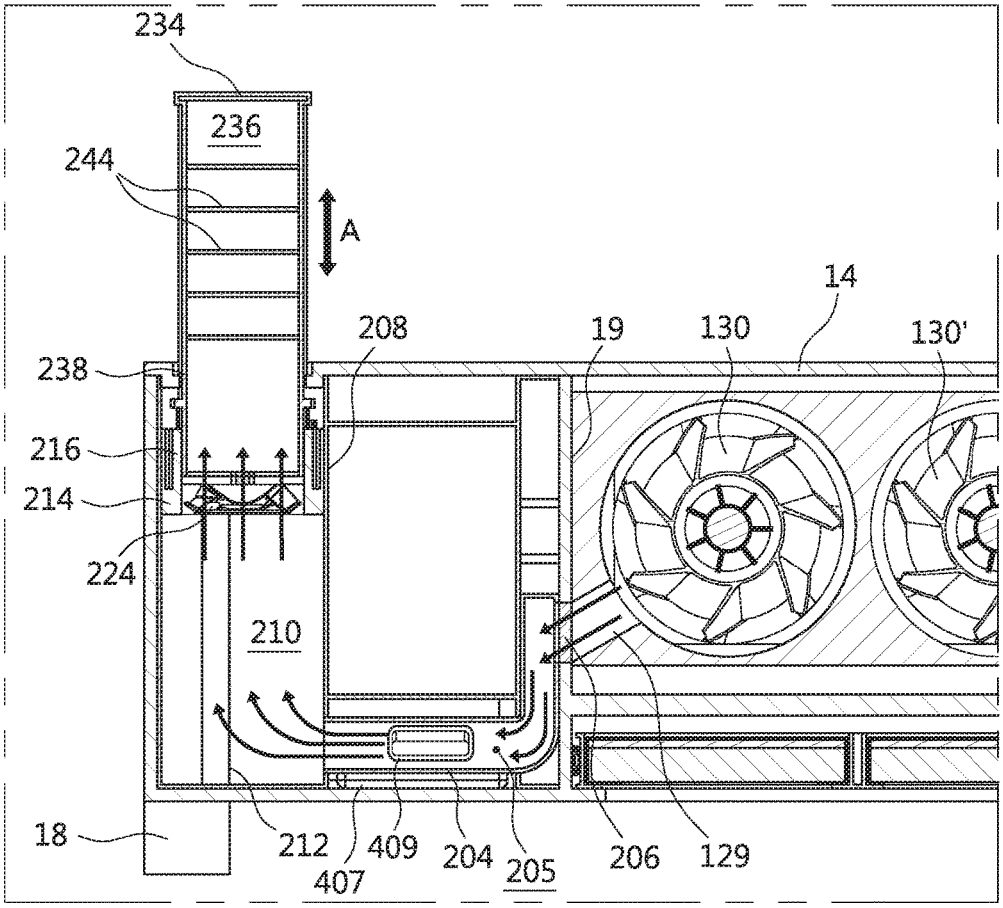
FIG. 34 illustrates the pop-up duct used to protrude from the housing.
Figure 35:
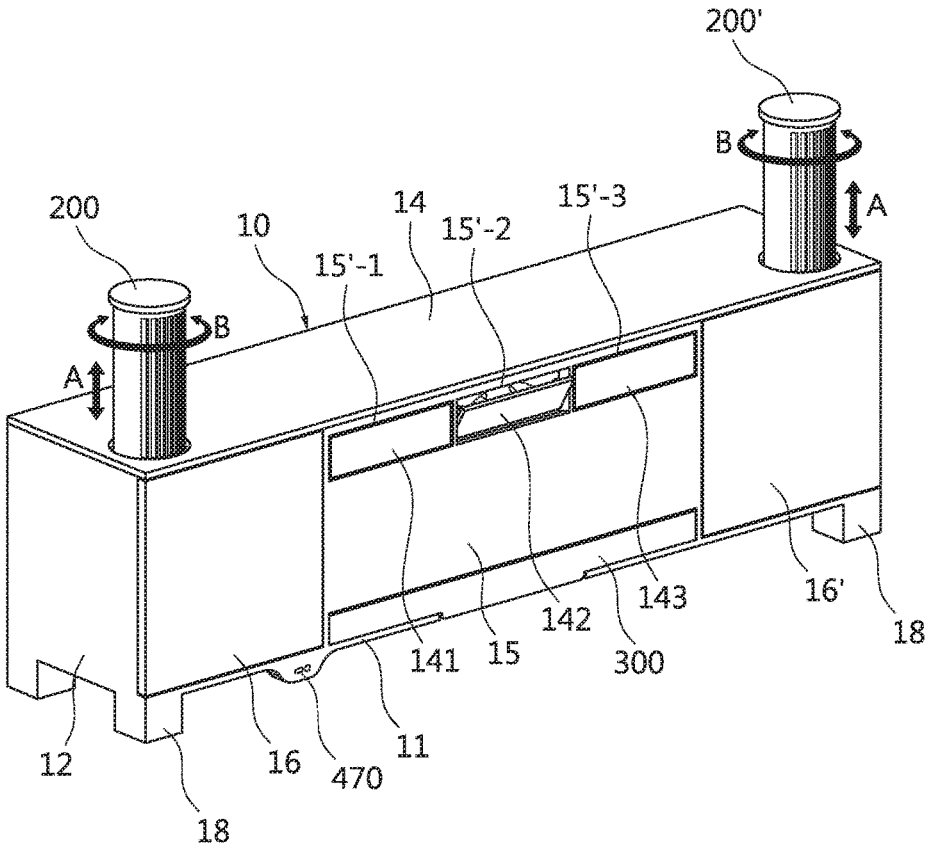
FIG. 35 is a view showing an operation state in which a discharge port is opened and pop-up ducts on both sides protrude to discharge air.

As shown in FIGS. 34-35, the retractable first and second fans 200 may be operated to disperse air further and/or wider than using only the discharge port 15'-1, 15'-2, 15'-3. The retractable first and/or duct 234, 234' may protrude above the upper surface of the housing 10 and rotate to disperse air to a further and/or wider area including a space adjacent to the space in which the air management device is installed. For example, if the air management device of the embodiment is used in the living room, the air coming out through the retractable first and/or second fan(s) 200, 200' may disperse the air to the adjacent kitchen.

In order for air to be discharged or dispersed to the surrounding space through the discharge vents 242 of the retractable first duct 234, air may be supplied to through the branch air flow passage 129. The first damper 206 may be opened to allow the branch air flow passage 129 and the first connection duct 204 communicate with each other. When at least one of the first primary impeller 131 or the third primary impeller 131" is turned on, the heat-exchanged air may be discharged through the discharge vents 242 of at least one of first or second retractable fans 200, 200' protruding above the top surface of the housing 10. Although the second louver 142 of the second discharge port 15'-2 is opened when the second primary impeller 131' is turned on, the second louver 142 may be closed similar to first louver 141 and third louver 143 and the second primary impeller 131' turned off while at least one of the first or third primary impeller 131, 131" turn on such that air is discharged or dispersed only through the first and second retractable fans 200, 200'.

FIG. 34 illustrates the air flow through the first retractable fan 200 on the left side of the housing 10. When the first primary impeller 130 is driven to be ON and the first damper 206 is opened, the air exchanged in the heat exchanger 104 flows to the branch air flow passage 129. Air flowing into the branch air flow passage 129 passes through the opened first damper 206 to the first connection passage 205 of the first connection duct 204. The first connection passage 205 is in communication with the first vertical flow path 210 of the first vertical duct 208, so that the air passing through the first connection passage 205 flows to the first vertical flow path 210.

In order to discharge the air through the discharge vents 242 of the first retractable duct 234, the first retractable fan 200 is raised above the upper surface of the housing 10. As previously described, the retractable first duct 234 is supported on a first lift platform 214, and when the lift motor 230 is turned ON, the second lift gear 232 rotates along the first lift gear 212 to raise the lift platform 214 with the retractable first duct 234, as shown in FIG. 35 in the direction of the arrow A. See also FIGS. 13, 15 and 16.

The first retractable fan 200 may also rotate in the direction of the arrow B shown in FIG. 35. For rotation, the rotary motor 226 installed in the lift platform 214 may be turned ON. When the rotary motor 226 is driven, the retractable first duct 234 rotates in conjunction with the second rotary gear 240 formed on the first support base 238 of the retractable first duct 234 while the first rotary gear 228 rotates. By rotating the retractable first duct 234 in a protruding state, the heat-exchanged air may be sent to a desired position by the user.

The discharge vents 242 may formed in an area of less than half of the retractable first duct 234 when viewed from the front. Although the retractable first duct 234 may rotate 360 degrees, the rear surface of the housing 10 is installed adjacent to the wall of the living space, and the retractable first duct 234 may substantially discharge air over a rotational region of about 180 degrees. For example, when the user is in front of the discharge ports 15'-1, 15'-2, 15'-3, the user may rotate the first retractable fan 200 such that discharge vents 242 are directed in the user direction to discharge air to the users. In other words, the air may be discharged to a particular by rotating the retractable fan 200 such that the discharge vents 242 face the corresponding space desired by the user.

Alternatively, the retractable first duct 234 may discharge the air while rotating the retractable first duct 234 by continuously reciprocating between predetermined angle ranges from side to side. Alternatively, or in addition thereof, the first directional blades 244 may adjust air dispersal in a vertical direction as the air exits through discharge vents 242. By adjusting the longitudinal or lateral direction of air dispersion, the direction of the heat exchanged air may be adjusted. Further when the air is discharged through the discharge vents 242 of the first retractable duct 234, the first secondary impeller blades 224 may be selectively rotated. The rotation of the first secondary impeller blades 224 pressurizes the air in the first communication passage 218 to send the air discharged through the retractable first duct 234 farther.

As can be appreciated similar to selective operation of the retractable first and/or second fans 200, 200', the first to third discharge ports 15'-1, 15'-2 and 15'-3 may be selectively opened or closed based on the operation of the first to third primary impellers 131, 131', 131". For example, when more users are situated in front of the housing 10, air dispersion of heat exchanged air may be manage air on different conditions and locations at the same time. In FIG. 35, the first and third louvers 141 and 143 are shown in a closed position, but may be selectively opened to allow air to discharge through them depending on the number of users or location for air dispersal.

As previously described, the replaceable filter 300 filters the air. The air delivered to the bottom inlet 11' passes directly through the first filter 320. Since the first filter 320, the second filter 330, and the third filter 340 are sequentially stacked on the filter frame 301, filtered air further filtered through the second filter 330 and the third filter 340 to further remove dust, fine dust, and odors are removed. Thereafter, air passing through the replaceable filter 300 enters the main air flow passage 102.

After extended and/or continuous filtering based on the operation of the air management device in the livable space, dust and odor components may be collected by the replaceable filter 300. The filter cleaner 370 is operated to maintain the performance of the replaceable filter 300 above a certain level of performance. The filter cleaner 370 is installed at one side of the bottom surface of the bottom plate 11, which is an area outside the bottom inlet 11', and moves along the cleaner rail 380 upon receiving an operation signal from the controller 600.

As the filter cleaner 370 passes through the bottom inlet 11', dust and foreign matter are sucked through the cleaner suction port 373, e.g., dust and foreign matter in the first filter 320 enter the cleaner suction port 373 by the suction force of the cleaner 370. Based on the filter cleaner operation, the performance of replaceable filter 300, e.g., the first filter 320, may be improved.

As previously discussed, the filter cleaner 370 has a predetermined weight and may sag on the cleaner rail 380 due to gravity. For example, the filter cleaner may sag at the middle of the cleaner rail, which may correspond to the farthest location from the ends of the cleaner rail 380 mounted to the bottom plate 11 of the housing, the elastic deflection of the elastic bristles 375 around the cleaner suction port 373 provide continuous contact with the bottom inlet 11' to prevent loss of suction force. Even if the distance between the surface of the first filter 320 and the filter cleaner 370 changes, the degree of elastic deflection of the elastic bristles 375 may change to allow continuous contact between the first filter 320 and the filter cleaner 370. The filter cleaner 370 performs the cleaning on the first filter 320 while linearly reciprocating along the cleaner rail 380. When the cleaning of the first filter 320 is completed, the filter cleaner 370 rest on the bottom surface of the bottom plate 11, e.g., at an end of the cleaner rail 380, to prevent impediment of the bottom inlet 11'.

Figure 36:
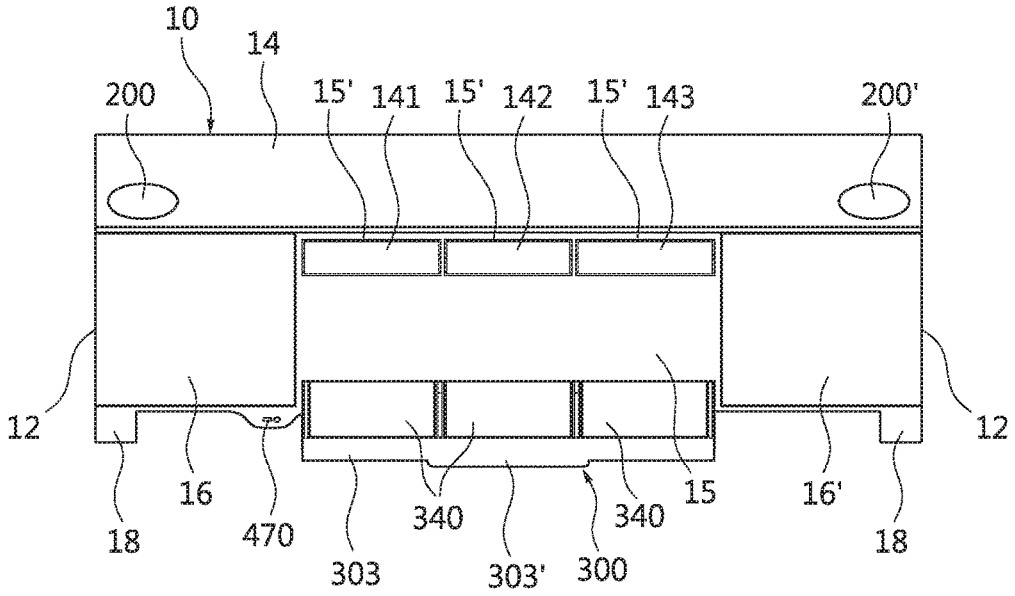
FIG. 36 is an operational state diagram showing a state in which the replaceable filter withdrawn from the housing.

After extended use or cleaning of the replaceable filter 300 is insufficient, the first, second and third filters 320, 330, and 340 in the filter frame 301 may be removed from the housing 10 for replacement. When the user grasps and pulls the handle 303', the filter frame 301 may be pulled out of the housing 10 like a drawer. The rail assembly 350 is assists in withdrawal of the filter frame 301 from the front of the housing 10, as illustrated in in FIG. 36. When the filter frame 301 is withdrawn from the front of the housing 10, the support rib 313 at the rear end of the filter frame 301 is hooked inside the bottom entry for the filter frame 301 at the bottom of the front plate 15 of the housing 10 to support the rear end of the filter frame 301 and to prevent the front end of filter frame 301 from falling. Further, the rail assembly 350 couples the filter frame 301 to the housing 10 to the filter frame 301 from falling out arbitrarily.

In this state, the second filter 330 and the third filter 340 in the storage space 325 are simultaneously removed from the filter frame 301 together with the first filter 320 when the storage case 324 is lifted out of the filter frame 301. The filters 320, 330, and 340 in the three pass openings 302 may be all be pulled out to perform maintenance or replacement. After maintenance or replacement with new filters, the storage case 324 with filters 320, 330, and 340 may be placed back into the plurality of passage openings 302 of the filter frame 301. For example, the second filter 330 and the third filter 340 are sequentially stacked in the storage space 325 of the storage case 324 and are positioned in the passage openings 302, and thereafter, the filter frame 301 is pushed or slide back into the housing 10.

Humidification may be added to the air being discharged through the first and/or second retractable ducts 234, 234' in two scenarios. In the first scenario, humidification of the air may be possible without the heat exchange through the heat exchanger 104, i.e., humidification and filtering of the ambient air. In the second scenario, humidification of the air may be possible for all heating modes of operation.

In the first scenario, the inlet fan 403 is operated to suck air in from the main air flow passage 102 through the inlet duct 401. The air pressurized by the inlet fan 403 is sent to the steam generator 407 through the transfer duct 405. In the steam generator 407, the liquid steam/vapors made by heating the liquid delivered from the bucket 419 is mixed with the air. The humidified air may be delivered through at least one of the first discharge duct 409 or the second discharge duct 411 to at least one of the first retractable duct 234 or the second retractable duct 234', respectively.

Figure 37:
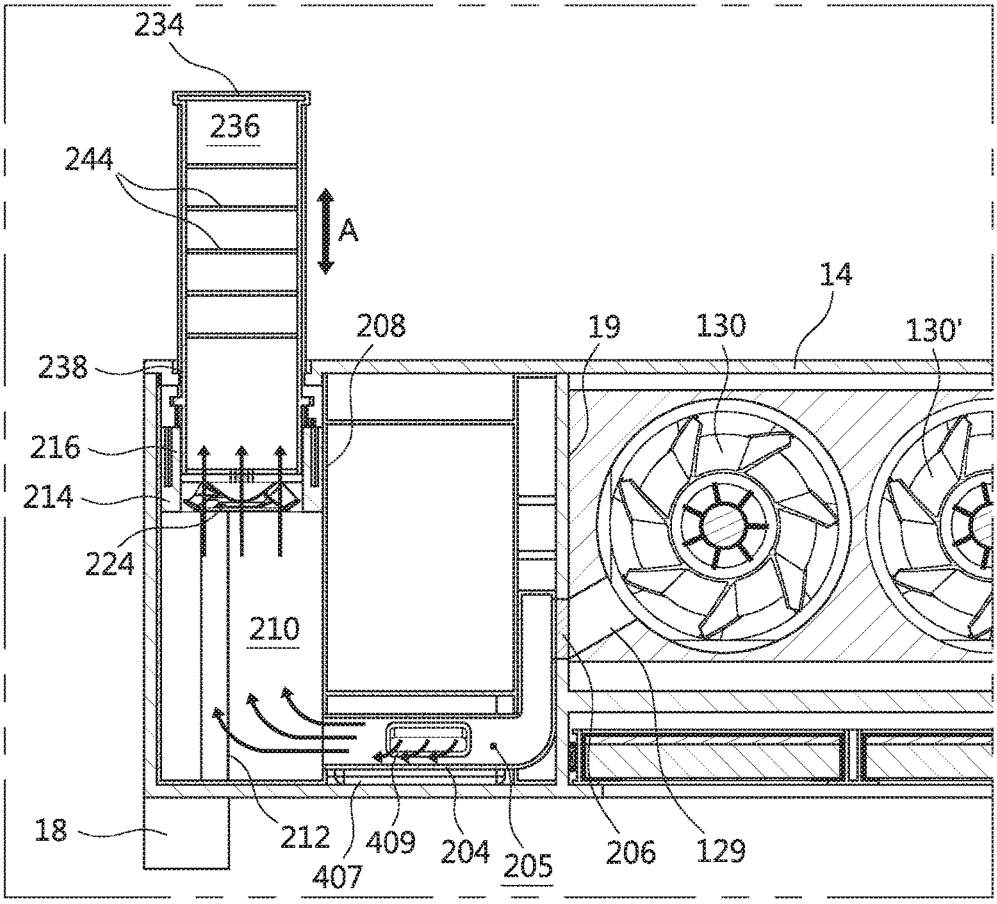
FIG. 37 is an operation state illustrating the humidified air being discharged through a pop-up duct.

FIG. 37 illustrates the delivery of the humidified air to the retractable first duct 234 on the left side of the housing 10 by opening the first discharge duct 409 to the first connection passage 205 of the first connection duct 204. The first damper 206 may be closed and the first primary impeller 130 may be turned OFF. Optionally, if the heat exchanger is maintained in an OFF state, the first damper 206 may be opened and the first primary impeller 130 may be turned ON to allow an air flow through the branch air flow passage 129. The humidified air from the first discharge duct 409 passes through the first connection passage 205 and the first vertical flow path 210 to the retractable channel 236 of the first retractable duct 234. The humidified air is discharged through the discharge vents 242 of the first retractable fan 200 protruding above the upper surface of the housing. The first retractable duct 234 may be rotated to disperse the humidified air to a farther and wider area. Further, the first secondary impeller blades 224 may be driven to pressurize the humidified air to be discharged farther.

In the second scenario, humidification may be additionally performed for during heating or cooling operation of the HVAC system 100. In such a case, heat exchange is performed in the heat exchanger 104, and the heat-exchanged air is dispersed through at least one of the discharge ports 15'-1, 15'-2, 15'-3. While being discharged therethrough, the humidified air may be simultaneously discharged through the first connection passage 205, the first vertical flow 210, the retractable channel 236 in order to be discharged into the indoor space, similar to the first scenario.

Figure 38:
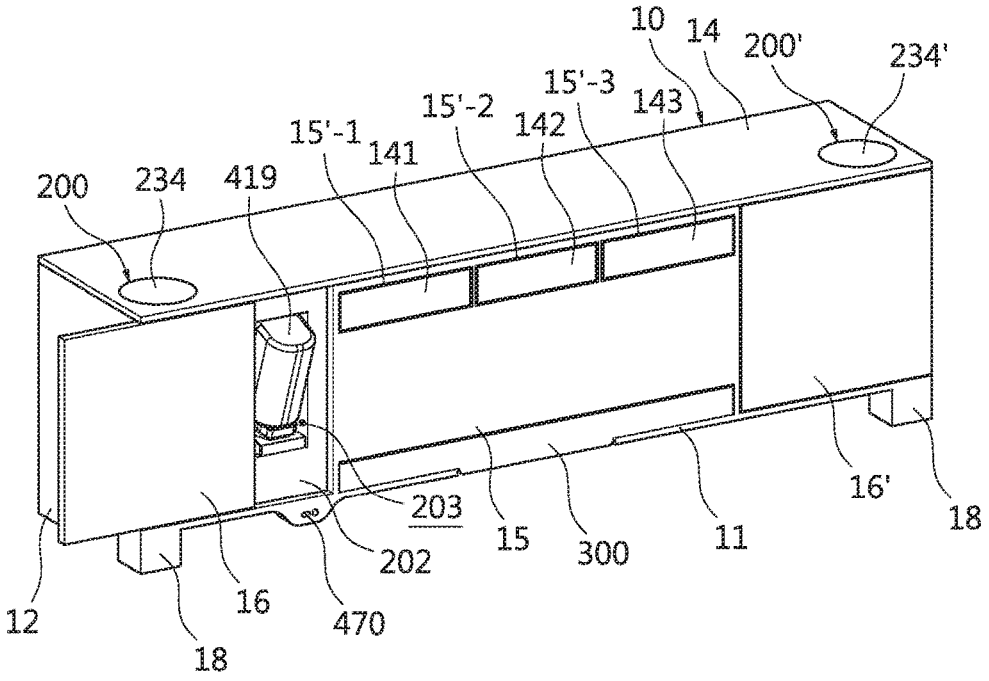
FIG. 38 is a use state in which the first movable panel is opened and the tilt table is inclined to expose the bucket.

As can be appreciated, liquid, e.g., water or mixture with solvent, is required for humidification, and may be stored and supplied from the bucket 419. As previously described the bucket 419 is seated on the bucket seat 415 in the first inner space 203. As shown in FIG. 38, when the proximity sensor 470 recognizes the user, the first movable panel 16 slides to the left side, and the tilting table 449 of the bucket seat 415 is operated to be inclined downward toward the front of the housing 10. The inclined position of the bucket 219 assists the user to readily remove and replace the bucket 419 from the first inner space 203. After removal and/or replacement of the bucket 219, the proximity sensor 470 operation instigates the return of the tilting table 449 to a horizontal position, and the first movable panel 16 closes the first inner space 203.

Figure 39:
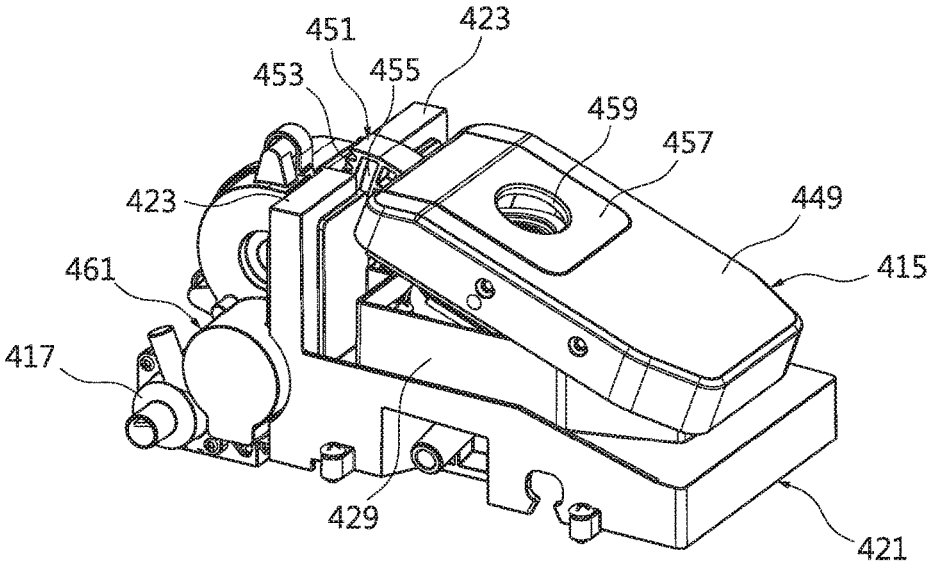
FIG. 39 is an operating state showing the tilt table tilted.
Figure 40:
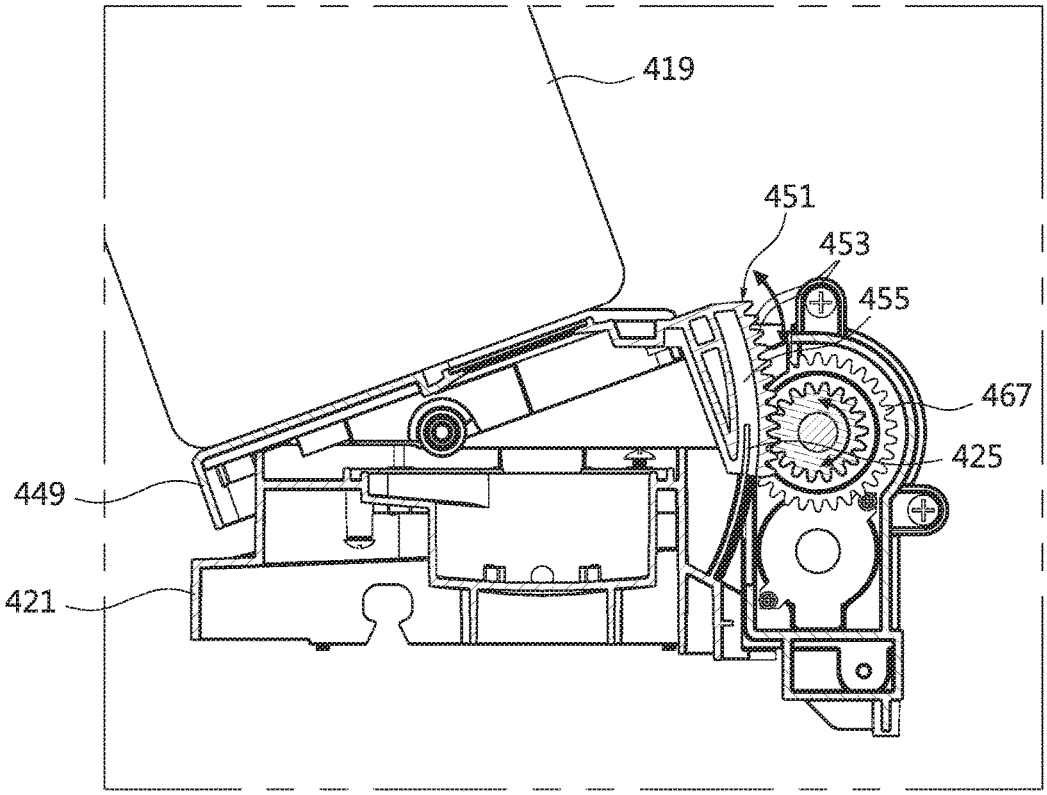
FIG. 40 is an operational state diagram showing the tilt table being driven in an inclined state.

FIGS. 39 and 40 illustrates the operation of the tilting table 449. See also FIGS. 26-28. When the tilting table 449 is rotated, the tilting table 449 is rotated about the shaft 447 with respect to the base 421. The force for the rotation of the tilting table 449 is provided by the motor 461, and the tilting reducer 463 operates the gear train. As the output gear 467 of the tilting reducer 463 is rotated in engagement with the rack teeth 453, the tilting rack gear 451 moves along the guide rail 425 of the base 421. Because the guide rail 425 is positioned in the interlocking channel 455 of the tilting rack gear 451 and guides the tilting rack gear 451 to be moved by the output gear 467, the tilting table 449 is rotated about the shaft 447.

As the tilting table 449 rotates about the shaft 447, the tilting table 449 may be selectively positioned between the horizontal state and the inclined state. Because the bucket 419 is positioned on the tilting table 449, the bucket 419 is in an inclined state when the first movable panel 16 is opened, and the bucket 419 is in an horizontal state when the first movable panel 16 is closed. When the bucket 419 seated on the tilting table 449, the valve in the bucket 419 is opened by the valve protrusion 443 so that liquid may be delivered to the temporary liquid bin 431. The liquid in the temporary liquid bin 431 may be delivered to the steam generator 407 by the humidification pump 417 to be heated and vaporized.

Figure 41:
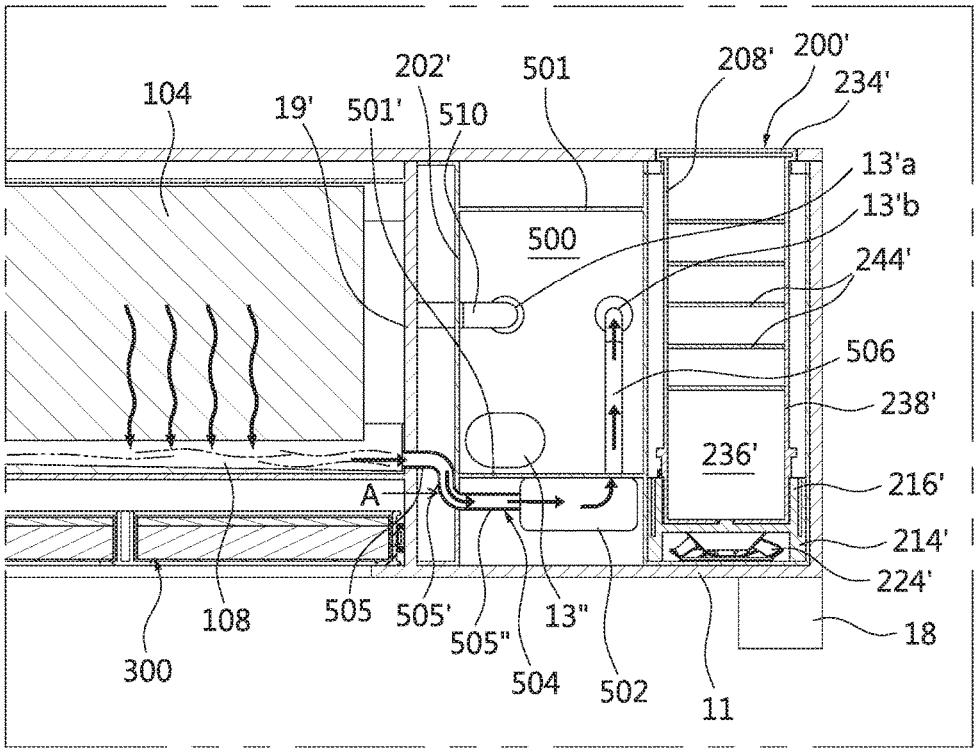
FIG. 41 is a sectional view D30 shown in FIG. 2.

When the working fluid and air exchange heat in the heat exchanger 104, moisture in the air may condense and water may form on the surface of the heat exchanger (104). As the size or the quantity of the condensate formed on the heat exchanger 104 increases, the condensed water may flow down the surface of the heat exchanger 104 and collect in the drain pan 108, as illustrated in FIG. 41. The condensed water collected in the drain pan 108 may flow by gravity into the connection hose 504. When condensed water is delivered to the drain pump 502 through the connection hose 504, the drain pump 502 operates to pressurize the condensed water. The pressurized water is pumped along the interior of the discharge hose 506. The condensate flowing along the discharge hose 506 may be pressurized and moved up to the maximum height H of the discharge hose 506. After the condensed water is delivered to the maximum height H of the discharge hose 506, the condensed water may be discharged by gravity action thereafter.

Because the connection hose 504 has a lower end 505" connected to the drain pump 502 and the upper end 505 connected to the drain pan 108 and the drain pan 108 is inclined toward the connection hose 504, the condensate collected at the drain pan 108 naturally flows down the connection hose 504 by gravity and fed to the drain pump 502. Hence, the condensate on the drain pan 108 is naturally fed by gravity to first fill the connection hose 504, and after the connection hose 504 is filled, the drain pan 108 starts collecting the condensate.

After the drain pan 108 has collected a predetermined amount of condensate or after a predetermined time period of operating the heat exchanger 104, the drain pump 502 is operated or turned ON. For example, a sensing means may be provided in the drain pan 108 to determine the predetermined amount of condensate, or a timer may be started by the controller to start the operation of the drain pump 502. If the condensed water stagnates too long in the drain pan 108, there may be a hygiene problem, such as bacteria propagation, and it may beneficial to minimize the time that the condensed water pools in the drain pan 108, the air to the drain pump 502.

In order to minimize suction power and prevent damage to the drain pump 502, the operation of the drain pump 502 may be stopped in the state where water may remain at the lower end 505" of the connection hose 504. As shown in FIG. 41, the operation of the drain pump 502 may be stopped at the water level A indicated by arrow A. The position indicated by arrow A may correspond to the minimum level of condensate inside the connection hose 504. The highest water level in the connection hose 504 may be the upper position of the connection section 505'.

Figure 43:
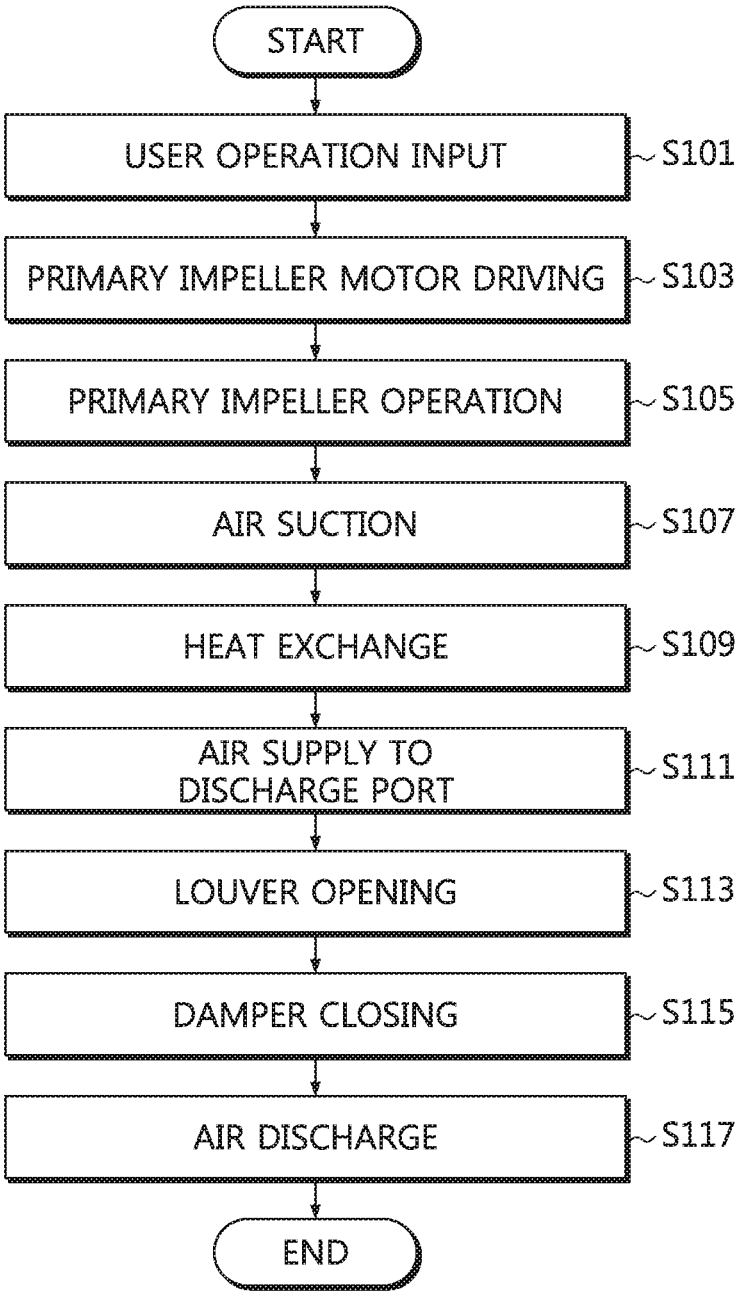
FIG. 43 is a flowchart illustrating a control method of an air management apparatus according to an embodiment.
Figure 44:
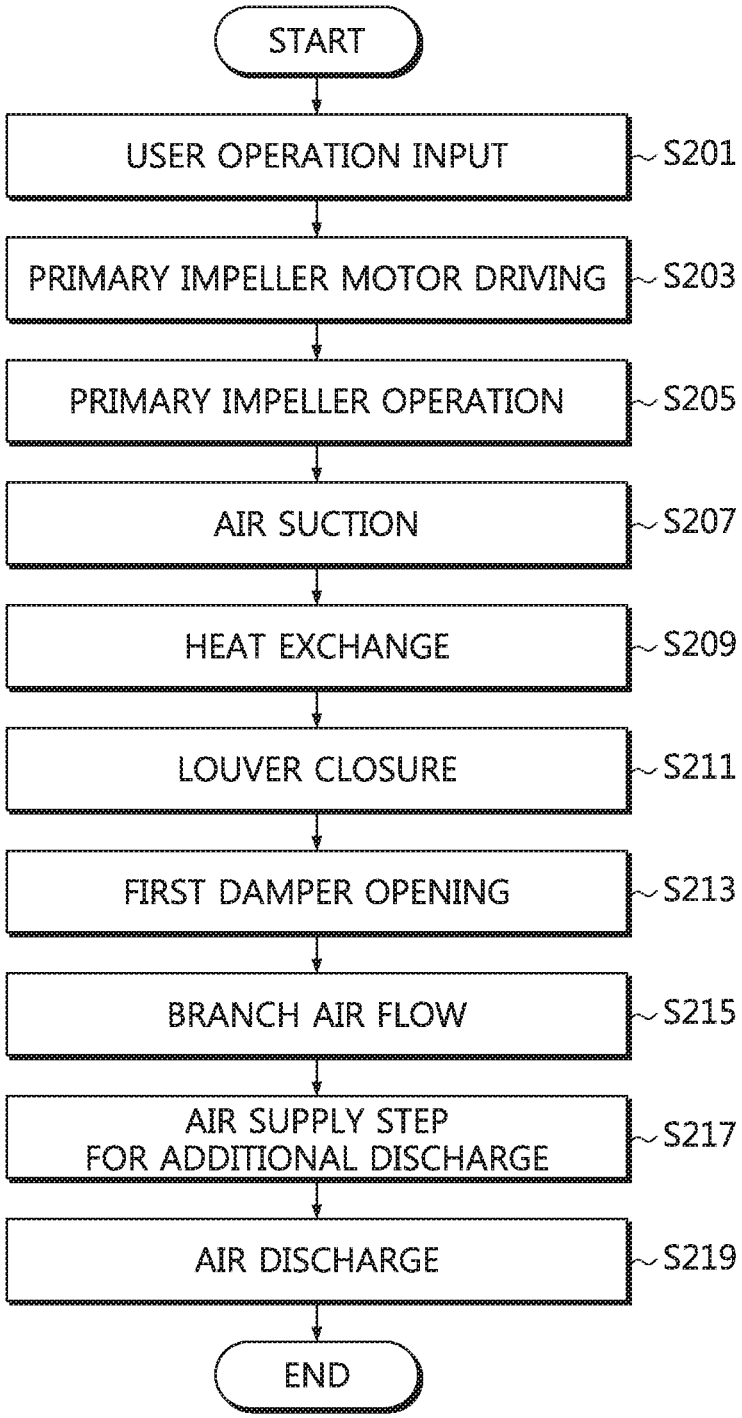
FIG. 44 is a flowchart illustrating a control method of an air management device according to another embodiment.
Figure 45:
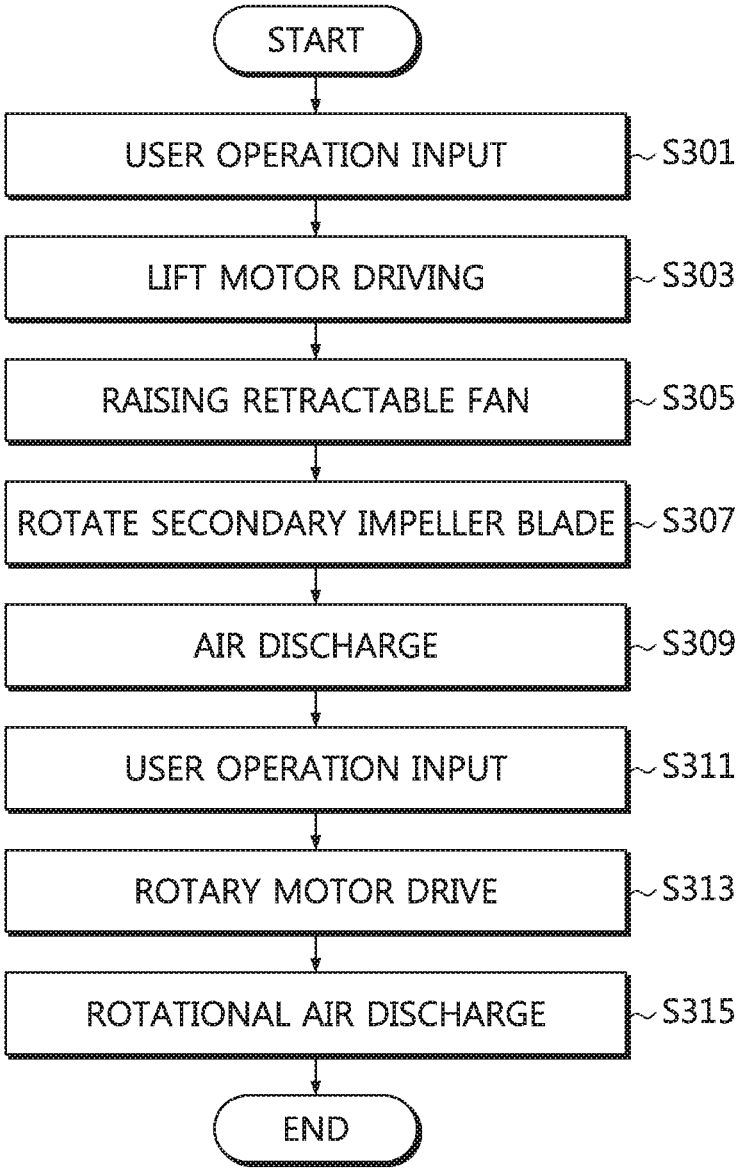
FIGS. 45 to 47 is a flow chart showing a control method of the air management device according to other embodiments.

FIG. 42 illustrates a schematic diagram of an air management apparatus, and FIG. 43 illustrates a flowchart of a control method for the air management apparatus. FIGS. 44 and 45 illustrate flowcharts of the control methods according to another embodiments.

As illustrated in FIGS. 42 and 43, the input unit 17 may be configured to receive a user's manipulation provided on the front surface of the housing 10. The user may input and set an operation of the air management device through the manipulation of the input unit 17. The user may directly touch the input unit 17 or may input the user operation through a wireless communication with an external device. Upon determination of a valid user operation through the input unit 17, the control unit 600 starts an operation for air discharge from the air management apparatus. [S101: User Operation Input step].

The controller 600 drives at least one of the primary impeller motors 132, 132' and/or 132" upon a valid user operation through the input unit 17. [S103: Primary Impeller Motor Driving Step]. Upon activation of the primary impeller motor(s), at least one of the primary impeller blades 130, 130' and/or 130" of the primary impellers 131, 131' and 131" installed in the primary impeller guide 120 rotates to create a suctioning force. [S105: Primary Impeller Operation Step]. The air outside of the air management system is sucked through the bottom inlet 11' and introduced into the primary air flow space 20 therein. [S107: Air Suction Step].

When air flows into the primary air flow space 20 through the bottom inlet 11', heat exchange proceeds in the heat exchanger 104 provided inside the housing 10. To this end, the control unit 600 drives the heat exchanger 104. Specifically, the air passing through the bottom inlet 11' flows through the primary air flow path 102 to exchange heat with the heat exchanger 104. [S109: Heat Exchange Step]. At least one of the primary impellers 131, 131' and/or 131" continue to operate to suction the air in the primary air flow passage 102 through the heat exchanger 104 to deliver the heat exchanged air to at least one of the discharge ports 15'-1, 15'-2, and/or 15'-3 provided on the front plate 15 of housing. [S111: Air Supply Step to Discharge Port]. In order to discharges the air provided to the at least one discharge ports 15'-1, 15'-2 and/or 15'-3 to the outside, the corresponding louvers 141, 142 and 143, which are separately driven by louver motors 141', 142' and 143', must be opened. [S113: Louver Opening Step].

As previously described, the heat exchanged air may be supplied to the at least one of the first retractable fan 200 through the branch air flow passage 129 in the first primary impeller opening 124 or the second retractable fan 200' through another corresponding branch air flow passage in the third primary impeller opening 124". For example, the branch air flow passage 129 may transfer the heat-exchanged air to the first retractable fan 200. The first retractable fan 200 allows the pop-up duct 234 to protrude from the upper surface of the housing 10 to disperse the heat exchanged air farther and wider.

If the first or the second retractable fan 200 or 200' is not used, the controller 600 closes the first damper 206 to prevent passage of air through the branch air flow passage [S115: Damper Closing Step], and the heat-exchanged air is discharged through at least one of the plurality of discharge ports 15'-1, 15'-2, 15'-3 with at least one of the louvers 141, 142, 143 opened to the front of the housing 10. [S117: Air Discharge Step]. Further, the angle of the louvers 141, 142, 143 may be adjusted by the controller 600 based on the current supplied to the louver motors 141', 142' and 143'.

FIG. 44 in conjunction with FIG. 42 illustrate an additional control method of the air management apparatus for discharging the heat exchanged through at least one of the first retractable fan 200 or the second retractable fan 200' without air discharge through the discharge ports 15'-1, 15'-2 and 15'-3. Steps S201 to S209 of FIG. 44 may be the same or similar Steps S101 to S109 of FIG. 43, and hence, the description is omitted. For purpose of illustration, the following description pertains to discharge of air through the first retractable fan 200.

In Step S211 [S211: Louver Closure Step], the louvers 141, 142, and 143 are closed to prevent air from being discharged through the discharge ports 15'-1, 15'-2, and 15'-3. The control unit 600 simultaneously or sequentially opens the first damper 206 to supply air to the first retractable fan 200 through the branch air flow passage 129. [S213: First Damper Opening Step]. As such, the heat exchanged air is supplied to the branch air flow path 129. [S215: Branch Air Flow Step]. Consequentially, the air through the branch air flow passage 129 is supplied to the first retractable fan 200. [S217: Air supply Step for Additional Discharge]. The first retractable fan 200 protruding above one side of the upper surface of the housing 10 discharges the heat exchanged air to the outside. [S219: Air Discharge Step].

FIG. 45 in conjunction with FIG. 42 illustrate an additional control method of the air management apparatus for discharging the heat exchanged through at least one of the first retractable fan 200 or the second retractable fan 200', which may be rotated. For purpose of illustration, the following description pertains to discharge of air through the first retractable fan 200.

A user may input a user operation for lifting and rotating the first retractable fan 200 through the input unit 17. [S301: User Operation Input Step]. When the user's manipulation according to the operation of the first retractable fan 200 is received, the control unit 600 drives the lift motor 230 for the first retractable fan 200 to protrude above the upper surface of the housing 10. [S303: Lift Motor Driving Step]. By the driving of the lift motor 230, the first retractable fan 200 is raised to protrude to the upper surface of the housing (10). [S305: Raising of the Fan 200 step].

The controller 600 may drive a motor to rotate the first secondary impeller blade 224 to pressurize the air discharged through the first retractable fan 200. The first secondary impeller blade 224 pressurizes the air in the first communication passage 218 received through the branch air flow passage 219 to send the air farther. [S307: Rotate Secondary Impeller Blade Step]. The air heat exchanged by the heat exchanger 104 is discharged through the discharge vents 242. [S309: Air Discharge Step].

The first retractable fan 200 may be rotated at a predetermined angle. A user may input a user manipulation for the rotation of the first retractable fan 200 through the input unit 17. If it is determined that the user operation for the rotation of the additional retractable fan 200 is input through the input unit 17, the controller 600 controls the operation of the first retractable fan 200 in the air management apparatus. [S311: User Operation Input Step].

The control unit 600 may drive a rotary motor 226 that provides a rotational force to the first retractable fan 200. [S313: Rotary Motor Drive Step]. The first retractable fan 200 may be rotated by the rotation motor 226. As the first retractable fan 200 rotates, the air heat-exchanged in the heat exchanger 104 may be discharged to the outside. [S315: Rotational Air Discharge Step].

Figure 46:
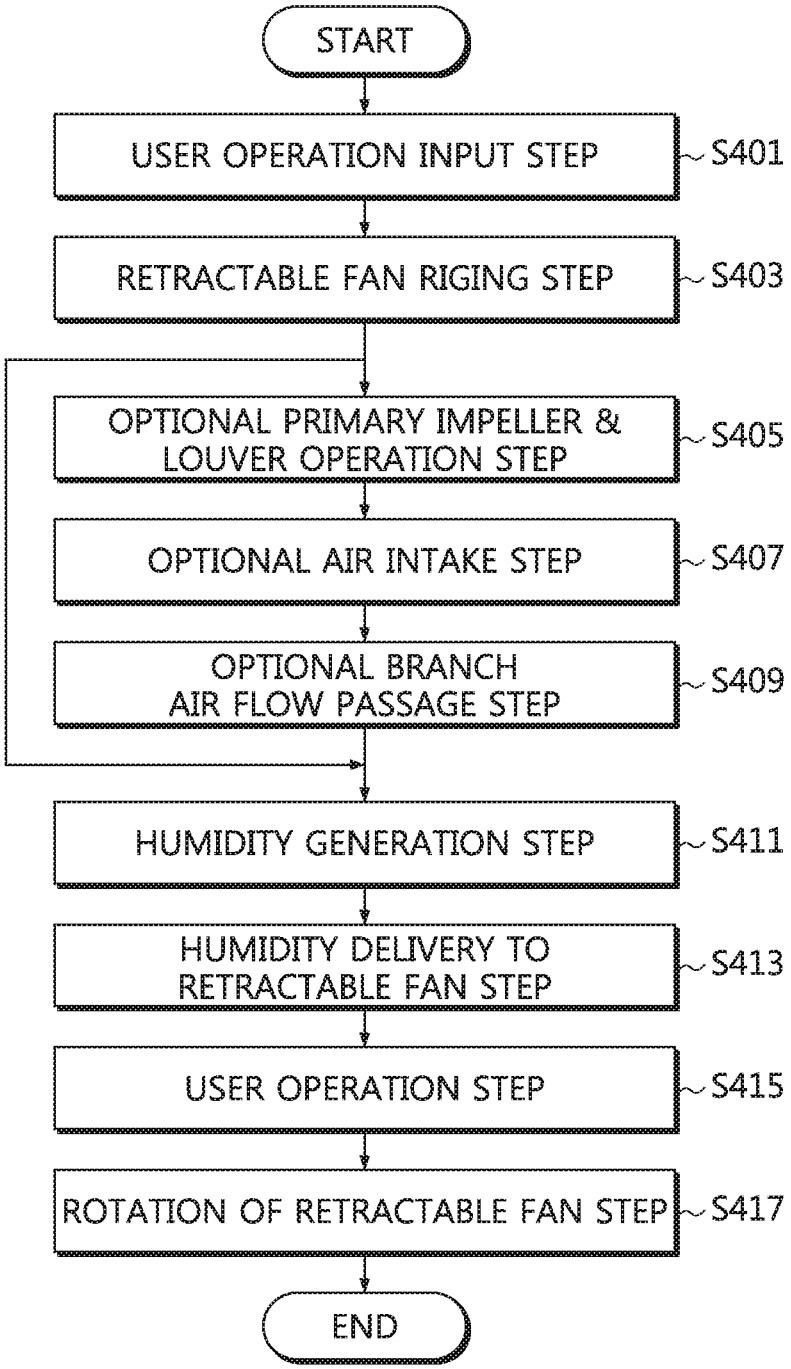

FIG. 46 in conjunction with FIG. 42 illustrate an additional control method of the air management apparatus for discharging the humidified air through at least one of the first retractable fan 200 or second retractable fan 200' with the heat exchanger 104 turned off. A user may input and set an operation for added humidity to the surrounding through the manipulation of the input unit 17. The user may directly touch the input unit 17, or may input the user operation through wireless communication with an external device. If user operation is determined to be valid, the controller 600 starts the operation control for humidification in the air management apparatus [S401: User Operation Input Step].

The controller 600 initiates the humidification process by raising at least one of the first retractable fan 200 or the second retractable fan 200' to protrude above the upper surface of the housing 10. For example, the controller initiates the operation of the lift motor 230 installed in the first lift platform 214. The rotation of the second lift gear 232 coupled to the shaft of the lift motor 230 and engaged with the first lift gear 212 vertically raises the first lift platform 214. As a result, the first retractable duct 234 coupled to the first support ring 216 of the first lift platform vertically rises with the first lift platform 214. [S403: Retractable Fan Rising Step].

Optionally, or in addition, the controller 600 may drive the first primary impeller 131 and may drive the second impeller 131' and/or third impeller 131" to supply the indoor air to the inside through the bottom inlet 11'. If the heat exchanger 104 is turned OFF, and the corresponding louvers 141, 142, and/or 143 may be opened to allow discharge of air [S405: Optional Primary Impeller and Louver Operation Step]. If the corresponding primary impeller or impellers is operated, air is sucked from the outside into the housing 10 through the bottom inlet 11' to flow into the main air flow passage 102. [S407: Optional Air Intake Step]. Further, the controller may open the corresponding dampers to allow passage of air from the branch air flow passage 129 at least one of the first retractable fan 200 or the second retractable fan 200'. [S409: Optional Branch Flow Air Passage Step].

If the optional steps S405 to S409 is not desired based on the user input in step S401, the process may go immediately from step S403 to step S411. [S411: Humidity Generation Step]. The air from the main air flow passage pressurized by the inlet fan 403 and sent to the steam generator 407 through the air transfer duct 405. The humidification pump 417 supplies water from the bucket 419 to the steam generator 407 under control of the controller 600, and the steam generator 407 produces steam from the liquid transferred from the bucket 419. The generated steam is mixed with the air delivered through the transfer duct 405.

The humidified air may be delivered to at least one of the first retractable duct 234 or the second retractable duct 234' through at least one of the first discharge duct 409 or the second discharge duct 411 based on opening or closing of dampers. [S413: Humidity Delivery to the Retractable Fan Step]. For example, when the humidified air is discharged through the first retractable duct 234 on the left side of the housing 10, the damper for the first discharge duct 409 is opened for connection or communication the first connection passage 205 of the first connection duct 204. The first damper 206 may be closed to cut off communication with between the branch air flow passage 219 and the first connection duct 204 to prevent mixing of air and humidified air causing formation of condensation or moisture in the first connection duct 204.

If a user selects rotation of the first retractable fan 200 through the input unit 17, the controller 600 initiates the rotation of the first retractable fan 200. [S415: User Operation Input]. As can be appreciated, such an input may be previously provided through step S401. Based on the rotary motor 226 being driven, the first retractable fan 200 rotates to further disperse the humidified air. [S417: Rotation of Retractable Fan Step].

Figure 47:
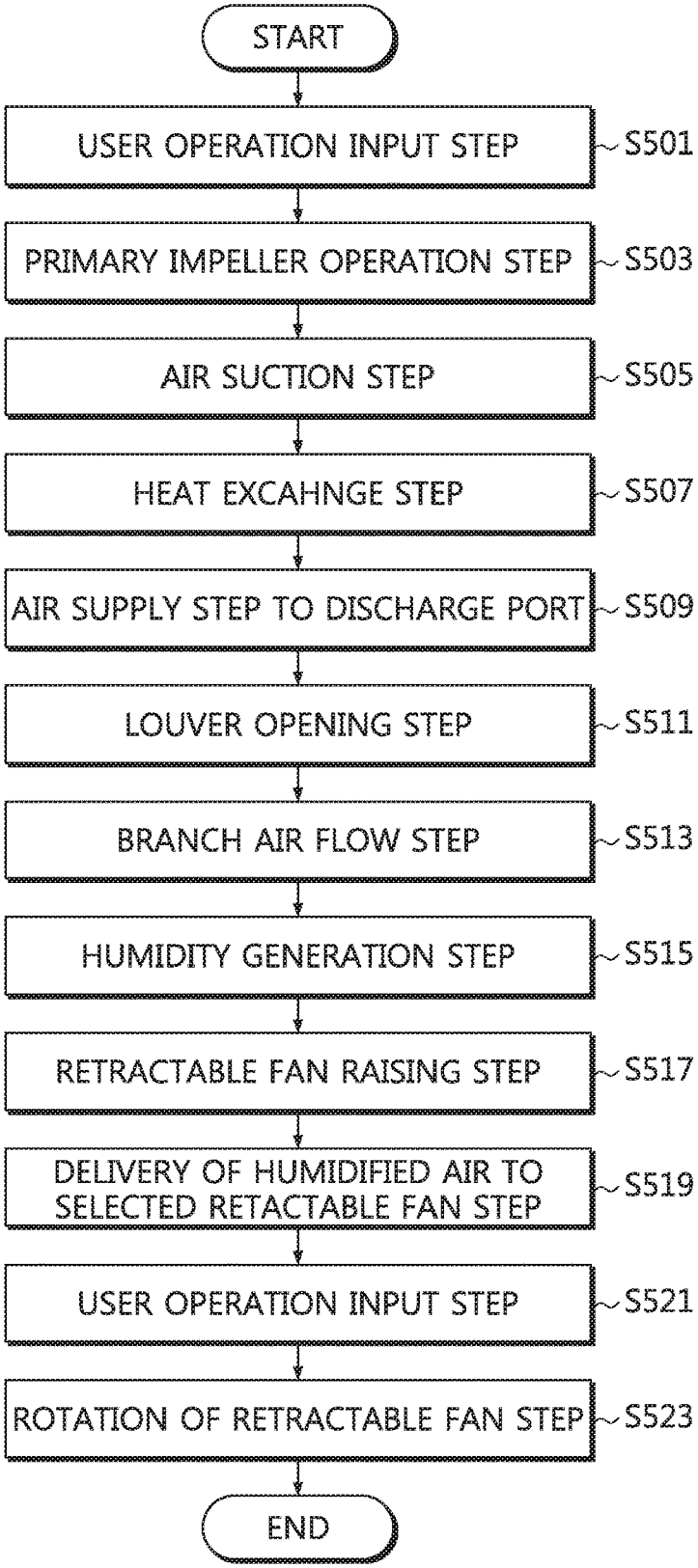

FIG. 47 in conjunction with FIG. 42 illustrate an additional control method of the air management apparatus for discharging the humidified air through at least one of the first retractable fan 200 or second retractable fan 200' with the heat exchanger 104 turned ON for simultaneously performing the air temperature setting and humidification.

The user may input a user operation for air temperature setting and humidification through the input unit 17 formed on the front surface of the housing 10 of the air management device. The user may directly input the user operation by directly touching the input unit 17 or may input the user operation through wireless communication with an external device. [S501: User Operation Input Step].

If it is determined that a valid user operation is input through the input unit 17, the controller 600 may start the operation of the air management device by starting the operation of at least one of the primary impellers 131, 131', 131" to rotate at least one of the primary impeller blades 130, 130' and 130", respectively. [S503: Drive Fan Operation Step]. When at least one of the primary impellers 131, 131', 131" are operated, air surround the housing 10 is drawn through the bottom inlet 11' and introduced into the main air flow passage 102. [S505: Air Suction Step]. When the air flows into the main air flow passage 102 of the primary air flow space through the bottom inlet 11', heat exchange proceeds in the heat exchanger 104 disposed inside the housing 10. To this end, the controller 600 drives the heat exchanger 104 to perform heat exchange. [S507: Heat Exchange Step].

The heat exchanged air of the heat exchanger 104 may be delivered to at least one of the discharge ports 15'-1, 15'-2, 15'-3 provided on the front plate 15 of the front plate 15 by the rotation of at least one of the primary impellers 130, 130', 130". The discharge ports 15'-1, 15'-2, and 15'-3 serve to discharge the heat exchanged air to the livable space in which the housing 10 is located. [S509: Air Supply Step to Discharge Port]. Because the louvers 141, 142, 143 determine opening and closing of the outlets 15'-1, 15'-2, 15'-3, the louvers 141, 142, 143 must be opened. [S511: Louver Opening Step].

The heat exchanged air as described above may be supplied to at least one of the first retractable fan 200 or the second retractable fan 200' through the corresponding branch air flow passage. For example, if the user input selected discharge of air through the first retractable fan 200, the branch air flow passage 129 allows heat exchange air to flow to first connection passage 205 of the first connection duct 204 by opening the first damper 206. [S513: Branch Air Flow Step].

The inlet fan 403 of the humidifier 400 draws in air from the main air flow passage 102 to deliver the air to the steam generator 407 through the air transfer duct 405. The steam generator 407 heats the liquid delivered from the bucket 419 to generate steam, and the steam is thus mixed with the air delivered through the air transfer duct 405. [S515: Humidifying Air Generation Step].

At least one of the first retractable fan 200 or the second retractable fan 200' may be raised to discharge humidified air or heat exchange air to the outside. For example, if the user selects on the first retractable fan 200 in step S501, the controller initiates the operation of the lift motor 230 installed in the first lift platform 214. The rotation of the second lift gear 232 coupled to the shaft of the lift motor 230 and engaged with the first lift gear 212 vertically raises the first lift platform 214. As a result, the first retractable duct 234 coupled to the first support ring 216 vertically rises with the first lift platform 214. [S517: Retractable Fan Rising Step].

The humidified air is supplied to at least one of the first retractable fan 200 or the second retractable fan 200' through at least one the first discharge duct 409 or the second discharge duct 411. For example, if the user selection in Step S501 indicates discharge of heat exchanged air through the second retractable fan 200' and discharge of humidified air to the first retractable fan 200, the first damper 206 may be closed while the first discharge duct 409 of the humidifier 400 is opened to allow passage of humidified air to the first connection passage 205 such that the heat exchange air, especially cooled air, provided through the branch air flow passage 129 may not mix with the humidified air to form condensation of liquid in the first connection duct 204. [S519: Delivery of Humidified Air to Selected Retractable Step].

If a user selects rotation of the first retractable fan 200 through the input unit 17, the controller 600 initiates the rotation of the first retractable fan 200. [S521: User Operation Input]. As can be appreciated, such an input may be previously provided through step S501. Based on the rotary motor 226 being driven, the first retractable fan 200 rotates to further disperse the humidified air. [S523: Rotation of Retractable Fan Step].

In the illustrated embodiment, three discharge ports 15'-1, 15'-2, and 15'-3 are disclosed, but any number may be possible with different sized opening. Further, there may be one-to-one correspondence between the number of discharge ports and number of louvers, variations are possible, e.g., two discharge ports with a single louver to open or close the discharge ports. Various configurations of discharge port opened/closed and first and second retractable fans protruding from the upper surface of the housing 10 are possible. For example, the louvers may be closed to deliver the heat exchange air only to at least one of the first retractable fan 200 or second retractable fan 200' or air sent to the opened louvers and protruding retractable fan. In other words, due to the independent operation of the louvers and retractable fans, the configuration for discharging air may be independently controlled by the user.

In the illustrated embodiment, the branch air flow passage 129 is in communication with the first vertical duct 208 through the first connection duct 204. However, the branch air flow passage 129 and the vertical duct 208 may be directly connected with the first damper 206 interposed therebetween. In the illustrated embodiment, in the position of the first vertical duct 208 in the first inner frame 202 is biased toward the end of the housing 10 relatively away from the primary air flow space 20. However, if the position of the vertical duct 208 is adjacent to the primary air flow space 20, the connection duct 204 may be omitted, and/or the first discharge duct 409 may be directly connected to the vertical duct 208.

In the illustrated embodiment, the first movable panel 16 is described as being automatically opened and closed, but this may not be required. A user may directly open or close the first movable panel 16. Further, the tilting table 449 of the bucket seat 415 may be tilted by pressing a button or manually tilted.

Further, the lift motor 230 may be installed at the top of the first vertical flow path 210, and the first lift gear 212 may be formed in the vertical direction on the rear surface of the first retractable duct 234.

Although three filters 320, 330, and 340 may be used, less than three filters may be used. In addition, although three passing regions 302 are formed in the filter frame 301, the number may be less. The rail assembly 350 may assist moving the filter frame 301 in and out of the housing 10, but the rail assembly 350 may not necessarily used, and the filter frame 301 may be pulled in and out without the rail assembly 350.

In the illustrated embodiment, the suction force at the cleaner suction opening 373 may be prevented from being leaked using the elastic bristles 375, but various leakage blocking members such as elastic seals are used.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A furniture assembly comprising:

a housing having left and right side plates, a front plate with at least one discharge port, a top plate with at least one opening, a back plate and a bottom plate with a bottom inlet, the housing defining an interior space and configured to be placed in a livable space with a gap between the bottom inlet and a floor of the livable space;

an air management device provided in the interior space of the housing, wherein the air management device includes:

at least one impeller to create an air flow from air of the livable space to pass through the bottom inlet and discharge through the at least one discharge port, a heat exchanger configured to exchange heat between the working fluid of the heat exchange cycle and the air of the air flow, and at least one retractable fan configured to pop-up through the at least one opening of the top plate, the at least one retractable fan discharging at least a portion of the air diverted from the air flow;

an input unit configured to receive a user input and provided on the housing; and a control unit configured to control the at least one impeller, the heat exchanger and the at least one retractable fan based on the user input.

2. The furniture assembly of claim 1, wherein the housing further includes a plurality of legs of a predetermined height connected to the bottom plate of the housing to create the gap.

3. The furniture assembly of claim 1, wherein the at least one opening comprises first and second openings provided at each end of the housing, and the at least one retractable fan includes a first retractable fan configured to pop-up through the first opening and a second retractable fan configured to pop-up through the second opening.

4. The furniture assembly of claim 1, wherein the interior space is partitioned into a primary space and at least one second secondary space, the heat exchanger and the at least one impeller is provided in the primary space, and the at least one retractable fan is provided in the at least one secondary space.

5. The furniture assembly of claim 1, wherein based on the user input received through the input device, the at least one retractable fan pops up through the at least one opening and rotate along a vertical axis.

6. The furniture assembly of claim 1, wherein the air management device further includes a guide having at least one space to house the at least one impeller, the guide being provided adjacent to at least one discharge port.

7. The furniture assembly of claim 6, wherein the at least one impeller is provided between the heat exchanger and the at least one discharge port to draw in the air through the bottom inlet and discharge the air through the at least one discharge port.

8. The furniture assembly of claim 6, wherein the guide includes at least one branch air flow passage to divert at least a portion of the air flow to the at least one retractable fan.

9. The furniture assembly of claim 8, wherein the housing further includes at least one damper provided between the at least one branch air flow passage and the at least one retractable fan to control a passage of the diverted air.

10. The furniture assembly of claim 1, further comprising a replaceable filter provided over the bottom inlet.

11. The furniture assembly of claim 10, wherein the replaceable filter is configured to be retracted through a front bottom section of the housing.

12. The furniture assembly of claim 1, further comprising a cleaner to clean the replaceable filter, provided below the bottom inlet and configure to move along a rail attach at the bottom plate along a width direction of the housing.

13. The furniture assembly of claim 1, wherein the housing further includes at least one louver to open or close the at least one discharge port.

14. The furniture assembly of claim 13, wherein the at least one louver is configured to pivot to control an angle of the air discharged through the at least one opening, and the controller is configured to control the angle based on the user input.

15. The furniture assembly of claim 1, wherein the air management device further includes a humidifier provided between the heat exchanger and the at least one retractable fan, and the at least one retractable fan is configured to discharge the diverted air mixed with liquid vapors generated by the humidifier.

16. The furniture assembly of claim 15, wherein the housing further includes a front movable panel to open or close a space housing the humidifier.

17. A furniture assembly comprising:

a housing a housing having left and right side plates, a front plate with a plurality of discharge ports, a top plate with first and second openings, a back plate and bottom plate with a bottom inlet spaced above a floor of the livable space by a plurality of legs, the housing defining an interior space partitioned into a primary space and first and second secondary space by first and second partition walls, and the plurality of discharge ports being provided between the first and second openings;

an air management device provided in the interior space of the housing, wherein the air management device includes:

a plurality of impellers provided in the primary space and configured to create an air flow from air of the livable space to pass through the bottom inlet and discharge through the plurality of discharge ports, a heat exchanger provided in the primary space and configured to exchange heat between the working fluid of the heat exchange cycle and the air of the air flow, a first retractable fan provided in the first secondary space and configured to pop-up through the first opening of the top plate, and a second retractable fan provided in the second secondary space and configured to pop-up through the second opening of the top plate, the first and second retractable fans being configured to discharge at least a portion of the air diverted from the air flow;

a user interface configured to receive a user input and provided on the housing; and a control unit configured to control the plurality of impellers, the heat exchanger and the first and second retractable fans based on the user input received through the user interface.

18. The furniture assembly of claim 17, wherein the first and second secondary space includes first and second vertical ducts, respectively, and the first and second retractable fans are provided in the first and second vertical ducts, respectively.

19. The furniture assembly of claim 17, wherein the front plate includes a bottom opening to house a replaceable filter.

20. The furniture assembly of claim 19, wherein the replaceable filter is provided in a drawer configured to be withdrawn through the bottom opening.

* * * * *